US012391452B2

(12) United States Patent
Hermanson et al.

(10) Patent No.: US 12,391,452 B2
(45) Date of Patent: Aug. 19, 2025

(54) PACKING MATERIAL AND METHOD OF MANUFACTURING THE PACKING MATERIAL

(71) Applicant: Terry Hermanson, Memphis, TN (US)

(72) Inventors: Terry Hermanson, Jackson, WY (US); Huang Meng-Suen, Hong Kong (CN)

(73) Assignee: Terry Hermanson, Memphis, TN (US)

( * ) Notice: Subject to any disclaimer, the term of this patent is extended or adjusted under 35 U.S.C. 154(b) by 0 days.

(21) Appl. No.: 18/884,705

(22) Filed: Sep. 13, 2024

(65) Prior Publication Data

US 2025/0091787 A1 Mar. 20, 2025

Related U.S. Application Data

(60) Provisional application No. 63/673,406, filed on Jul. 19, 2024, provisional application No. 63/624,460, filed on Jan. 24, 2024, provisional application No. 63/538,629, filed on Sep. 15, 2023.

(51) Int. Cl.
*B65D 81/05* (2006.01)
*B65D 81/127* (2006.01)

(52) U.S. Cl.
CPC ..... *B65D 81/127* (2013.01); *B65D 2581/053* (2013.01)

(58) Field of Classification Search
CPC .... B65D 81/127; B65D 81/05; B65D 81/052; B65D 2581/053; B65D 81/053; B65D 81/057; B65D 81/055; B65D 2581/051
USPC ..... 206/521, 522, 586
See application file for complete search history.

(56) References Cited

U.S. PATENT DOCUMENTS

| | | | |
|---|---|---|---|
| 950,785 | A | 3/1910 | Pene |
| 1,189,140 | A | 6/1916 | Lane |
| 1,710,543 | A | 4/1929 | Leo |
| 1,984,653 | A | 12/1934 | Palmer et al. |
| 2,020,639 | A | 11/1935 | Grayson et al. |
| 2,045,384 | A | 6/1936 | Gerb |

(Continued)

FOREIGN PATENT DOCUMENTS

| | | | |
|---|---|---|---|
| CA | 2472739 | A1 | 12/2005 |
| CN | 102712400 | A | 10/2012 |

(Continued)

OTHER PUBLICATIONS

Comprehensive Guide to cushioning and void fill for shipping packaging, Internet Archive of https://www.ecoenclose.com/Definitive-Guide-to-Void-Fill-and-Cushioning/ (captured Sep. 18, 2019), available at https://web.archive.org/web/20190918180012/https://www.ecoenclose.com/Definitive-Guide-to-Void-Fill-and-Cushioning/.

(Continued)

*Primary Examiner* — Steven A. Reynolds
(74) *Attorney, Agent, or Firm* — Venable LLP

(57) ABSTRACT

Cellulosic packing materials, layers for the cellulosic packing materials, and panels therefor. The panels can be cushioning panels and, more specifically, cellulosic cushioning panels, such as cushioning panels formed from molded pulp or corrugated fiberboard sheets. The panels can be rigid panels and, more specifically, cellulosic rigid panels. The cellulosic cushioning panels can form cushioning layers, and the rigid panels can form rigid layers. Cushioning bocks and packing materials can be formed from the cushioning layers and rigid layers.

30 Claims, 51 Drawing Sheets

(56) References Cited

U.S. PATENT DOCUMENTS 2,115,745 A 5/1938 Page
2,657,158 A 10/1953 Gerard
2,744,624 A 5/1956 Hoogstoel et al.
2,924,154 A 2/1960 Russell et al.
2,978,006 A 4/1961 Clemens
3,040,948 A 6/1962 Wells
3,074,543 A 1/1963 Stanley
3,131,240 A 4/1964 Kirkpatrick
3,231,454 A 1/1966 Williams
3,509,797 A 5/1970 Johnson
3,530,020 A 9/1970 Liebermann
3,542,636 A 11/1970 Wandel
3,546,055 A 12/1970 Spertus
3,574,103 A 4/1971 Latkin
3,616,158 A 10/1971 Rubens et al.
3,650,877 A 3/1972 Johnson
3,655,500 A 4/1972 Johnson
3,669,820 A 6/1972 Fredericks
3,741,411 A 6/1973 Peacock
3,741,859 A 6/1973 Wandel
3,756,904 A 9/1973 Fredericks
3,812,618 A 5/1974 Wood et al.
4,034,135 A 7/1977 Passmore
4,039,708 A 8/1977 Seltz et al.
4,384,442 A 5/1983 Pendleton
4,644,733 A 2/1987 Dolinar
4,680,918 A 7/1987 Lovell
4,806,410 A 2/1989 Armington et al.
4,828,913 A 5/1989 Kiss
4,880,119 A 11/1989 Simon
4,937,131 A 6/1990 Baldacci et al.
4,941,922 A 7/1990 Snyder
4,997,091 A 3/1991 McCrea
5,007,579 A 4/1991 Thomas, Jr.
5,102,036 A 4/1992 Orr et al.
5,151,312 A 9/1992 Boeri
5,230,943 A 7/1993 Pregont
5,251,414 A 10/1993 Duke
5,270,095 A 12/1993 Ito et al.
5,312,665 A 5/1994 Pratt et al.
5,330,165 A 7/1994 van Goubergen
5,340,638 A 8/1994 Sperner
5,468,556 A 11/1995 Fuss et al.
5,540,972 A * 7/1996 Jaegers ..... B32B 38/00 428/116
5,545,297 A 8/1996 Andersen et al.
5,568,867 A 10/1996 Lencoski
5,569,519 A 10/1996 Ervay et al.
5,595,811 A 1/1997 Stout, Jr.
5,623,815 A 4/1997 Hornstein et al.
5,636,744 A 6/1997 Hirose
5,639,543 A 6/1997 Isoda et al.
5,658,624 A 8/1997 Anderson et al.
5,674,344 A 10/1997 Thompson et al.
5,683,772 A 11/1997 Andersen et al.
5,688,578 A 11/1997 Goodrich
5,756,127 A 5/1998 Grisoni et al.
5,799,861 A 9/1998 Bonner et al.
5,826,404 A 10/1998 Fuss et al.
5,871,857 A 2/1999 Alhamad
5,900,119 A 5/1999 Goers et al.
5,910,079 A 6/1999 Watanabe
5,910,089 A 6/1999 Weder
5,944,192 A 8/1999 Weder
5,992,637 A 11/1999 Weder
6,067,779 A 5/2000 Weder
6,128,889 A 10/2000 Fuss
6,190,756 B1 2/2001 Yokoyama et al.
6,254,945 B1 7/2001 Simmons
6,298,637 B1 10/2001 Weder
6,385,949 B2 5/2002 Weder
6,532,721 B1 3/2003 Weder
6,546,701 B2 4/2003 Weder et al.
6,632,165 B1 10/2003 Letourneau et al.
6,752,910 B2 6/2004 Sato et al.
6,797,119 B2 9/2004 Koike
6,871,480 B1 3/2005 Goodrich
6,969,548 B1 11/2005 Goldfine
7,614,201 B2 11/2009 Cabanski et al.
7,651,455 B2 1/2010 Yampolsky et al.
7,803,100 B2 9/2010 Lu et al.
8,052,037 B2 11/2011 Bussey, III et al.
8,146,748 B2 4/2012 Vulpitta
8,201,671 B2 6/2012 Cho
8,360,949 B2 1/2013 Wetsch et al.
8,763,667 B2 7/2014 De Luca
8,900,111 B2 12/2014 Wetsch et al.
8,999,490 B2 4/2015 Kung et al.
9,205,621 B2 12/2015 Cheich
9,266,658 B2 * 2/2016 Kuo ..... B65D 81/1275
9,315,312 B2 4/2016 De Luca et al.
9,427,928 B2 8/2016 Arora et al.
9,457,982 B2 10/2016 Wetsch et al.
9,688,044 B2 6/2017 Deis et al.
10,099,836 B2 10/2018 Cheich
10,357,936 B1 7/2019 Vincent et al.
10,392,177 B2 8/2019 Lantz
10,766,220 B2 9/2020 Deis et al.
10,766,221 B2 9/2020 Deis et al.
10,792,882 B2 10/2020 Wetsch et al.
10,828,859 B2 11/2020 Ciasullo, Jr. et al.
11,123,943 B2 9/2021 Cheich et al.
11,161,668 B1 11/2021 Hermanson et al.
11,167,907 B1 11/2021 Hermanson et al.
11,358,775 B2 6/2022 Hermanson et al.
11,390,443 B2 7/2022 Hermanson et al.
11,390,444 B2 7/2022 Hermanson et al.
2002/0040859 A1 4/2002 Weder
2003/0051819 A1 3/2003 Moustier
2004/0050743 A1 3/2004 Slovencik et al.
2004/0052988 A1 3/2004 Slovencik et al.
2004/0108243 A1 6/2004 Jeannin
2005/0230864 A1 10/2005 Ozasa et al.
2006/0281621 A1 12/2006 Weder
2007/0082181 A1 4/2007 Jung
2007/0095711 A1 * 5/2007 Thompson ..... B65D 5/603 206/522
2008/0153685 A1 6/2008 Cheich et al.
2009/0082187 A1 3/2009 Cheich et al.
2010/0227116 A1 9/2010 Leylekian et al.
2010/0323153 A1 12/2010 Huskey
2011/0053743 A1 3/2011 Wetsch et al.
2011/0061986 A1 3/2011 Orsini et al.
2012/0031957 A1 2/2012 Whitaker
2012/0097067 A1 4/2012 Fascio
2012/0104009 A1 5/2012 Fascio
2012/0165172 A1 6/2012 Wetsch et al.
2012/0237717 A1 * 9/2012 Dunn ..... B32B 29/007 428/116
2013/0171422 A1 7/2013 De Luca
2013/0313277 A1 11/2013 Stewartson et al.
2014/0155241 A1 6/2014 Cheich et al.
2015/0314940 A1 * 11/2015 Matta ..... B65D 75/58 206/522
2016/0060014 A1 3/2016 Timmers et al.
2016/0221233 A1 8/2016 Kiiskinen et al.
2018/0029764 A1 2/2018 Chung et al.
2018/0030659 A1 2/2018 Chung et al.
2018/0086531 A1 * 3/2018 Lefkow ..... B65D 31/10
2018/0126686 A1 5/2018 Nelson et al.
2018/0264768 A1 9/2018 Haug
2018/0319116 A1 11/2018 Haug
2018/0370702 A1 12/2018 Goodrich
2019/0092549 A1 * 3/2019 Buelna ..... B65D 77/26
2019/0241342 A1 8/2019 Kling
2020/0061951 A1 2/2020 Slovencik
2020/0063361 A1 2/2020 Everett et al.
2020/0115087 A1 4/2020 Hagestedt et al.
2020/0139661 A1 5/2020 Greenwell
2020/0180841 A1 6/2020 Alvarez et al.
2020/0290790 A1 * 9/2020 Mowery ..... F25D 3/08
2020/0406592 A1 * 12/2020 Dayrit ..... B32B 7/12
2021/0061535 A1 3/2021 Moore et al.
2021/0179333 A1 * 6/2021 Wetsch ..... B65D 65/40

(56) References Cited

U.S. PATENT DOCUMENTS

| | | | |
|---|---|---|---|
| 2021/0237961 | A1 | 8/2021 | Lenart et al. |
| 2022/0009693 | A1 | 1/2022 | Wu |
| 2022/0072905 | A1 | 3/2022 | Brousseau et al. |

FOREIGN PATENT DOCUMENTS

| | | | |
|---|---|---|---|
| CN | 104371343 | A | 2/2015 |
| CN | 107984859 | A | 5/2018 |
| CN | 111070843 | A | 4/2020 |
| DE | 3817490 | | 11/1989 |
| DE | 40 25 257 | C2 | 9/1992 |
| DE | 42 25 143 | A1 | 2/1994 |
| DE | 9414805 | U1 | 11/1994 |
| DE | 4319792 | A1 | 12/1994 |
| DE | 202004010558 | U1 | 9/2004 |
| DE | 102007005001 | A1 | 8/2008 |
| DE | 102015109972 | A1 | 12/2016 |
| EP | 0560608 | A1 | 9/1993 |
| EP | 3415443 | A | 12/2018 |
| EP | 3747798 | A1 | 12/2020 |
| EP | 3981588 | A1 | 4/2022 |
| GB | 689693 | A | 4/1953 |
| GB | 1119244 | A | 7/1968 |
| GB | 2368074 | | 4/2022 |
| JP | 27634/1994 | U1 | 4/1994 |
| JP | 3003200 | U | 8/1994 |
| JP | H06-247471 | A | 9/1994 |
| JP | H08-244853 | A | 9/1996 |
| JP | 2000118571 | A | 4/2000 |
| JP | 2002-225946 | A | 4/2002 |
| JP | 2008-273574 | A | 11/2008 |
| JP | 2009-513383 | A | 4/2009 |
| JP | 2009-286439 | A | 12/2009 |
| KR | 100832094 | B1 | 5/2008 |
| KR | 101085309 | B1 | 11/2011 |
| WO | 92/04253 | A1 | 3/1992 |
| WO | 94/12576 | | 6/1994 |
| WO | 97/09248 | | 3/1997 |
| WO | 02/102592 | A1 | 12/2002 |
| WO | 2017-034910 | A1 | 3/2017 |
| WO | 2023/176001 | A1 | 9/2023 |

OTHER PUBLICATIONS

ExpandOS, https://expandos.com, visited Oct. 29, 2020.

"Paper Packaging Applications", Paper Packaging Systems, https://www.paperpackagingsystems.com/paper-packaging-applications-paper, visited Oct. 29, 2020.

"Crinkle Cut Fill", Bags and Bows Online, https://www.bagsandbowsonline.com/retail-packaging/search?Ntt=crinkle cut fill, visited Oct. 29, 2020.

"Molded Pulp Bubble Wrap," YouTube, with selected screen shots, available at https://youtu.be/36g0IVZ6OU8?si =-4upcDe4TydOEOtL (accessed Dec. 6, 2023).

"Paper Bubble Cushioning", Lumi Products https://www.lumi.com/products/paper-bubble-cushioning (accessed Dec. 16, 2023).

"Corrugated Paper Board"; Easty Limited; https://www.eastyltd.com/Corrugated-Paper-board-CardBoard-p49.html (Accessed: Aug. 27, 2020).

"Hexacomb Packaging"; Packaging Corporation of America; https://www.packagingcorp.com/packaging-solutions/need/protect-products/hexacomb/ (Accessed: Aug. 27, 2020).

"Layered Cardboard Sheet at the best price"; https://www.mwmaterialsworld.com/en/layered-cardboard-sheet.html (Accessed: Aug. 27, 2020).

"Production of Honeycomb Cardboard for sandwich panels"; Bui Giordano; https://www.giordanobui.com/en/main-products/honeycomb-panel/ (Accessed: Aug. 27, 2020).

"Honeycomb by Multi-Wall" brochure from Multi-Wall Packaging (https://www.multiwall.com/honeycomb/); downloaded Aug. 10, 2020.

"Sculpture7"; The Art Teacher (https://artteacherblog.wordpress.com/2016/04/26/cardboard-sculpture/sculpture7/#main) (Accessed: Feb. 8, 2024).

"What is Honeycomb Cell Technology?"; Pallite Group, (https://pallitegroup.com/us/news/what-is-honeycomb-technology/), (Accessed Jun. 13, 2024).

"Custom Paper Bubble Cushioning", Lumi, (https://www.lumi.com/products/paper-bubble-cushioning), (Accessed Dec. 6, 2023).

Search Report and Written Opinion dated Nov. 11, 2024, in International Patent Application No. PCT/US2024/046675.

* cited by examiner

PACKING MATERIAL AND METHOD OF MANUFACTURING THE PACKING MATERIAL

CROSS-REFERENCE TO RELATED APPLICATIONS

This application claims the benefit under 35 U.S.C. § 119(e) of U.S. Provisional Patent Application No. 63/673,406, filed Jul. 19, 2024, and titled "PACKING MATERIAL AND METHOD OF MANUFACTURING THE PACKING MATERIAL." This application claims the benefit under 35 U.S.C. § 119(e) of U.S. Provisional Patent Application No. 63/624,460, filed Jan. 24, 2024, and titled "PACKING MATERIAL AND METHOD OF MANUFACTURING THE PACKING MATERIAL." This application claims the benefit under 35 U.S.C. § 119(e) of U.S. Provisional Patent Application No. 63/538,629, filed Sep. 15, 2023, and titled "PACKING MATERIAL AND METHOD OF MANUFACTURING THE PACKING MATERIAL." The foregoing applications are incorporated herein by reference in their entireties.

FIELD OF THE INVENTION

The invention relates to packing material and to methods of manufacturing the same.

BACKGROUND OF THE INVENTION

Various packing materials are used to secure and protect items in shipping containers, including cardboard boxes, to thereby prevent damage to these items if they move within the shipping container during shipment or other impacts during shipping, air, and land transport, such as being dropped or impacted. Such packing materials include bubble wrap, expanded polystyrene foam (EPS foam), and other plastic foam packing, which may be molded into blocks or into other shapes, peanuts, and inflated plastic bags (also known as air pillows). These plastic products may be discarded as waste after they have been used during shipping. Plastic waste takes a significant time to decompose and produces carbon dioxide in the decomposition process. In addition, EPS foam does not readily biodegrade and may take many, many years to effectively break down.

SUMMARY OF THE INVENTION

In one aspect, the invention relates to cushioning panels and, more specifically, cellulosic cushioning panels, such as cushioning panels formed from molded pulp or corrugated fiberboard sheets.

In another aspect, the invention relates to rigid panels and, more specifically, cellulosic rigid panels.

In a further aspect, the invention relates to packing materials including a plurality of layers, such as cushioning layers formed from the cushioning panels, the rigid panels, or both.

In still another aspect, the invention relates to a packing material including one or more cushioning layers. Each cushioning layer includes a first cushioning panel and a second cushioning panel. The first cushioning panel has a first base layer with a plurality of first projections extending therefrom. Each of the first projections has a distal end that is distal from the first base layer. The first cushioning panel is a molded pulp panel. The second cushioning panel has a second base layer with a plurality of second projections extending therefrom. Each of the second projections has a distal end that is distal from the second base layer. The second cushioning panel is a molded pulp panel. The first cushioning panel is positioned with the plurality of first projections projecting toward the second cushioning panel. The second cushioning panel is positioned with the plurality of second projections projecting toward the first cushioning panel, and at least a portion of the second projections of the plurality of second projections being second contacting projections. The distal ends of the second contacting projections contact the first cushioning panel.

In still a further aspect, the invention relates to composite packing material including one or more cushioning layers arranged to have a product side and an outer side and a cellulosic sheet positioned on the outer side of the one or more cushioning layers. Each cushioning layer includes a first cushioning panel and a second cushioning panel. The first cushioning panel has a first base layer with a plurality of first projections extending therefrom. The first cushioning panel is a molded pulp panel. The second cushioning panel has a second base layer with a plurality of second projections extending therefrom. The second cushioning panel is a molded pulp panel. The first cushioning panel and the second cushioning panel are positioned to contact each other with the plurality of first projections projecting toward the second cushioning panel and the plurality of second projections projecting toward the first cushioning panel.

In yet another aspect, the invention relates to composite packing material including a cushioning layer and a rigid panel. The cushioning layer includes a cushioning panel having a base layer with a plurality of projections extending therefrom. Each of the projections has a distal end that is distal from the base layer. The cushioning panel is a molded pulp panel. The rigid panel contacts the cushioning layer. The rigid panel is formed of a cellulosic material. The rigid panel has a rigidity greater than that of the cushioning panel when a load is applied in a thickness direction of the rigid panel or the cushioning panel.

In yet a further aspect, the invention relates to a packing material including one or more cushioning blocks capable of being positioned around an object-to-be-shipped on a product side of each cushioning block. Each cushioning block includes one or more cushioning layers. Each cushioning layer includes a first cushioning panel and a second cushioning panel. The first cushioning panel has a first base layer with a plurality of first projections extending therefrom. Each of the first projections has a distal end that is distal from the first base layer. The first cushioning panel is a molded pulp panel. The second cushioning panel has a second base layer with a plurality of second projections extending therefrom. Each of the second projections has a distal end that is distal from the second base layer. The second cushioning panel is a molded pulp panel. The first cushioning panel is positioned with the plurality of first projections projecting toward the second cushioning panel, and the second cushioning panel is positioned with the plurality of second projections projecting toward the first cushioning panel.

These and other aspects of the invention will become apparent from the following disclosure.

BRIEF DESCRIPTION OF THE DRAWINGS

FIG. 10A is a first step, and FIG. 10B is a second step.

FIG. 11A is a first step, and FIG. 11B is a second step. FIG. 11C shows an optional additional step.

FIG. 11D shows another optional additional step. 11E shows an alternative optional additional step.

DETAILED DESCRIPTION OF THE PREFERRED EMBODIMENTS

With an increased awareness of the negative effects of plastics and EPS foam on the environment, as discussed above, companies and consumers are increasingly seeking to use environmentally friendly, recyclable, and biodegradable products as a packing material. The packing materials discussed herein provide environmentally friendly, recyclable, and biodegradable products while also providing sufficient protection and cushioning effects at an affordable cost. In particular, embodiments discussed herein may be environmentally friendly, recyclable, and biodegradable replacements for EPS and other plastic foams (e.g., expanded polyethylene, or EPE, foam).

Figure 1:
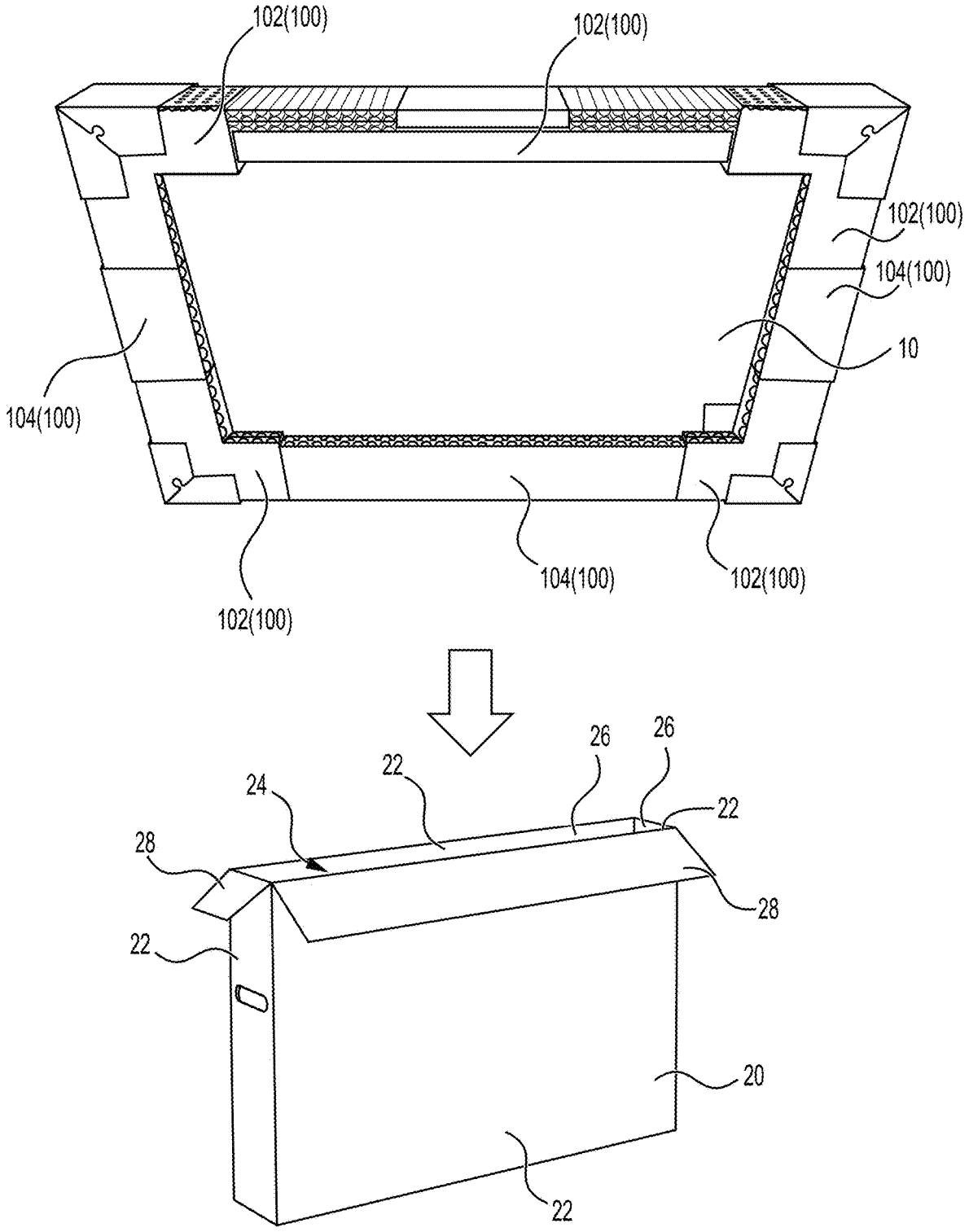
FIG. 1 shows packing materials formed according to the present disclosure to protect an item-to-be-shipped.

FIG. 1 shows packing materials 100 formed according to the present disclosure used to protect an item-to-be-shipped, such as a flat-panel television, during shipping. The item-to-be-shipped is referred to herein as a product 10. The packing materials 100 can be arranged around the product 10 in various different arrangements to protect the product during shipping. As will be discussed further below, however, the packing materials 100 can be arranged with certain features thereof closer to the product 10 than others. The packing materials 100 can include a product side and include a product-side surface. The product-side surface can be in contact with the product 10 in some arrangements.

The packing materials 100 are positioned around the product 10, and the product 10, with the packing materials 100 positioned therearound, can be placed in a shipping container, such as a shipping box 20, for example. The shipping box 20 depicted in FIG. 1 is a corrugated cardboard shipping box, but the packing materials 100 discussed herein can be used with other shipping containers. The shipping box 20 includes a plurality of walls 22 defining an internal cavity 24; more specifically, each wall 22 can include an interior-facing surface 26 delineating the internal cavity 24. As will be discussed further below, the packing materials 100 can be arranged with certain features thereof closer to the shipping box 20 than others. The packing materials 100 can include a container side and include a container-side surface. The container-side surface can be in contact with the interior-facing surfaces 26 of the shipping container (e.g., the shipping box 20). The shipping box 20 can also include a plurality of flaps 28 that can be used to open and close the shipping box 20 to allow access to the internal cavity 24 through an opening.

In FIG. 1, the plurality of packing materials 100 are depicted around the product 10. The packing materials 100, or a portion of the packing materials 100, can be positioned around the product 10 prior to placing the product 10 into the shipping box 20. Other packing methods can be used, such as placing packing materials 100 into the internal cavity 24 of the shipping box 20 before the product 10, after the product 10, together with the product 10, or a combination thereof.

As will be discussed further below, the packing materials 100 can be comprised of a plurality of cushioning blocks in different arrangements to form the packing materials 100. The packing materials 100, depicted in FIG. 1, include, for example, corner-shaped packing materials 102 and U-shaped packing materials 104. In some embodiments, such as those depicted for use in protecting the TV (the product 10) in FIG. 1, the U-shaped packing materials 104 can be elongated, and the packing materials 100 can also be arranged to form elongated packing materials.

Figure 2:
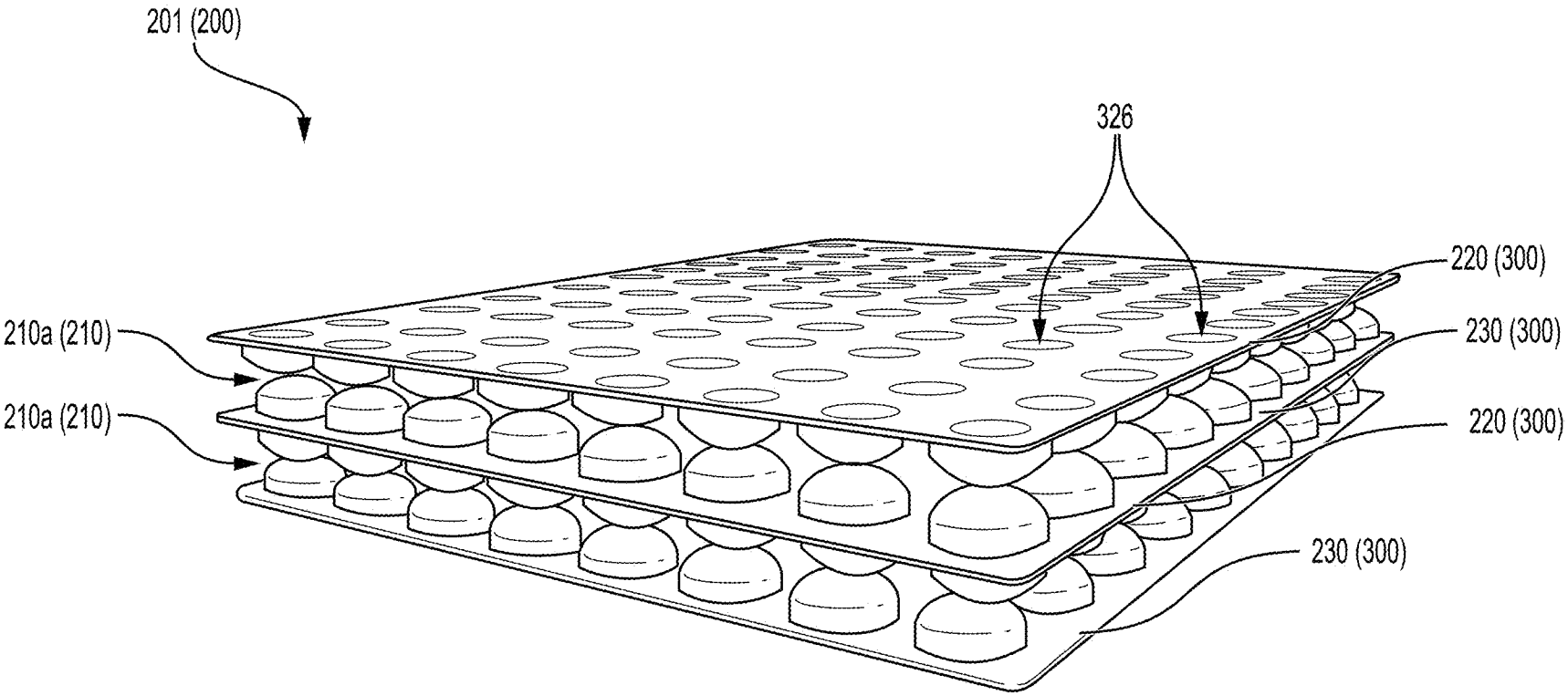
FIG. 2 is a schematic view of a cushioning block that can be used to form the packing materials.

FIG. 2 shows a cushioning block 200 and, more specifically, a cushioning block 201 that can be used to form the packing materials 100 (FIG. 1) discussed herein. As noted above, the packing materials 100 discussed herein can be formed from one or more cushioning blocks 200. The cushioning blocks 200 discussed herein can have several different constructions, but reference numeral 200 is used to refer generally to any one of the cushioning blocks 200 discussed herein. The cushioning blocks 200 discussed herein can include a plurality of layers. In some of the cushioning blocks 200, at least some of the layers may be different from each other in terms of materials, their construction, or both, and these different layers have various different structures, resulting in different strengths, rigidity, and cushioning properties. The cushioning blocks 200, with these different layers and the packing materials 100, may be referred to herein as composite cushioning blocks and composite packing materials. The composite cushioning blocks and composite packing materials can be, for example, a cushioning layer 210, discussed further below, in combination with at least one other, different layer.

The materials of construction also directly affect such properties. As discussed in more detail below, the cushioning blocks 200 can be formed of cellulosic materials. Some layers, or portions thereof, are formed from molded pulp (also referred to as molded fiber), fiberboard, including corrugated fiberboard sheets (also referred to as corrugated cardboard), and paper sheets in different arrangements. The inventors have found that particular arrangements and constructions of these different layers can be successful in protecting the product 10 during shipping, where other arrangements, including the use of certain layers alone, do not provide the same protective capacity.

The cushioning blocks 200 can include one or more cushioning layers. The cushioning block 201 shown in FIG. 2 includes two cushioning layers 210, a first cushioning layer 210*a* and a second first cushioning layer 210*b*. Each cushioning layer 210 can be formed from one or more cushioning panels 300. Various different cushioning panels 300 that can be used to form the cushioning layer 210 are discussed further below, and reference numeral 300 is used herein to refer generally to the various different cushioning panels. More specifically, in FIG. 2, the cushioning layer 210 is formed from a first cushioning panel 220, such as a top cushioning panel, and a second cushioning panel 230, such as a bottom cushioning panel. As will be discussed further below, the cushioning layer 210 can be used in various different arrangements to form the cushioning blocks 200, but the cushioning layer 210 can be used on its own as the cushioning block 201.

Figure 3A:
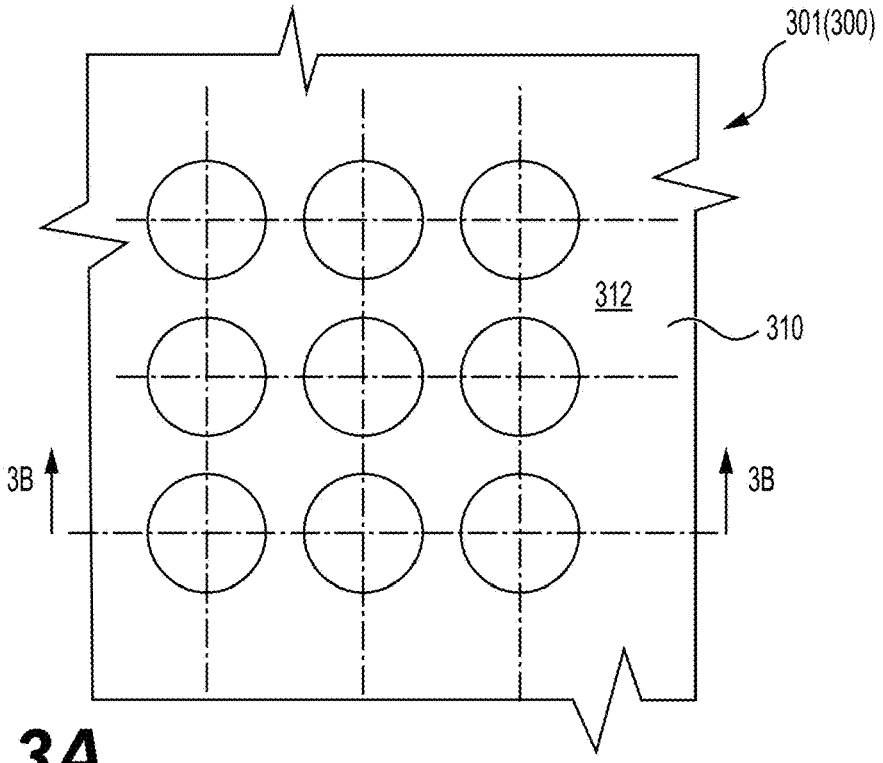
FIG. 3A is a top view of a cushioning panel that may be to form cushioning layers of the packing materials.
Figure 3B:
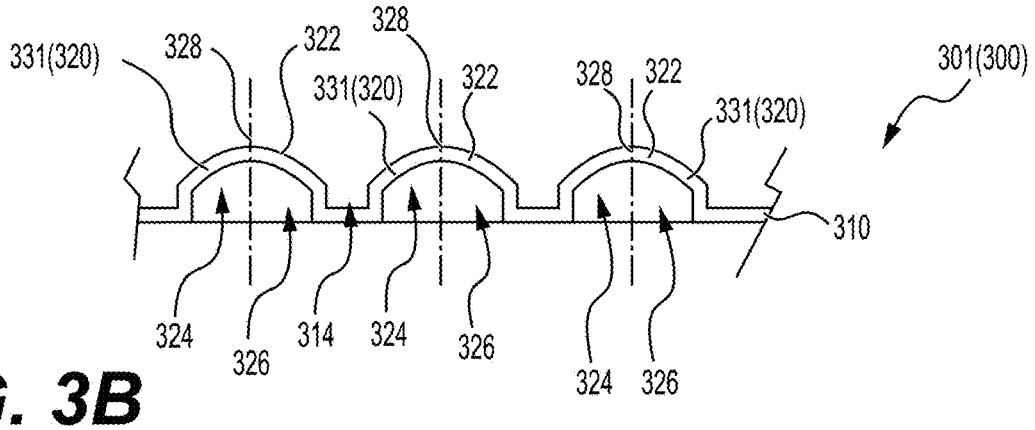
FIG. 3B is a cross-sectional view of the cushioning panel taken shown in FIG. 3A along line 3B-3B in FIG. 3A.

FIG. 3A is a top view of a cushioning panel 301 that may be used as the cushioning panel 300 to form the cushioning layers 210 (FIG. 2) discussed herein. FIG. 3B is a cross-sectional view of the cushioning panel 301 taken along line 3B-3B in FIG. 3A. The cushioning panel 301, shown in FIGS. 3A and 3B, can be used to form the cushioning layer 210 shown in FIG. 2, and more specifically, the cushioning panel 301 can be used to form either one or both of the first cushioning panel 220 or the second cushioning panel 230.

The cushioning panels 300 discussed herein, such as cushioning panel 301, are formed from cellulosic materials, like natural cellulosic materials; as such, cellulosic materials are recyclable and biodegradable. The cushioning panel 301 may be formed by using a molded pulp process (also known as a molded fiber process). The pulp or fibers used in this process are preferably cellulosic pulp and fibers and, even more preferably, pulp produced from post-consumer recycled paper, including newsprint, recycled paperboard/fiberboard, recycled cardboard, recycled corrugated cardboard (OCC), and the like. Wastepaper, including paperboard/fiberboard, recycled cardboard, and OCC, may be dissolved in water to defibrillate paper fibers, forming an aqueous slurry of paper (cellulosic) fibers. Other suitable cellulosic (paper) fiber sources may be used and, in some embodiments, recycled paper fibers may be blended with other cellulosic (paper) fibers. Other suitable defibrillating methods and pulping methods (such as Kraft methods) may be used depending upon the source of cellulosic fibers. Accordingly, the cushioning panels 300 formed using this process can also be referred to as molded cushioning panels.

One such molded pulp process is a vacuum-forming process or wet fiber molding process. A forming tool having a surface shaped to correspond to the cushioning panels 300 discussed herein, such as a surface with a plurality of cylindrical projections, may be placed in the aqueous slurry of paper (cellulosic) fibers. The shaped surface may be referred to as a mold or molding surface. A vacuum is drawn, such as through the molding surface, to remove water and to cause the paper fibers to accumulate on the molding surface and take the shape of the molding surface. Once a desired thickness of paper fibers has been accumulated, the molding surface is removed from the aqueous slurry, and the now-molded paper fibers are allowed to dry. The molded paper fibers may be removed from the molding surface to complete drying, such as in a drying oven.

Other suitable fiber molding processes may be used, including, for example, dry fiber molding processes. In such dry fiber molding processes, the paper pulp/fibers are defibrillated, such as by milling, and then molded in a dry form (e.g., without the aqueous slurry). The dry, defibrillated paper fibers may be molded in a press mold under pressure and temperature to form the desired shape, such as the shapes discussed herein. In some processes, the dry, defibrillated paper fibers may be loosely formed into a sheet (referred to as a fiber sheet) by a vacuum, rolled (or otherwise shaped) to a desired thickness, and then fed to the press mold. Prior to being fed into the press mold, the fiber sheet may optionally include a tissue sheet applied to at least one of the top or bottom of the fiber sheet.

The cushioning panel 301 shown in FIGS. 3A and 3B is formed with a base layer 310, having a plurality of projections 320 extending therefrom. The base layer 310 can be a generally planar layer. The base layer 310 can include a projection side with a projection-side surface 312. Each of the projections 320 can extend from the projection-side surface 312. The other side of the base layer 310 is referred to herein as a back side, and the base layer 310 can thus include a back-side surface 314. In FIGS. 3A and 3B, the projections 320 all extend from the projection-side surface 312, and the back-side surface 314 of the cushioning panel 301 is a generally flat surface.

Each of the projections 320 have a distal end 322 that is distal from the base layer 310. Each projection 320 has a geometric shape. As shown in FIGS. 3A and 3B, the projections 320 are cylindrical and, more specifically, circular-cylindrical. As will be discussed further below, the projections 320 can be other geometric shapes such as a cylinder, a rectangular prism, a pyramid, or a cone. The projections 320 of the cushioning panel 301, shown in FIGS. 3A and 3B, all have the same geometric shape, but the cushioning panel 301 can have projections 320 with a plurality of different geometric shapes. That is, one projection of the plurality of projections 320 has a first geometric shape, and another projection of the plurality of projections 320 has a second geometric shape that is different from the first geometric shape.

Each of the projections 320 can be a hollow projection with a cavity 324 formed therein. Each of the projections 320 thus can include one or more sidewalls extending from the base layer 310 and defining the cavity 324. Each of the projections 320 can be closed on one end. In FIGS. 3A and 3B, for example, the distal end 322 is closed and includes an end wall, defining, in part, the cavity 324. The distal end 322 and, more specifically, the end wall can have various suitable shapes. As depicted in FIG. 3B, the distal end 322 is rounded. The distal end 322 can have, for example, a spherical dome shape, such as a hemispherical shape. Alternatively, the distal end 322 can be flat, for example, and the projections 320 can have a U-shaped cross-sectional.

The cavity 324 of the projections 320 in the depicted embodiments is an open cavity, having an opening 326 formed in the base layer 310 and, more specifically, in the back-side surface 314 of the base layer 310. The opening 326 is an opening into the cavity 324. Depending upon how the cushioning panel 301 is arranged, with respect to other features of the cushioning block 200, the cavity 324 can become a closed cavity 324, such as when a plurality of cushioning panels 301 are arranged back-to-back with the back-side surface 314 of one cushioning panel 301 abutting another cushioning panel 301. The openings 326 can also be seen in FIG. 2, for example.

The base layer 310 has a thickness. The thickness of the base layer 310 can be less than the length of the projections 320. The length of each projection 320 can be taken as the distance from the projection-side surface 312 to a tip 328 of the distal end 322. In FIG. 3B, all of the projections 320 have the same length, but, as will be discussed further below, the projections 320 can have a plurality of different lengths.

The plurality of projections 320 can be arranged in a two-dimensional (2D) array, having a plurality of rows and columns. The cushioning panel 301 has a length and a width with a corresponding length direction and a width direction. The plurality of projections 320 can be arrayed in both the length direction and the width direction. In FIG. 3A (see also FIG. 2), the projections 320 in each row are evenly spaced apart from each other, and the projections 320 in each column are also evenly spaced apart from each other. Other arrangements, however, may be used.

As noted above, the projections 320 can have other shapes, such as other geometric shapes. FIGS. 3C to 3F depict cushioning panels with projections 320 of different geometric shapes. Other than the shape of the projections 320, these cushioning panels have the same or similar features as the cushioning panel 301 discussed above with reference to FIGS. 3A and 3B, and that discussion applies here. For clarity, with other cushioning panels discussed herein, the projections shown in FIGS. 3A and 3B are referred to as cylindrical projections 331.

Figure 3C:
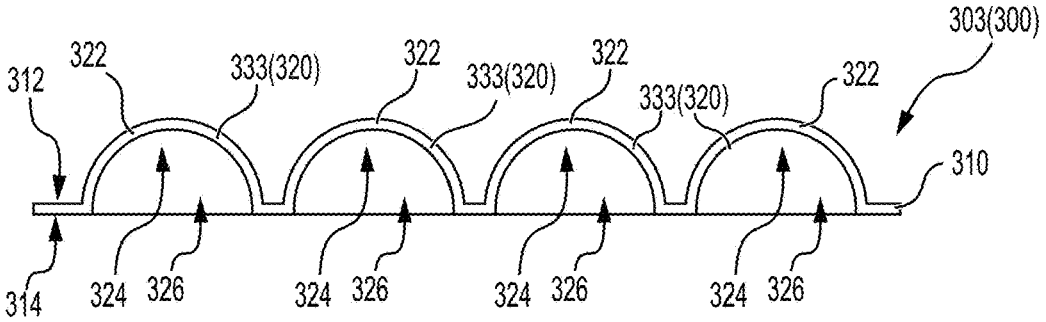
FIG. 3C is a cross-sectional view of a cushioning panel taken from a perspective similar to FIG. 3B.

FIG. 3C is a cross-sectional view of a cushioning panel 303 taken from a perspective similar to FIG. 3B. The projections 320 of the cushioning panel 303 shown in FIG. 3C have a dome shape. The dome shape can be, for example, a spherical dome shape, such as a hemispherical shape. For clarity, with other cushioning panels discussed herein, the projections shown in FIG. 3C are referred to as dome-shaped projections 333.

Figure 3D:
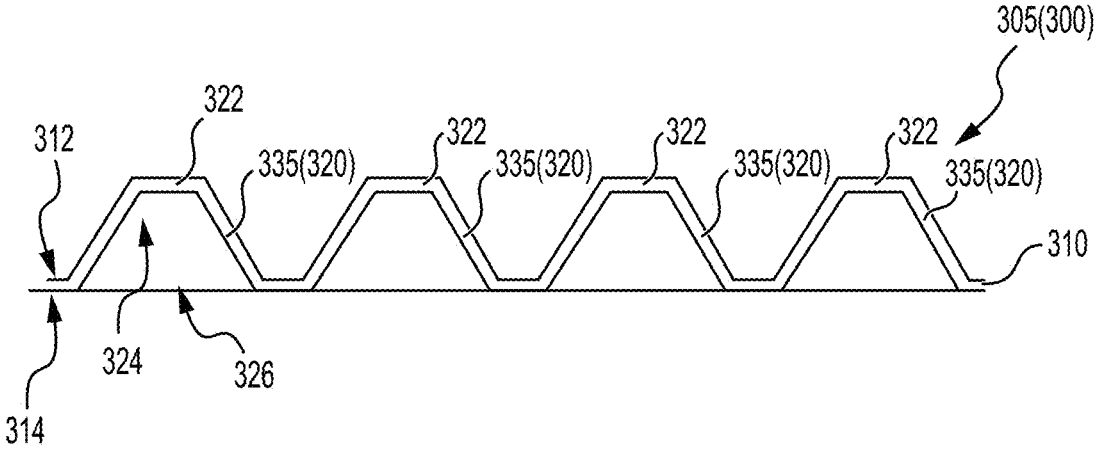
FIG. 3D is a cross-sectional view of a cushioning panel taken from a perspective similar to FIG. 3B.

FIG. 3D is a cross-sectional view of a cushioning panel 305 taken from a perspective similar to FIG. 3B. The projections 320 of the cushioning panel 305 shown in FIG. 3D have a pyramidal or cone shape. The base can have various suitable shapes, including a circular base and a corresponding curved side wall or a rectangular base, such as a square base, with corresponding triangular or trapezoidal side walls. For clarity, with other cushioning panels discussed herein, the projections shown in FIG. 3D are referred to as pyramidal projections 335. Instead of coming to a point, the pyramidal projections 335 shown in FIG. 3D have a distal end 322 that is flat.

Figure 3E:
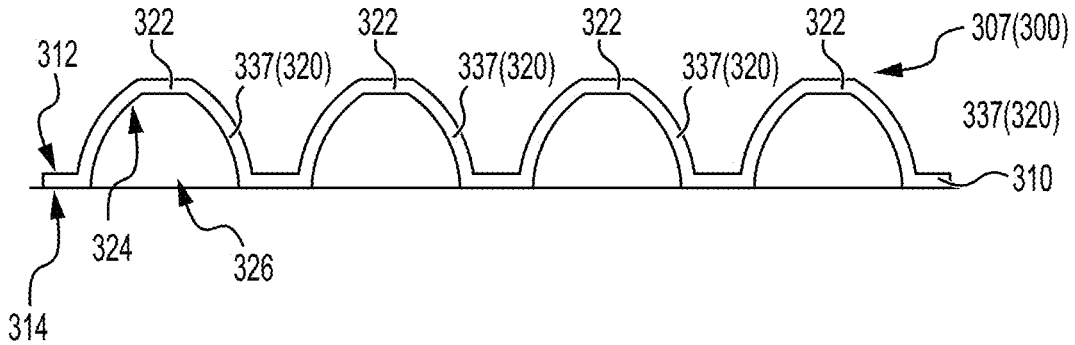
FIG. 3E is a cross-sectional view of a cushioning panel taken from a perspective similar to FIG. 3B.

FIG. 3E is a cross-sectional view of a cushioning panel 307 taken from a perspective similar to FIG. 3B. The projections 320 of the cushioning panel 307 shown in FIG. 3E have arcuate sidewalls. As with the pyramidal projections 335, the base can have various suitable shapes, including a circular base and a square base. For clarity, with other cushioning panels discussed herein, the projections shown in FIG. 3E are referred to as arcuate projections 337. The arcuate projections 337 shown in FIG. 3E have a distal end 322 that is flat.

Figure 3F:
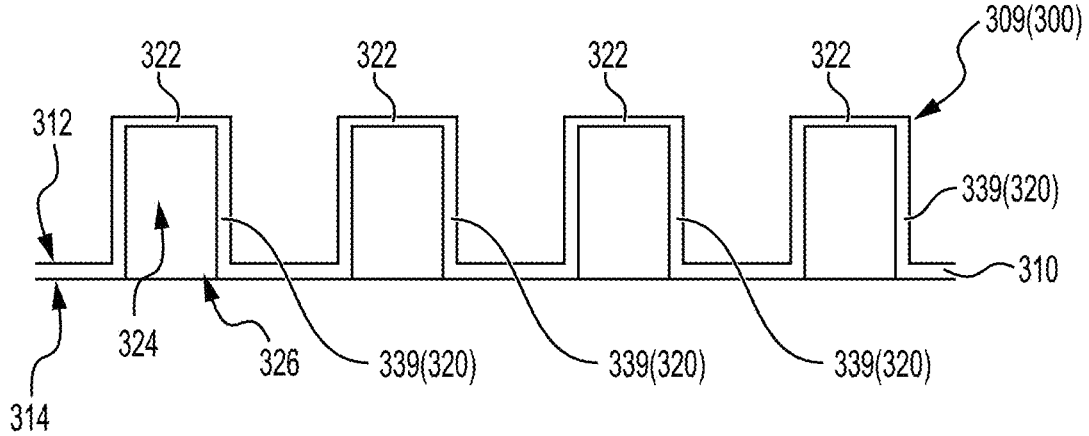
FIG. 3F is a cross-sectional view of a cushioning panel taken from a perspective similar to FIG. 3B.

FIG. 3F is a cross-sectional view of a cushioning panel 309 taken from a perspective similar to FIG. 3B. The projections 320 of the cushioning panel 309 shown in FIG. 3F have a geometric shape that is a rectangular prism. The base can be various rectangular shapes, including square. For clarity, with other cushioning panels discussed herein, the projections shown in FIG. 3F are referred to as rectangular projections 339. The rectangular projections 339 shown in FIG. 3F have a distal end 322 that is flat.

Figure 3G:
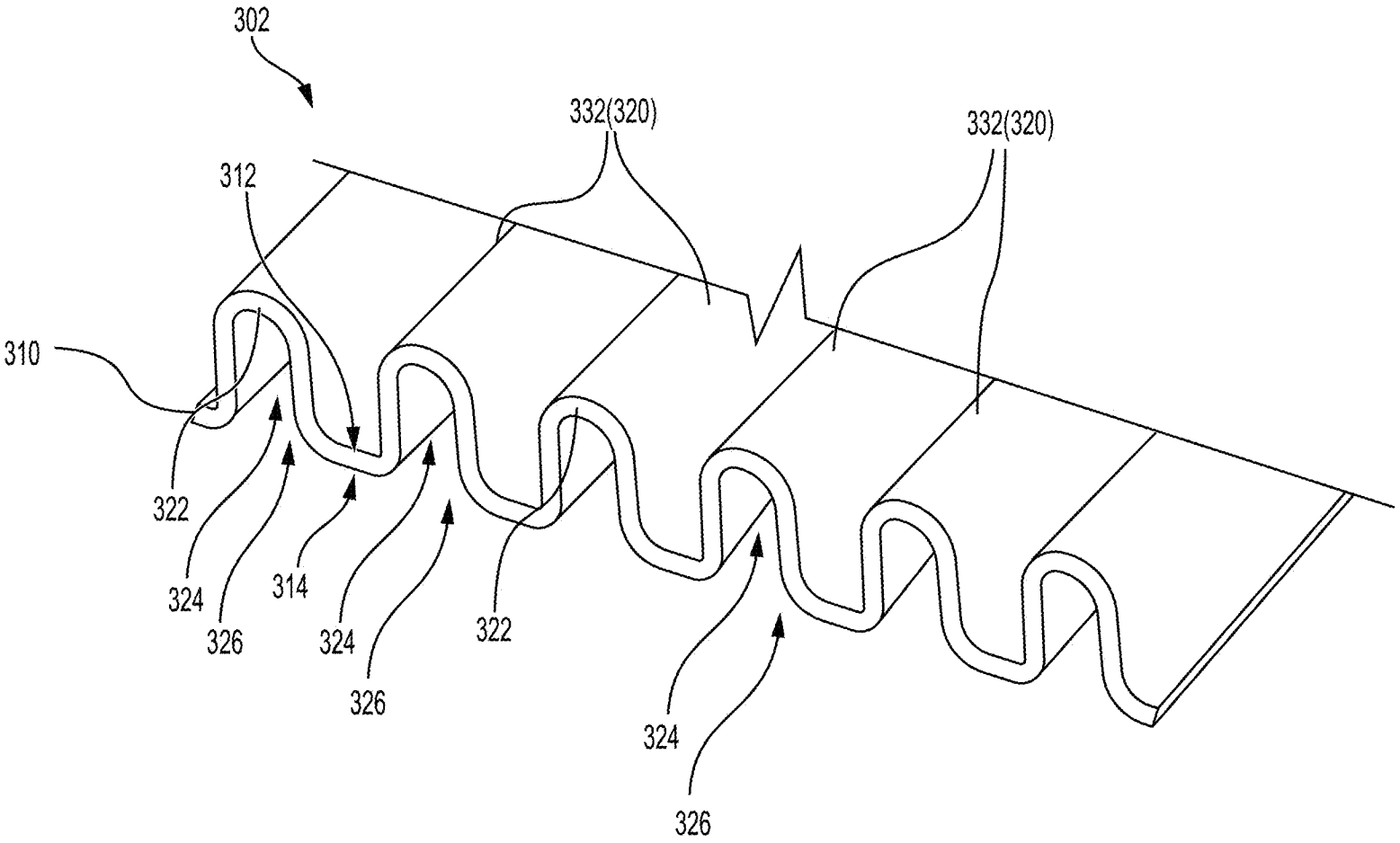
FIG. 3G is a schematic view of another cushioning panel that may be to form cushioning layers of the packing materials.

FIG. 3G shows another cushioning panel 302 that may be used as one of the cushioning panels 300 discussed herein. The cushioning panel 302 is similar to the cushioning panels 300 discussed above, but instead of having projections 320 arranged in a plurality of rows or columns, the projections 320 are ridges 332. The ridges 332 are elongated and extend parallel to each other. The ridges 332 can have various shapes, including the domed or arcuate distal end 322 shown in FIG. 3G.

Figure 3H:
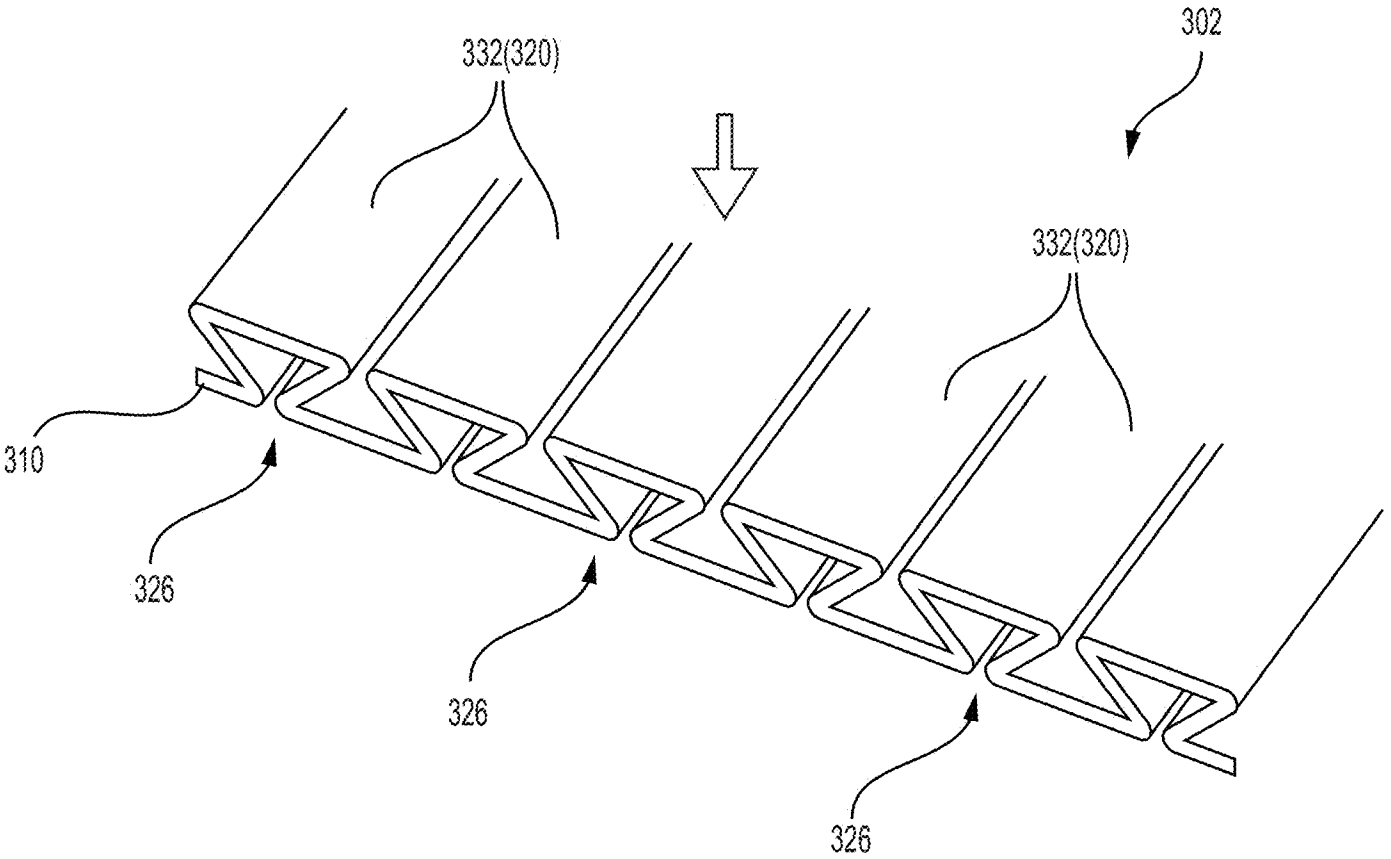
FIG. 3H is a schematic view illustrating the cushioning panel shown in FIG. 3G in a compressed state.

FIG. 3H illustrates the cushioning panel 302 shown in FIG. 3G in a compressed state. When a force is applied in a direction normal to the cushioning panel 302, the ridges 332 can deform such as by spreading out on the distal end 322 and having portions of the base layer 310 move closer together, reducing the size of the opening 326.

As noted above, the cushioning layer 210 (FIG. 2) can be formed by arranging two or more cushioning panels 300. The following discussion will refer to certain cushioning panels 300 discussed above (e.g., the cushioning panels 302 having the dome-shaped projections 333), but the discussion is also applicable to other cushioning panels 300, with projections 320 having other shapes. In general, reference numeral 210 is used to apply to any of the cushioning layers 210, regardless of the specific configurations below. Likewise, the first cushioning panel 220 and the second cushioning panel 230 are used generally to refer to the cushioning panels of the cushioning layer 210, regardless of the specific shape of the projections.

Figure 4A:
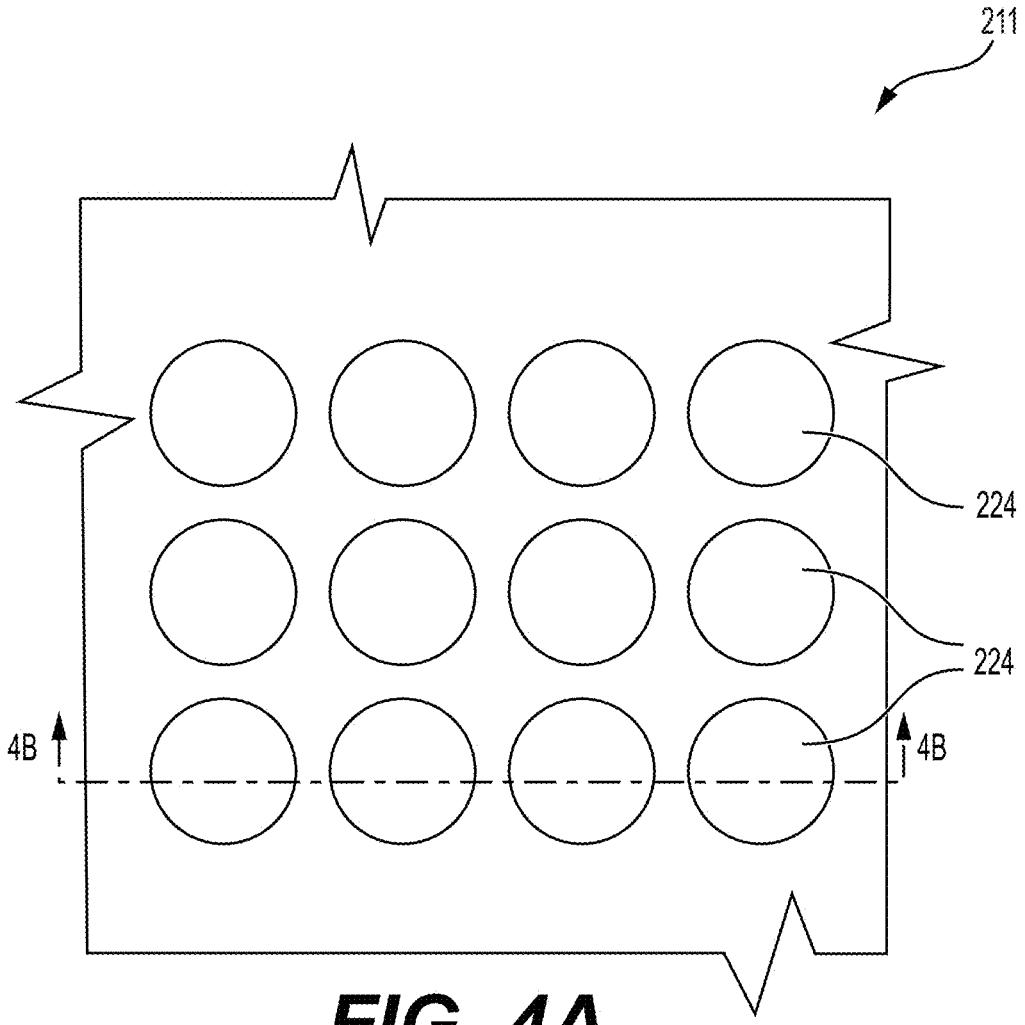
FIG. 4A is a top view of the cushioning layer formed by positioning a first cushioning panel relative to a second cushioning panel.
Figure 4B:
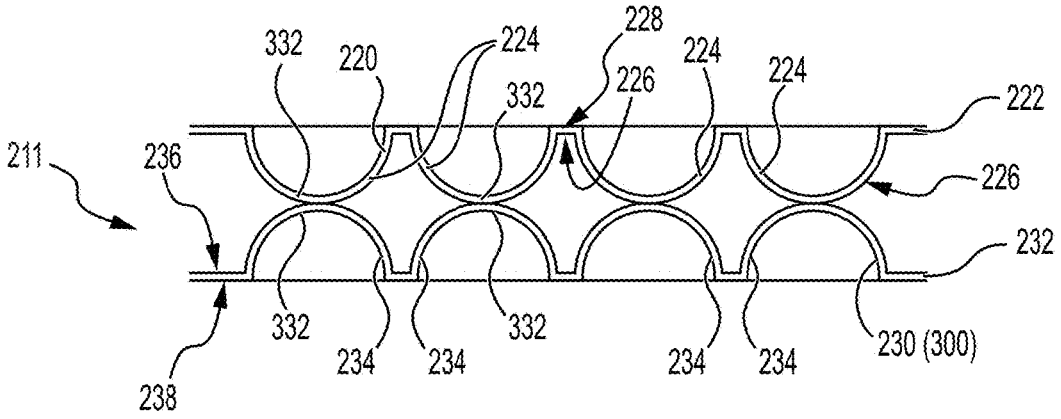
FIG. 4B is a cross-sectional view of the cushioning layer shown in FIG. 4A taken along line 4B-4B in FIG. 4A.

FIGS. 4A and 4B show a cushioning layer 211 formed by positioning a first cushioning panel 220 relative to a second cushioning panel 230. FIG. 4A is a top view of the cushioning layer 211, and FIG. 4B is a cross-sectional view of the cushioning layer 211 taken along line 4B-4B in FIG. 4A. Each of the first cushioning panel 220 and the second cushioning panel 230 are shown as the cushioning panels 303, having the dome-shaped projections 333, but as noted above, the first cushioning panel 220 and the second cushioning panel 230 can be other cushioning panels 300 (FIGS. 3A to 3F), having projections 320 with alternative shapes. The first cushioning panel 220 thus has a first base layer 222 and a plurality of first projections 224 extending therefrom. Similarly, the second cushioning panel 230 has a second base layer 232 and a plurality of second projections 234 extending therefrom. Each first projection 224 of the plurality of first projections 224 has a first geometric shape, and each second projection 234 of the plurality of second projections 234 has a second geometric shape. In FIGS. 4A and 4B, the second geometric shape is the same geometric shape as the first geometric shape and is depicted as the dome-shaped projections 333. The second geometric shape, however, can be a different geometric shape than the first geometric shape.

The first cushioning panel 220 is positioned with the plurality of first projections 224 projecting toward the second cushioning panel 230, and the second cushioning panel 230 is positioned with the plurality of the second projections 234 projecting toward the first cushioning panel 220. The first base layer 222 has an inner side 226 and an outer side 228. The inner side 226 of the first base layer 222 is positioned to oppose the second cushioning panel 230, and the plurality of first projections 224 extend from the inner side 226 of the first base layer 222. The second base layer 232 also has an inner side 236 and an outer side 238. The inner side 236 of the second base layer 232 is positioned to oppose the first cushioning panel 220, and the plurality of second projections 234 extend from the inner side 236 of the second base layer 232.

In FIGS. 4A and 4B, the first projections 224 and the second projections 234 oppose each other and, more specifically, directly oppose each other. When the first projections 224 and the second projections 234 directly oppose each other, the distal end 322 of the first projections 224 can contact the distal end 322 of the second projections 234. The projections that contact another surface, such as the other cushioning panel (more specifically projections with the distal end 322 contacting another surface), are referred to herein as contacting projections, and accordingly, at least a portion of the first projections 224 and at least a portion of the second projections 234 are contacting projections. At least a portion of the first projections 224 are first contacting projections with the distal ends 322 of the first contacting projections contacting the second cushioning panel 230, and at least a portion of the second projections 234 are second contacting projections with the distal ends 322 of the second contacting projections contacting the first cushioning panel 220. More specifically, in FIGS. 4A and 4B, the first contacting projections and the second contacting projections are positioned to directly oppose each other, with the distal end 322 of each first contacting projection contacting a distal end 322 of a corresponding second contacting projection. In this case, both the first projections 224 and the second projections 234 are contacting projections, but in other cases, as will be discussed further below, only one of the first projections 224 or the second projections 234 are contacting projections.

Figure 4C:
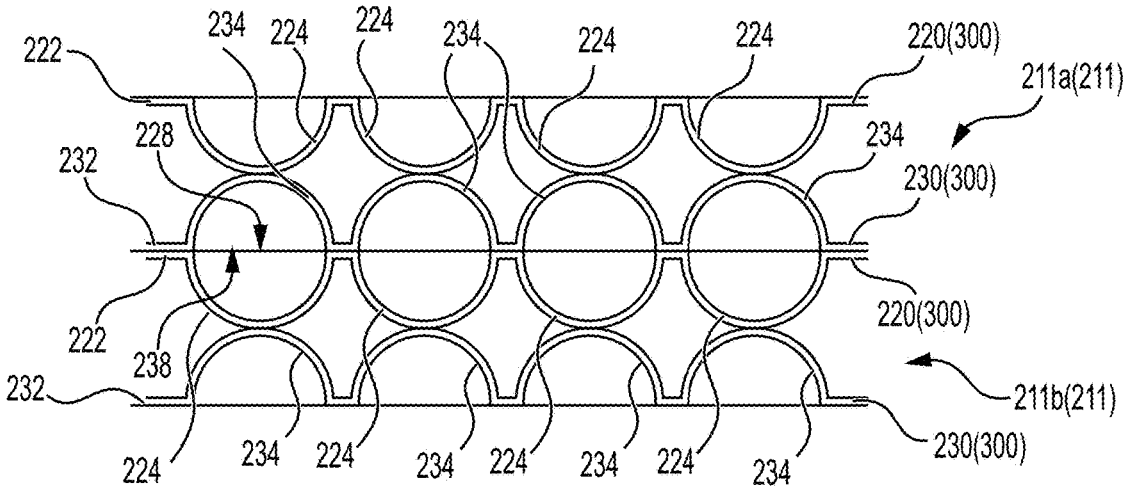
FIG. 4C is a cross-sectional view of a plurality of the cushioning layers shown in FIGS. 4A and 4B, taken from a perspective similar to FIG. 4B.

FIG. 4C is a cross-sectional view of a plurality of the cushioning layers 211 taken from a perspective similar to FIG. 4B. As noted above, the packing materials 100 (FIG. 1) can include cushioning blocks 200 (FIG. 2) with a single cushioning layer 210, such as the cushioning layer 211 shown in FIG. 5B. Other packing materials 100 can include cushioning blocks 200 with a plurality of cushioning layers 210. FIG. 5C shows, for example, four cushioning panels 300 arranged to form two cushioning layers 210 and, more specifically, a first cushioning layer 211*a* and a second cushioning layer 211*b*. Each of the first cushioning layer 211*a* and the second cushioning layer 211*b*, shown in FIG. 4C, are the cushioning layers 211 discussed above with reference to FIG. 4B, and that discussion applies here. Although shown as having the same arrangement, the first cushioning layer 211*a* and the second cushioning layer 211*b* can be arranged differently from each other.

Figure 4D:
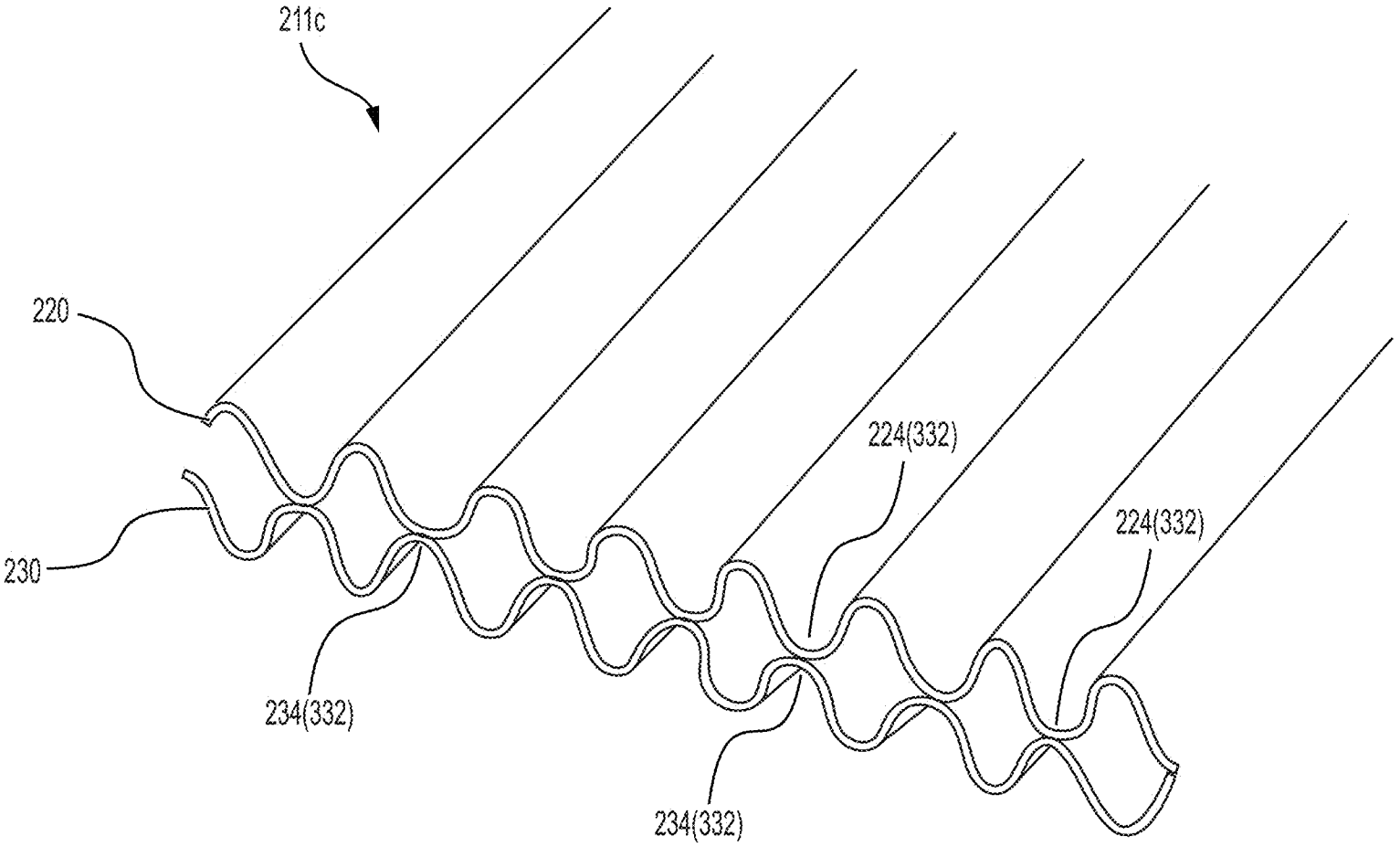
FIG. 4D is a schematic view of a cushioning layer formed by positioning a first cushioning panel relative to a second cushioning panel.

FIG. 4D is a perspective view of a cushioning layer 211*c* formed by positioning a first cushioning panel 220 relative to a second cushioning panel 230. In FIG. 4D, each of the first cushioning panel 220 and a second cushioning panel 230 is the cushioning panel 302 with the ridges 332 arranged to directly oppose each other in a manner similar to the cushioning layers 211 discussed above with reference to FIGS. 4A and 4B.

As depicted in FIG. 5C, the packing materials 100 (FIG. 1), such as cushioning block 200, can have two or more cushioning layers, including the first cushioning layer 211*a* and the second cushioning layer 211*b*. The outer side 238 of one of the first base layer 222 or the second base layer 232 of the first cushioning layer 211*a* abuts the outer side 238 of one of the first base layer 222 or the second base layer 232 of the second cushioning layer 211*b*. In FIG. 4C, the outer side 238 of the second base layer 232 in the first cushioning layer 211*a* abuts the outer side 238 of the first base layer 222 in the second cushioning layer 211*b*.

Figure 5A:
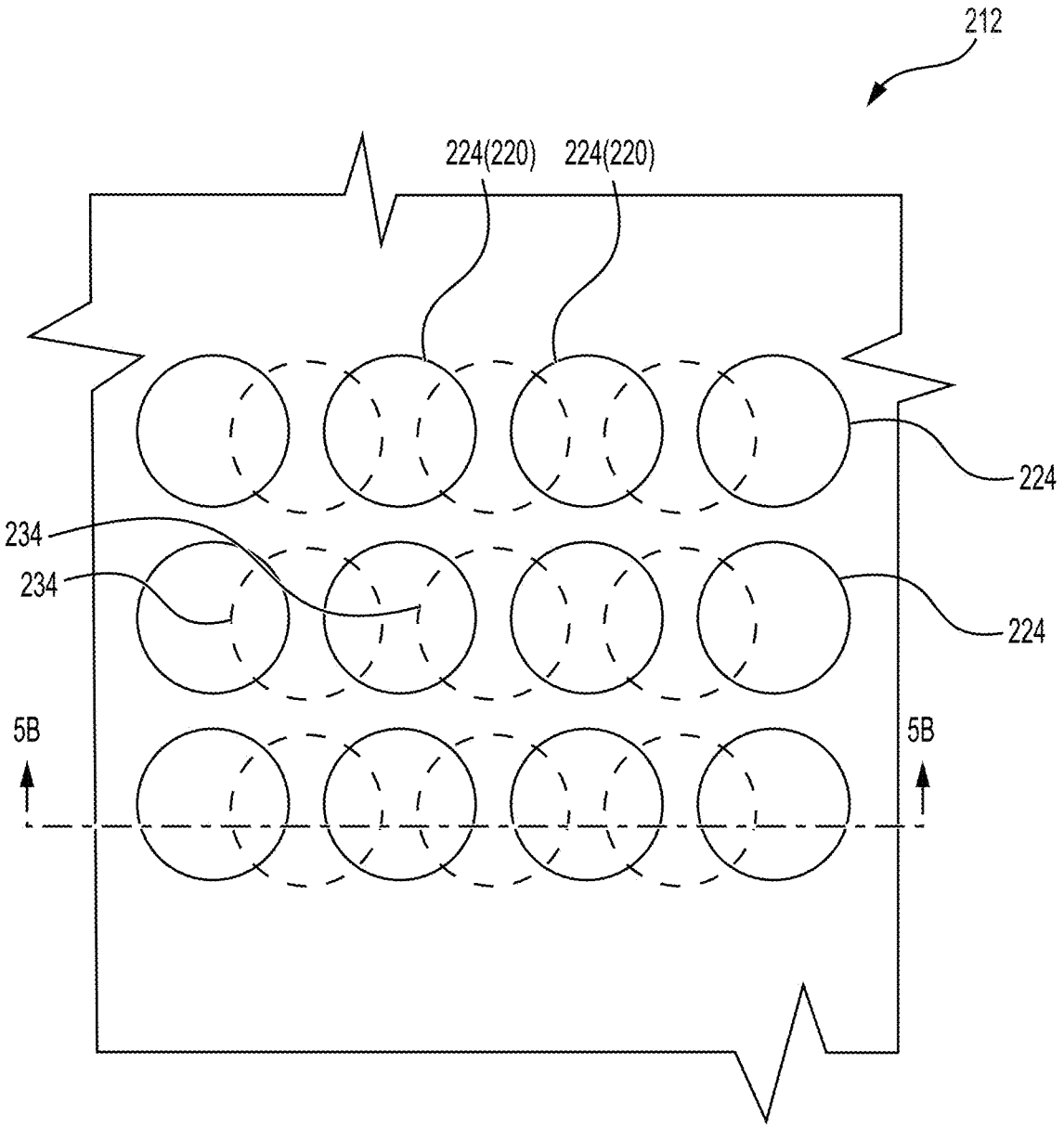
FIG. 5A is a top view of the cushioning layer formed by positioning a first cushioning panel relative to a second cushioning panel.
Figure 5B:
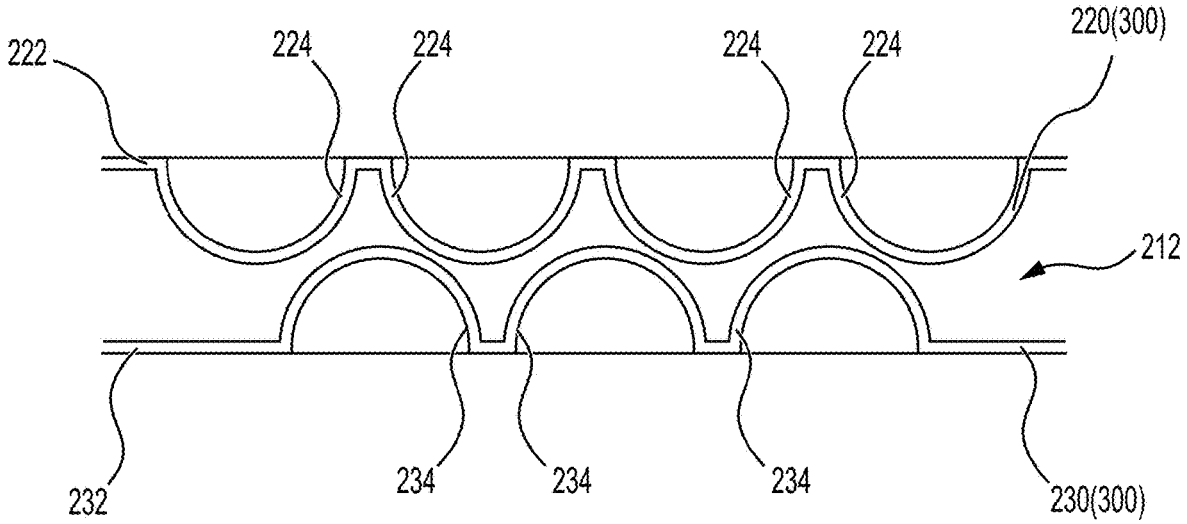
FIG. 5B is a cross-sectional view of the cushioning layer shown in FIG. 5A taken along line 5B-5B in FIG. 5A.
Figure 5C:
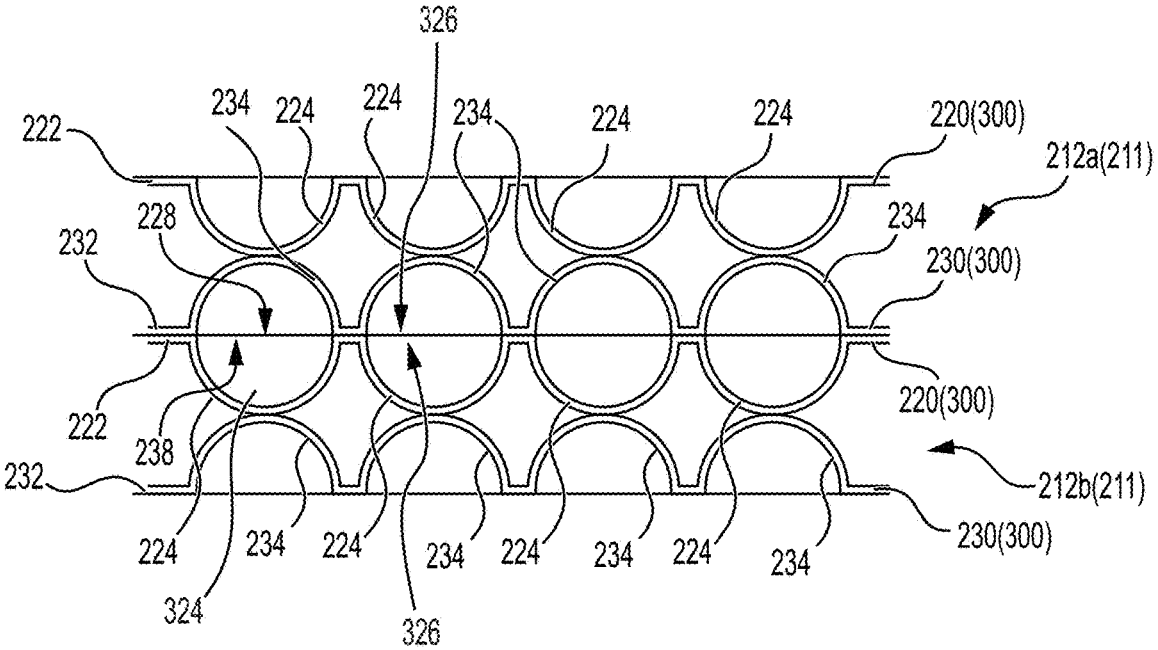
FIG. 5C is a cross-sectional view of a plurality of the cushioning layers shown in FIGS. 5A and 5B, taken from a perspective similar to FIG. 5B.

FIGS. 5A and 5B show a cushioning layer 212 formed by positioning a first cushioning panel 220 relative to a second cushioning panel 230. FIG. 5A is a top view of the cushioning layer 212, and FIG. 5B is a cross-sectional view of the cushioning layer 212 taken along line 6B-6B in FIG. 6A. FIGS. 5A and 5B depict a direct opposition of the first projections 224 and the second projections 234, but as noted above, other arrangements of the first cushioning panel 220 and the second cushioning panel 230 may be used to form the cushioning layers 210 discussed herein, such as, for example, offset arrangements. FIGS. 5A and 5B depict the cushioning layer 212 with one such offset arrangement.

The first projections 224 and the second projections 234 are offset from each other. More specifically, the first projections 224 and the second projections 234 are offset from each other in one of a length direction or a width direction of the cushioning panel 303 but aligned in the other one of a length direction or a width direction of the cushioning panel 303. In FIG. 5A, the first projections 224 are shown with solid lines and the second projections 234 are shown with broken lines. As can be seen in FIG. 5A, the rows of projections of the first cushioning panel 220 and the second cushioning panel 230 are still aligned with each other, but the columns of the first cushioning panel 220 and the second cushioning panel 230 are offset from each other.

More specifically, at least some second projections 234 are each positioned between two adjacent first projections 224, and at least some first projections 224 are each positioned between two adjacent second projections 234. In the depicted embodiment, some of the first projections 224 are on the edges of the first cushioning panel 220 and are referred to herein as edge projections. The edge projections are not positioned between two adjacent second projections 234, but rather next to only one second projection 234. Each of the first projections 224 and the second projections 234 may include edge projections. More specifically, at least a portion of the first projections 224 can be edge projections, and/or at least a portion of the second projections 234 can be edge projections. Other projections of the first projections 224 and the second projections 234 can be internal projections. More specifically, at least a portion of the first projections 224 can be internal projections, and/or at least a portion of the second projections 234 can be internal projections. Each of the internal projections of the first projections 224 are positioned between two adjacent second projections 234, and each of the internal projections of the second projections 234 are positioned between two first projections 224. In FIGS. 5A and 5B, the internal projections of the first projections 224 contact two adjacent second projections 234, and the internal projections of the second projections 234 contact two adjacent first projections 224.

FIG. 5C is a cross-sectional view of a plurality of the cushioning layers 212 taken from a perspective similar to FIG. 5B. Two or more of the cushioning layers 212 shown in FIGS. 5A and 5B can be arranged adjacent to each other in a manner similar to the first cushioning layer 211*a* and the second cushioning layer 211*b*, discussed above with reference to FIG. 4C. More specifically, the plurality of cushioning layers 213 shown in FIG. 5C includes a first cushioning layer 212*a* and the second cushioning layer 212*b*. In FIG. 6C, the outer side 238 of the second base layer 232 in the first cushioning layer 212*a* abuts the outer side 238 of the first base layer 222 in the second cushioning layer 212*b*.

While these can be arranged in different ways, the openings 326 of the second projections 234 in the first cushioning layer 212*a* are aligned with the openings 326 of the first projections 224 in the second cushioning layer 212*b* to form a closed cavity between the cavity 324 of the second projections 234 in the first cushioning layer 212*a* and the cavity 324 of the first projections 224 in the second cushioning layer 212*b*.

Figure 6A:
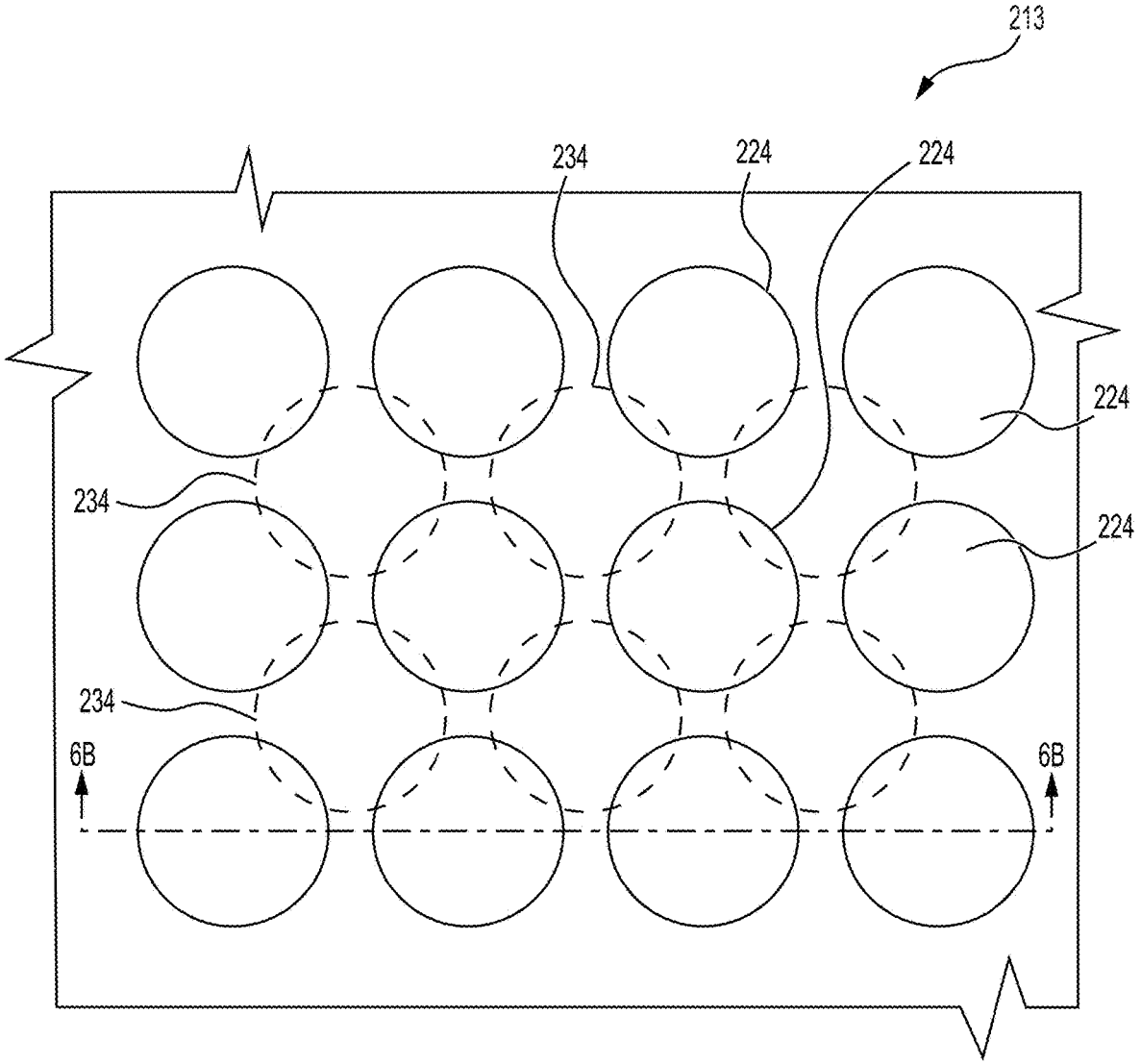
FIG. 6A is a top view of the cushioning layer formed by positioning a first cushioning panel relative to a second cushioning panel.
Figure 6B:
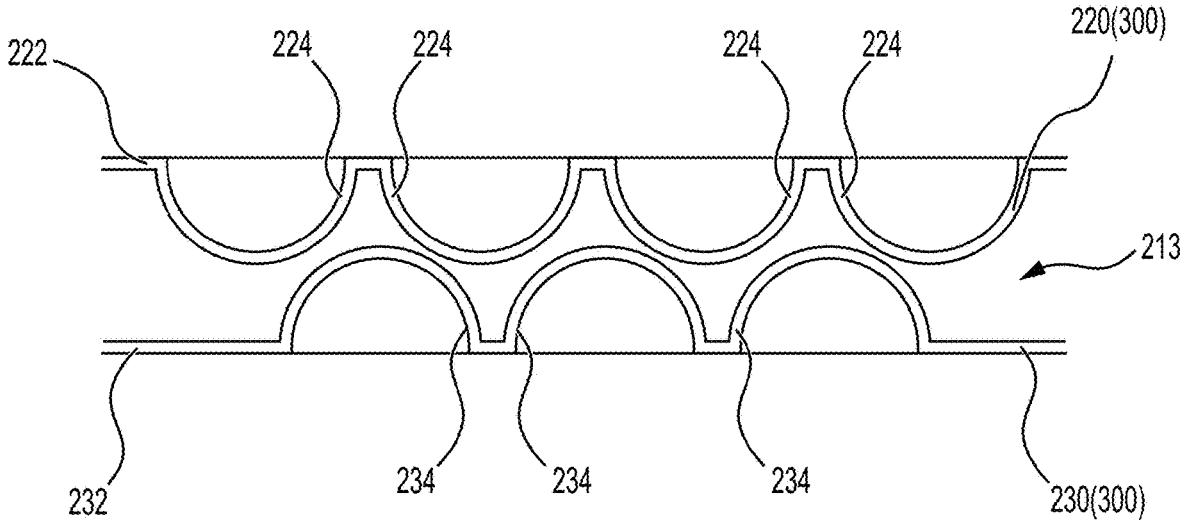
FIG. 6B is a cross-sectional view of the cushioning layer shown in FIG. 6A taken along line 6B-6B in FIG. 6A.
Figure 6C:
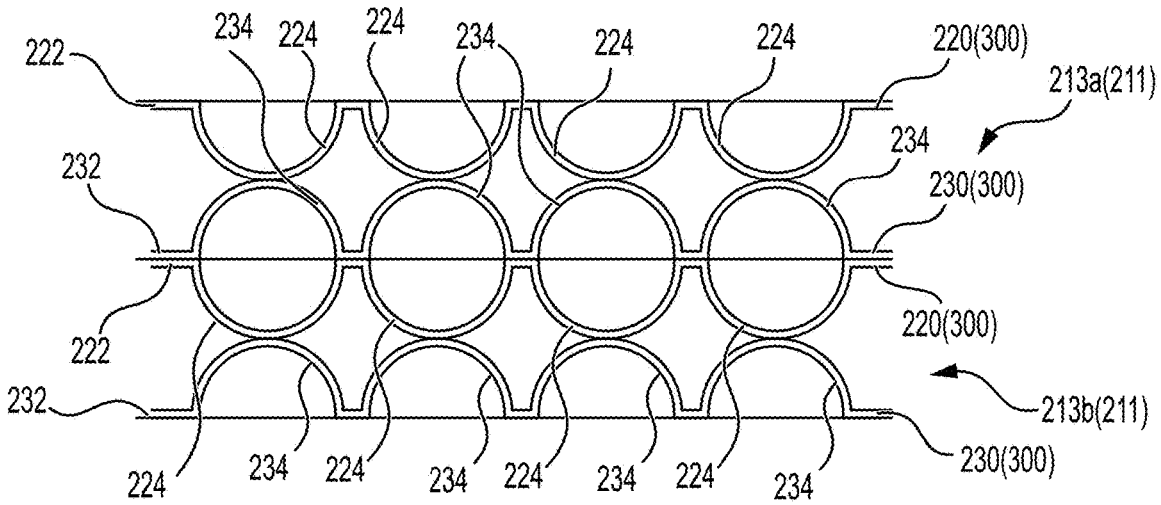
FIG. 6C is a cross-sectional view of a plurality of the cushioning layers shown in FIGS. 6A and 6B, taken from a perspective similar to FIG. 6B.

FIGS. 6A and 6B show a cushioning layer 213 formed by positioning a first cushioning panel 220 relative to a second cushioning panel 230. FIG. 6A is a top view of the cushioning layer 213 and FIG. 6B is a cross-sectional view of the cushioning layer 213 taken along line 6B-6B in FIG. 6A. FIGS. 6A and 6B depict the cushioning layer 213 with another offset arrangement.

The first projections 224 and the second projections 234 are offset from each other. More specifically, the first projections 224 and the second projections 234 are offset from each other in both the length direction and the width direction of the cushioning panel 303. In FIG. 6A, the first projections 224 are shown in solid lines and the second projections 234 are shown in broken lines. As can be seen in FIG. 6A, at least a portion of the second projections 234, such as the internal projections, are located in interstitial locations between the first projections 224. In FIG. 6A, this interstitial position is between four adjacent first projections 224. With this arrangement, at least a portion of the first projections 224, such as the internal projections, are also located in interstitial locations between the second projections 234. In FIG. 6A, this interstitial position is between four adjacent second projections 234. In FIGS. 6A and 6B, the internal projections of the first projections 224 contact four adjacent second projections 234, and the internal projections of the second projections 234 contact four adjacent first projections 224.

FIG. 6C is a cross-sectional view of a plurality of the cushioning layers 213 taken from a perspective similar to FIG. 6B. Two or more of the cushioning layers 213 shown in FIGS. 6A and 6B can be arranged adjacent to each other in a manner similar to the first cushioning layer 212*a* and the second cushioning layer 212*b*, discussed above with reference to FIG. 5C. The discussion of the features in FIG. 5C applies to a first cushioning layer 213*a* and a second cushioning layer 213*b* shown in FIG. 7C, but with the offset arrangement discussed above, with respect to FIGS. 6A and 6B.

Figure 7A:
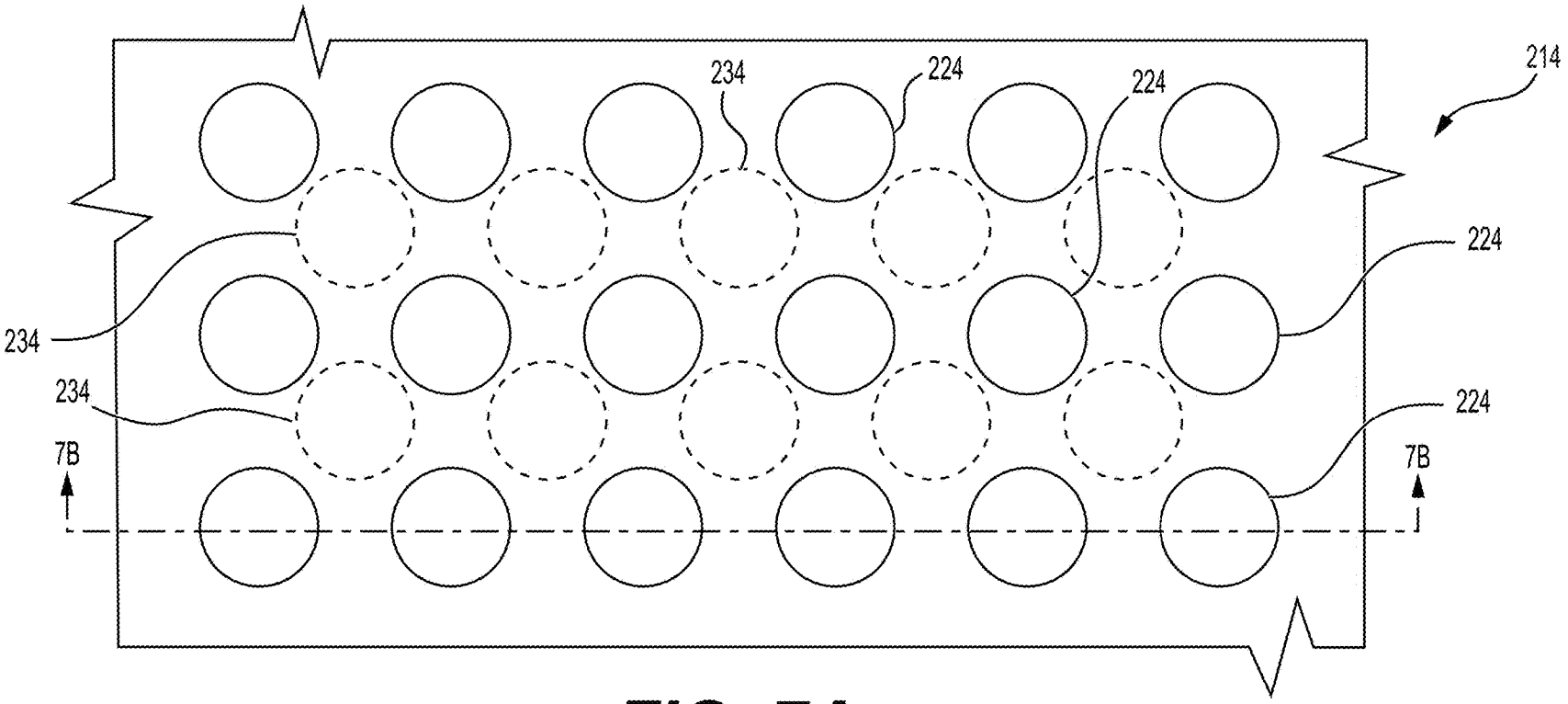
FIG. 7A is a top view of the cushioning layer formed by positioning a first cushioning panel relative to a second cushioning panel.
Figure 7B:
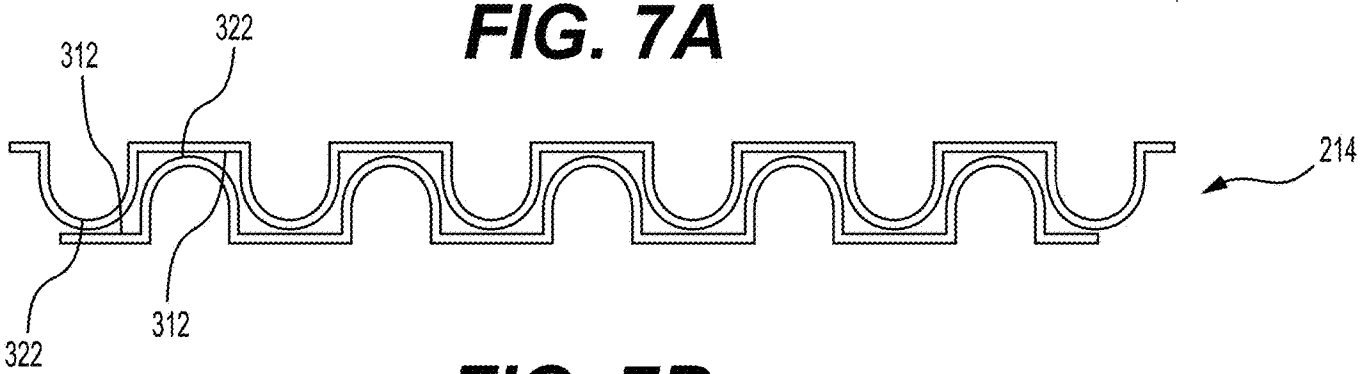
FIG. 7B is a cross-sectional view of the cushioning layer shown in FIG. 7A taken along line 7B-7B in FIG. 7A.

FIGS. 7A and 7B show a cushioning layer 214 formed by positioning a first cushioning panel 220 relative to a second cushioning panel 230. FIG. 7A is a top view of the cushioning layer 213 and FIG. 7B is a cross-sectional view of the cushioning layer 214, taken along line 7B-7B in FIG. 7A. FIGS. 7A and 7B depict the cushioning layer 213 with another offset arrangement. In FIGS. 6A and 6B, the contacting projections of the first projections 224 and the second projections 234 contacted other projections, but other arrangements can be used. In FIGS. 7A and 7B, the contacting projections of the first projections 224 and the second projections 234 do not contact each other, but rather, are in contact with other portions of the second cushioning panel 230 and the first cushioning panel 220, respectively. More specifically, the distal ends 322 of the first projections 224 contact the projection-side surface 312 of the second base layer 232, and the distal ends 322 of the second projections 234 contact the projection-side surface 312 of the second projections 234.

Figure 8A:
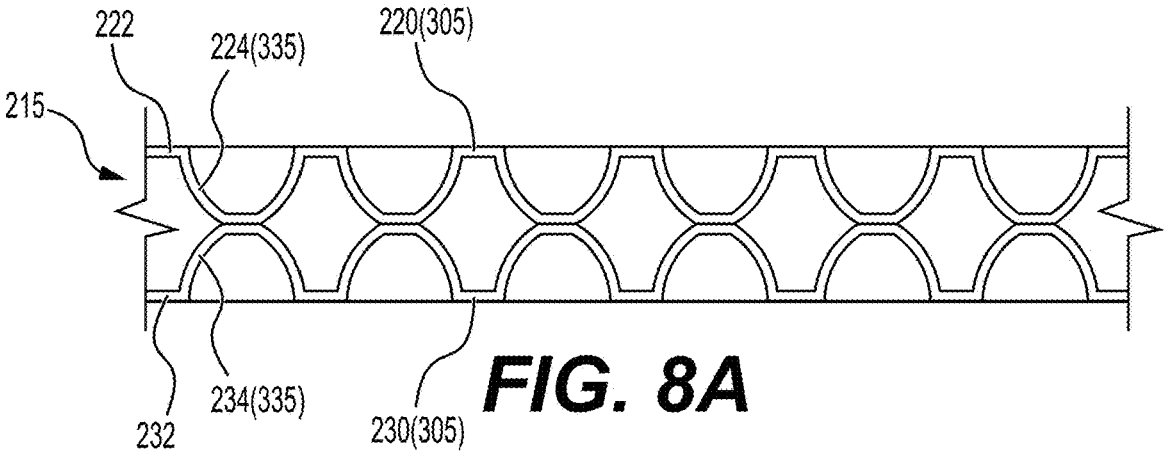
FIG. 8A is a cross-sectional view of a cushioning layer, taken from a perspective similar to FIG. 4B.
Figure 8B:
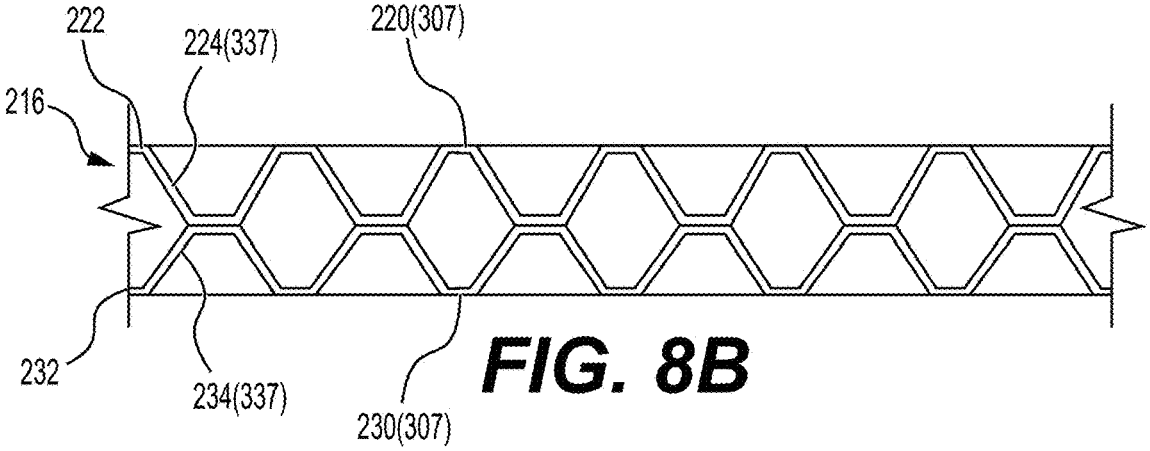
FIG. 8B is a cross-sectional view of a cushioning layer, taken from a perspective similar to FIG. 4B.

The cushioning layers 210 discussed herein can provide a level of cushioning for the product 10. The cushioning layer 210 has some elastic deformability to provide a first level of cushioning but also provide energy absorption by crumpling or deforming. These different arrangements of the cushioning layers 210 provide different levels of energy absorption that can be adjusted depending upon the need. Additionally, as noted above, the first projections 224 and the second projections 234 can have a variety of shapes, such as different geometric shapes. These different geometric shapes can have different configurations to provide different cushioning or resilience. For example, FIG. 8A shows a cushioning layer 215 formed by positioning a first cushioning panel 220 relative to a second cushioning panel 230. FIG. 8A is a cross-sectional view of the cushioning layer 214 taken from a perspective similar to FIG. 4B above, but each of the first cushioning panel 220 and the second cushioning panel 230 in the cushioning layer 215 is the cushioning panel 305 having the pyramidal projections 335 shown in FIG. 3D. Similarly, FIG. 8B shows a cushioning layer 216 formed by positioning a first cushioning panel 220 relative to a second cushioning panel 230. FIG. 8B is a cross-sectional view of the cushioning layer 216 taken from a perspective similar to FIG. 4B above, but each of the first cushioning panel 220 and the second cushioning panel 230 in the cushioning layer 216 is the cushioning panel 307 having the arcuate projections 337 shown in FIG. 3E. While FIGS. 8A and 8B are depicted with the first projections 224 and the second projections 234 directly opposing each other, other arrangements can be used, including the offset arrangements discussed above.

Figure 8C:
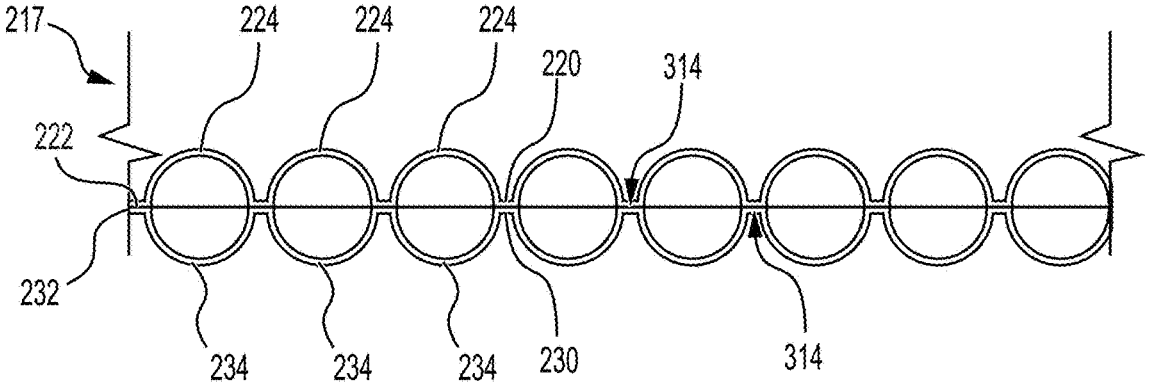
FIG. 8C is a cross-sectional view of a cushioning layer, taken from a perspective similar to FIG. 4B.

FIG. 8C also shows a cushioning layer 217 formed by positioning a first cushioning panel 220 relative to a second cushioning panel 230. FIG. 8C is a cross-sectional view of the cushioning layer 216 taken from a perspective similar to FIG. 4B above. In the cushioning layers 210 discussed above, the first cushioning panel 220 and the second cushioning panel 230 are arranged such that the first projections 224 project toward the second cushioning panel 230 and the second projections 234 project toward the first cushioning panel 220, but as depicted in FIG. 8C, the first cushioning panel 220 and the second cushioning panel 230 are arranged such that the first projections 224 project away from the second cushioning panel 230 and the second projections 234 project the first cushioning panel 220. As with the discussion of a plurality of layers, the discussion of which applies here, the first cushioning panel 220 and the second cushioning panel 230 are positioned with the back-side surface 314 of the first cushioning panel 220 abutting the back-side surface 314 of the second cushioning panel 230.

Figure 9A:
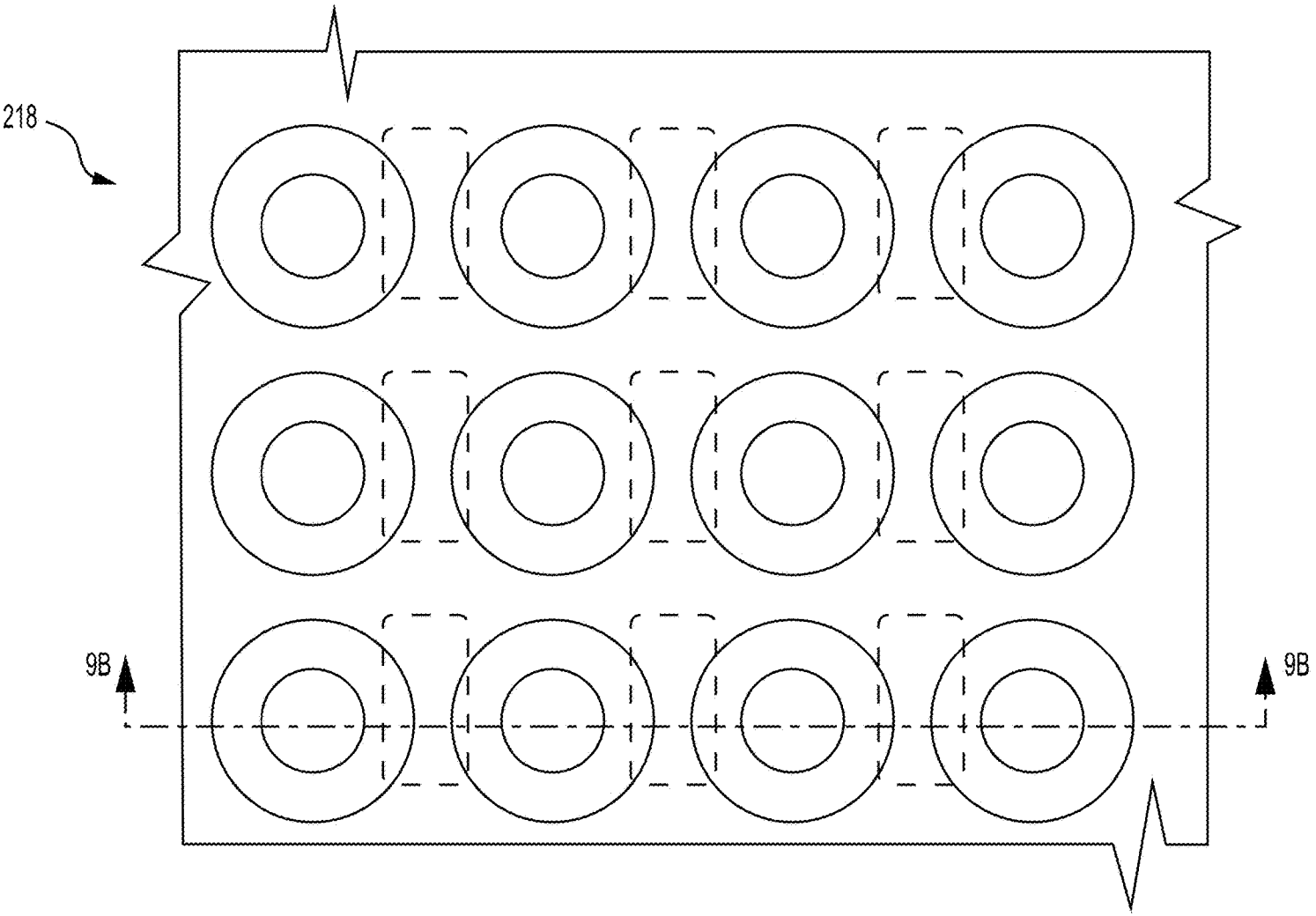
FIG. 9A is a top view of the cushioning layer formed by positioning a first cushioning panel relative to a second cushioning panel.
Figure 9B:
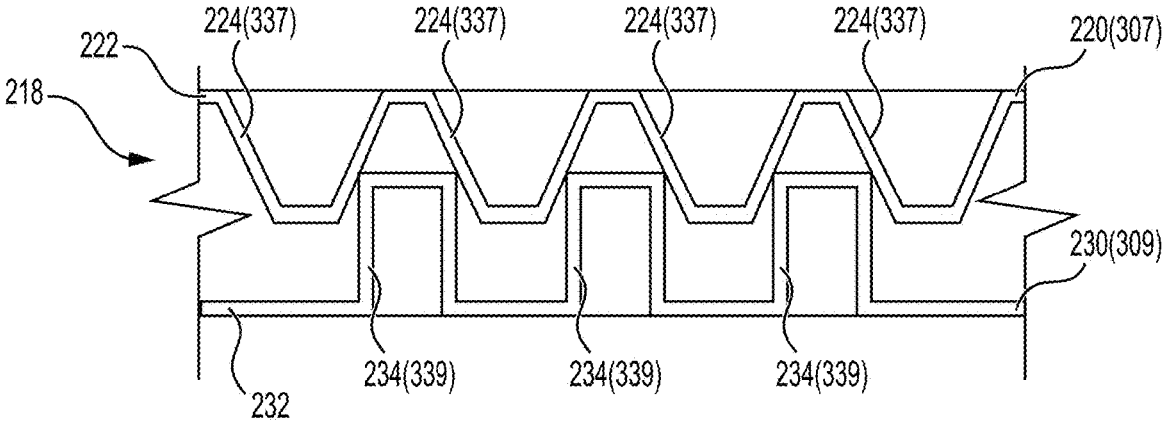
FIG. 9B is a cross-sectional view of the cushioning layer shown in FIG. 9A taken along line 9B-9B in FIG. 9A.

FIGS. 9A and 9B show a cushioning layer 218 formed by positioning a first cushioning panel 220 relative to a second cushioning panel 230. FIG. 9A is a top view of the cushioning layer 213 and FIG. 9B is a cross-sectional view of the cushioning layer 218 taken along line 9B-9B in FIG. 9A. As noted above, the second projections 234 can have a geometric shape that is different than the geometric shape of the first projections 224. In FIGS. 9A and 9B, the first cushioning panel 220 is formed using the cushioning panel 305, shown in FIG. 4D, with pyramidal projections 335, and the second cushioning panel 230 is formed using the cushioning panel 309, shown in FIG. 4F, with rectangular projections 339. Although other arrangements may be used, FIGS. 9A and 9B depict the cushioning layer 218 with the offset arrangement discussed above with reference to FIGS. 5A and 5B. In the previous cushioning layers 210, both the first projections 224 and the second projections 234 included contacting projections, but depending upon the arrangement and geometric shape, only one of the first projections 224 or the second projections 234 can include contacting projections. As depicted in FIGS. 9A and 9B, for example, the second projections 234 include contacting projections where the distal end 322 of the second projections 234 contact the first cushioning panel 220, but the distal end 322 of the first projections 224 is not in contact with the second cushioning panel 230.

Figure 9C:
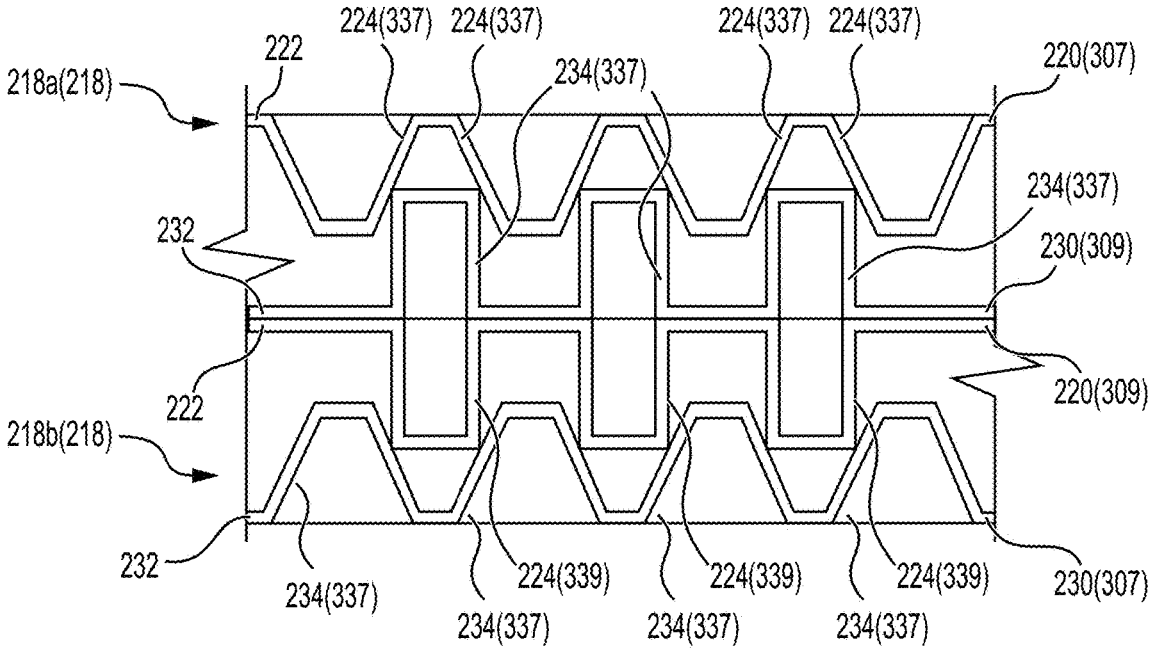
FIG. 9C is a cross-sectional view of a plurality of the cushioning layers shown in FIGS. 9A and 9B, taken from a perspective similar to FIG. 9B.

FIG. 9C is a cross-sectional view of a plurality of the cushioning layers 218 taken from a perspective similar to FIG. 9B. Two or more of the cushioning layers 218 shown in FIGS. 9A and 9B can be arranged adjacent to each other in a manner similar to the first cushioning layer 212*a* and the second cushioning layer 212*b*, discussed above with reference to FIG. 5C. The discussion of the features in FIG. 5C applies to a first cushioning layer 218*a* and a second cushioning layer 218*b* shown in FIG. 9C.

Figure 9D:
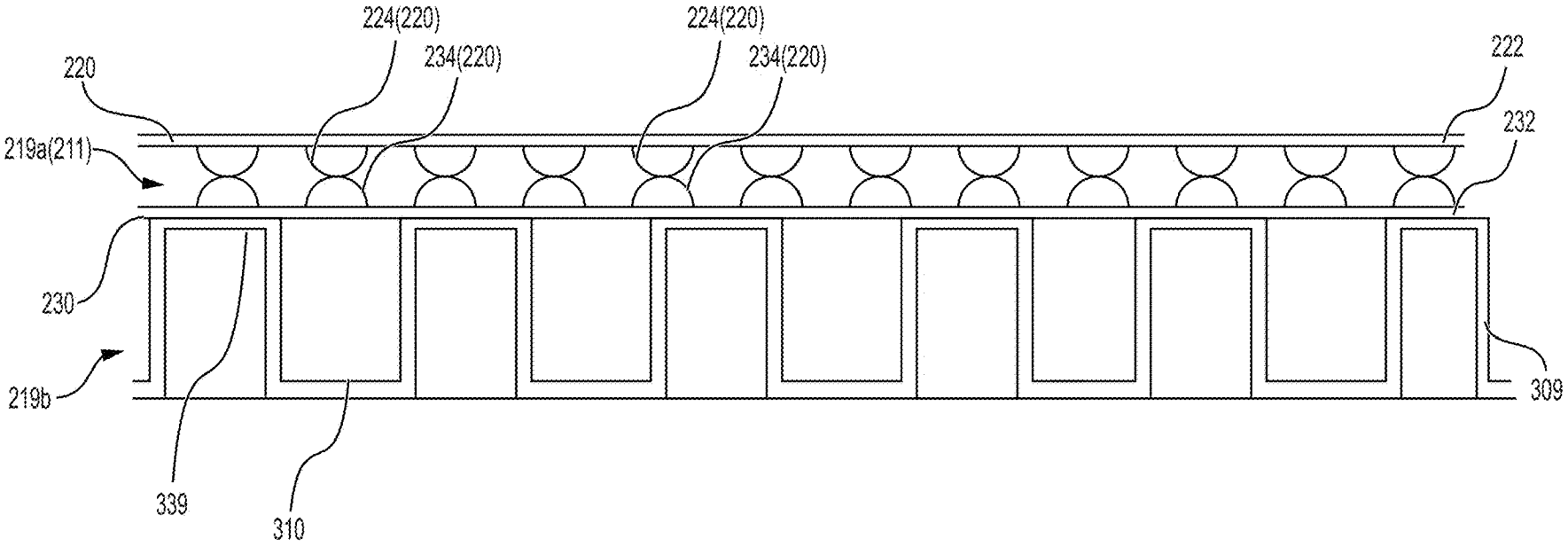
FIG. 9D is a cross-sectional view of cushioning panels of different types in another arrangement, taken from a perspective similar to FIG. 9B.

FIG. 9D shows a plurality of cushioning panels of different types in another arrangement. The shapes of the projections, in addition to their arrangement relative to each other, result in different levels of rigidity for each sheet. As will be discussed in more detail below, using a first cushioning layer 219*a* in combination with a second layer 219*b* that has a greater rigidity that the first cushioning layer 219*a* can be advantageous, particularly when the first cushioning layer 219*a* is positioned closer to the product 10 than the more rigid layer, the second layer 219*b* in FIG. 9D. In FIG. 9D, the first cushioning layer 219*a* is depicted as using the cushioning layer 211 shown and described above with reference to FIGS. 4A and 4B, the second layer 219*b* is depicted as the cushioning panel 309 having rectangular projections 339 shown in FIG. 3F. Other cushioning panels, however, can be used to form these layers provided the rigidity is as discussed above.

Figure 10B:
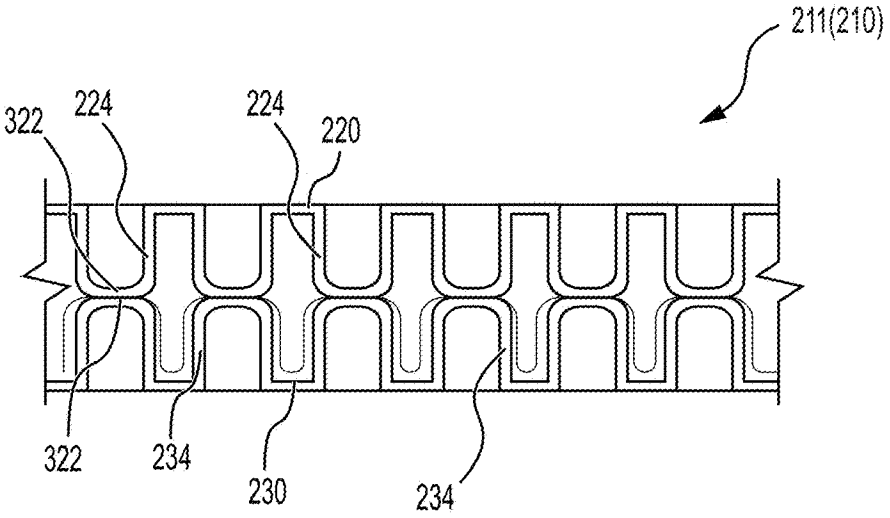
FIGS. 10A and 10B illustrate a method of forming a cushioning layer.
Figure 10A:
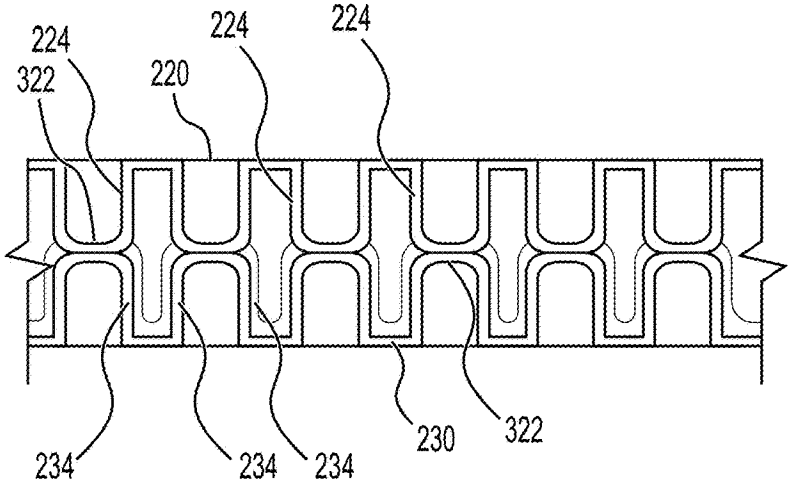

FIGS. 10A and 10B illustrate a method of forming a cushioning layer 210, such as the cushioning layer 211 discussed above. FIG. 10A is a first step and FIG. 10B is a second step. After each of the first cushioning panel 220 and the second cushioning panel 230 are formed using the molded pulp methods discussed above, an adhesive 241 can be applied to the first cushioning panel 220, the second cushioning panel 230, or both. In FIG. 10A, the adhesive 241 is shown being applied to the second cushioning panel 230. More specifically, the adhesive 241 is shown as being applied to the projection side of the second cushioning panel 230, including the distal end 322 of the second projections 234. Then the first cushioning panel 220 is positioned relative to the second cushioning panel 230, which, as depicted, can include positioning the first projections 224 to directly oppose the second projections 234, with the distal ends 322 of the first projections 224 contacting the distal ends 322 of the second projections 234. The adhesive 241 then is allowed to dry, binding the distal ends 322 of the first projections 224 to the distal ends 322 of the second projections 234.

Figure 11A:
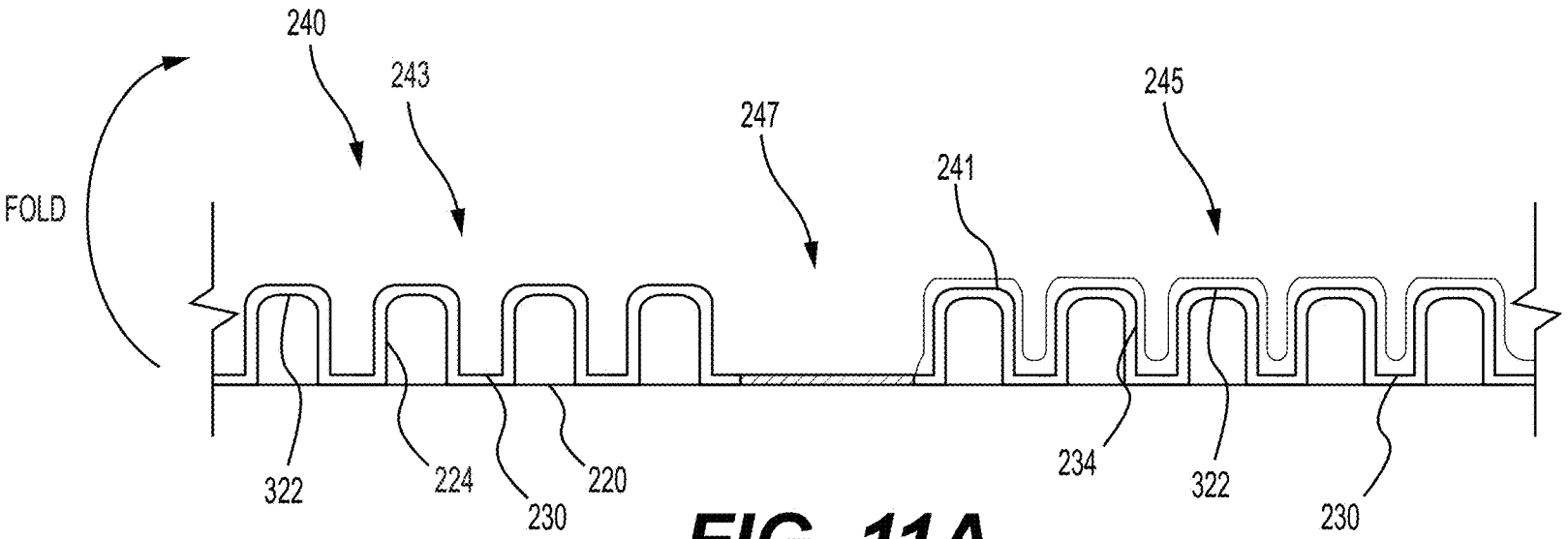
FIGS. 11A to 11E illustrate another method of forming a cushioning.
Figure 11B:
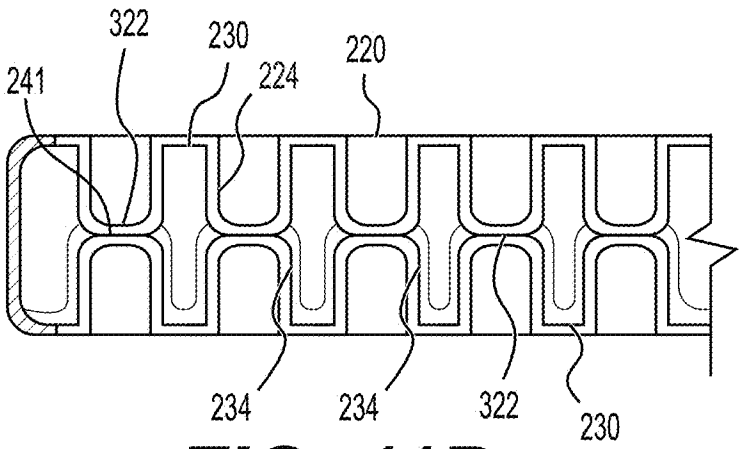

FIGS. 11A and 11B illustrate another method of forming a cushioning layer 210, such as the cushioning layer 211 discussed above. FIG. 11A illustrates a first step and FIG. 11B illustrates a second step. In this method, the first cushioning panel 220 and the second cushioning panel 230 are formed as a single cushioning panel 240, with the first cushioning panel 220 being a first portion 243 of the cushioning panel 240 and the second cushioning panel 230 being a second portion 245 of the cushioning panel 240. The first portion 243 and the second portion 245 are separated by a connecting portion 247. The connecting portion 247 can be a portion of the cushioning panel 240 without the projections 320 formed thereon. The connecting portion 247 can be a flat sheet portion of the cushioning panel 240. After the adhesive 241 is applied in the manner discussed above, the first portion 243 can be rotated relative to the second portion 245 as indicated by the arrow to be positioned, as shown in FIG. 11B, in the manner discussed above relative to FIG. 10B.

Figure 11C:
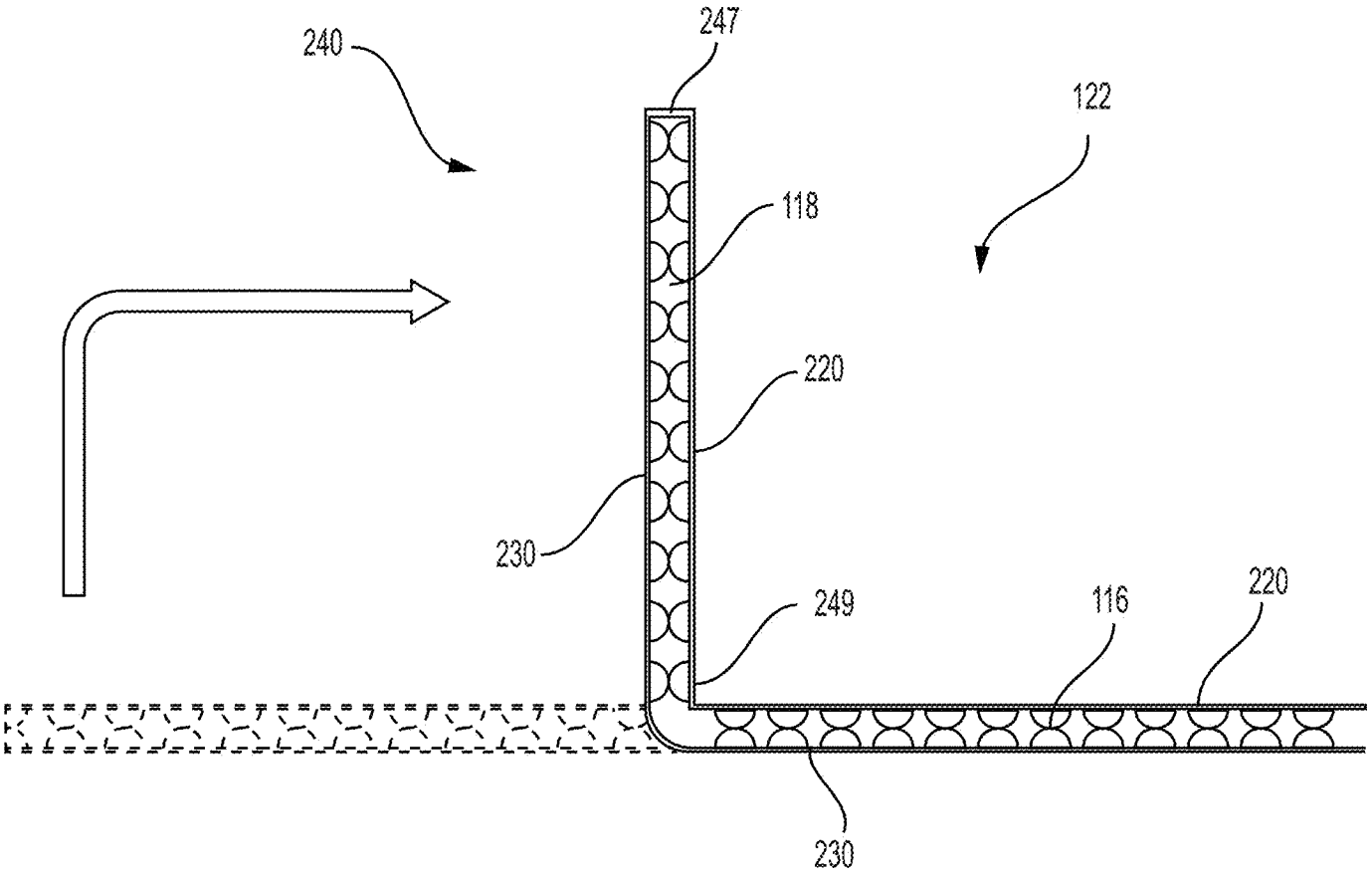

FIG. 11C shows an optional additional step. As will be discussed further below, the cushioning layers 210 and cushioning bocks 200 can be positioned relative to each other to form various packing materials. As will be discussed with reference to FIGS. 16A and 16B, a third cushioning block 116 and a fourth cushioning block 118 can be arranged transversely to each other, such as to form an L-shape, with a product cavity 122 therebetween. One way of arranging transversely is to further fold the cushioning panel 240 after the step shown in FIG. 11B. For example, one end of the cushioning panel 240 can be rotated relative to the other end of the cushioning panel 240 to form two cushioning blocks (e.g., third cushioning block 116 and the fourth cushioning block 118) positioned transversely to each other. The cushioning panel 240 can include a corner portion 249 and, before rotating one of the first base portion 222 and the second base portion 232 can be scored or otherwise cut to facilitate rotation. Additionally, instead of stopping the fold to form the L-shape, the one end of the cushioning panel 240 can be further rotated to form a plurality of cushioning layers (e.g., the first cushioning layer 211*a* and second cushioning layer 211*b* discussed above with reference to FIG. 4C).

Figure 11D:
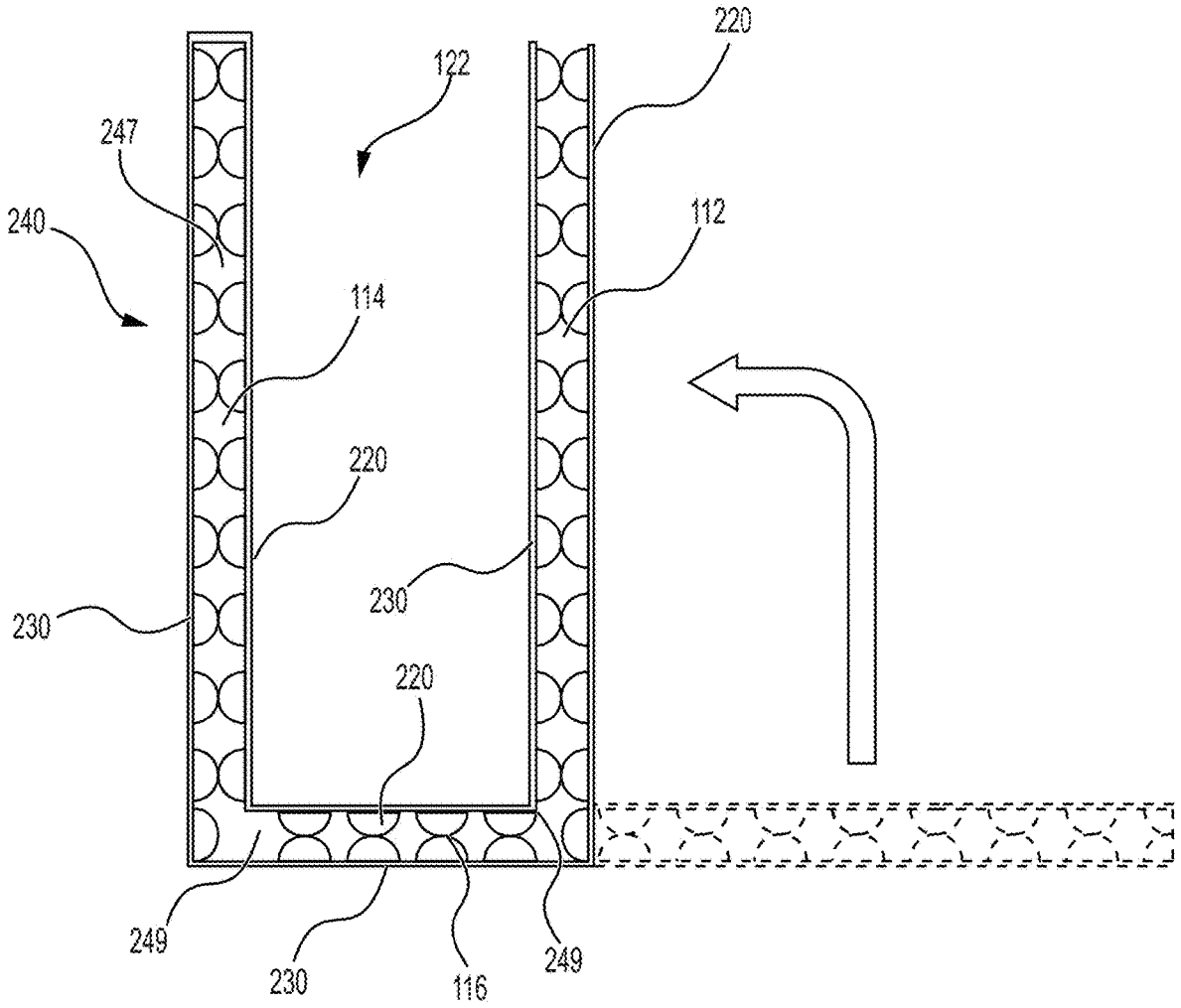

FIG. 11D shows another optional additional step. The cushioning panel 240 can be further rotated in the manner discussed above with reference to FIG. 11C to form a U-shape having for example, a first cushioning block 112, a second cushioning block 114, and a third cushioning block 116, discussed in more detail below. One end of the L-shape shown in FIG. 11C can be further rotated to be arranged transversely to another section of the cushioning panel 240.

Figure 11E:
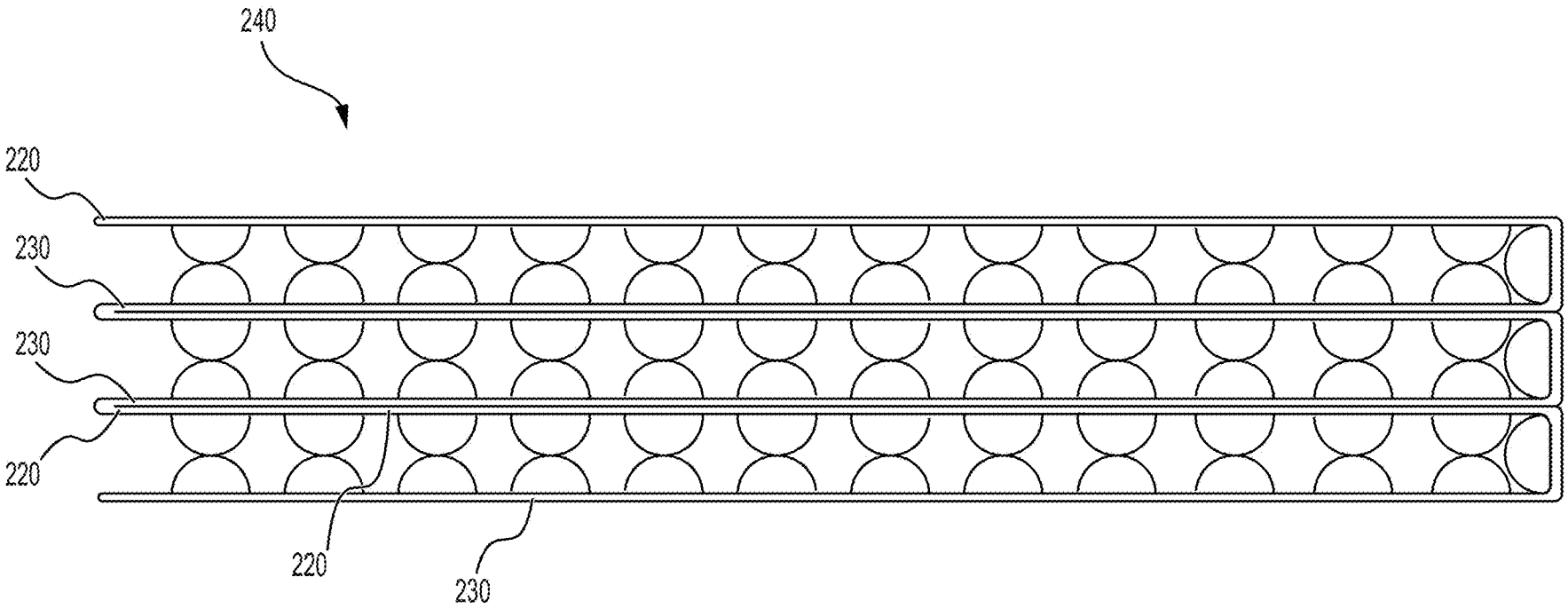

FIG. 11E shows another optional additional step to form a plurality of layers. In FIG. 11B the cushioning panel 240 was folded back on itself once to form the cushioning layer and then one end of the cushioning layer was folded the other end of the cushioning layer. Here, in FIG. 11E, the cushioning panel 240 is folded back on itself multiple times to form a plurality of cushioning layers. The base layer of the cushioning panel 240 can thus have a serpentine structure after being folded.

Figure 12:
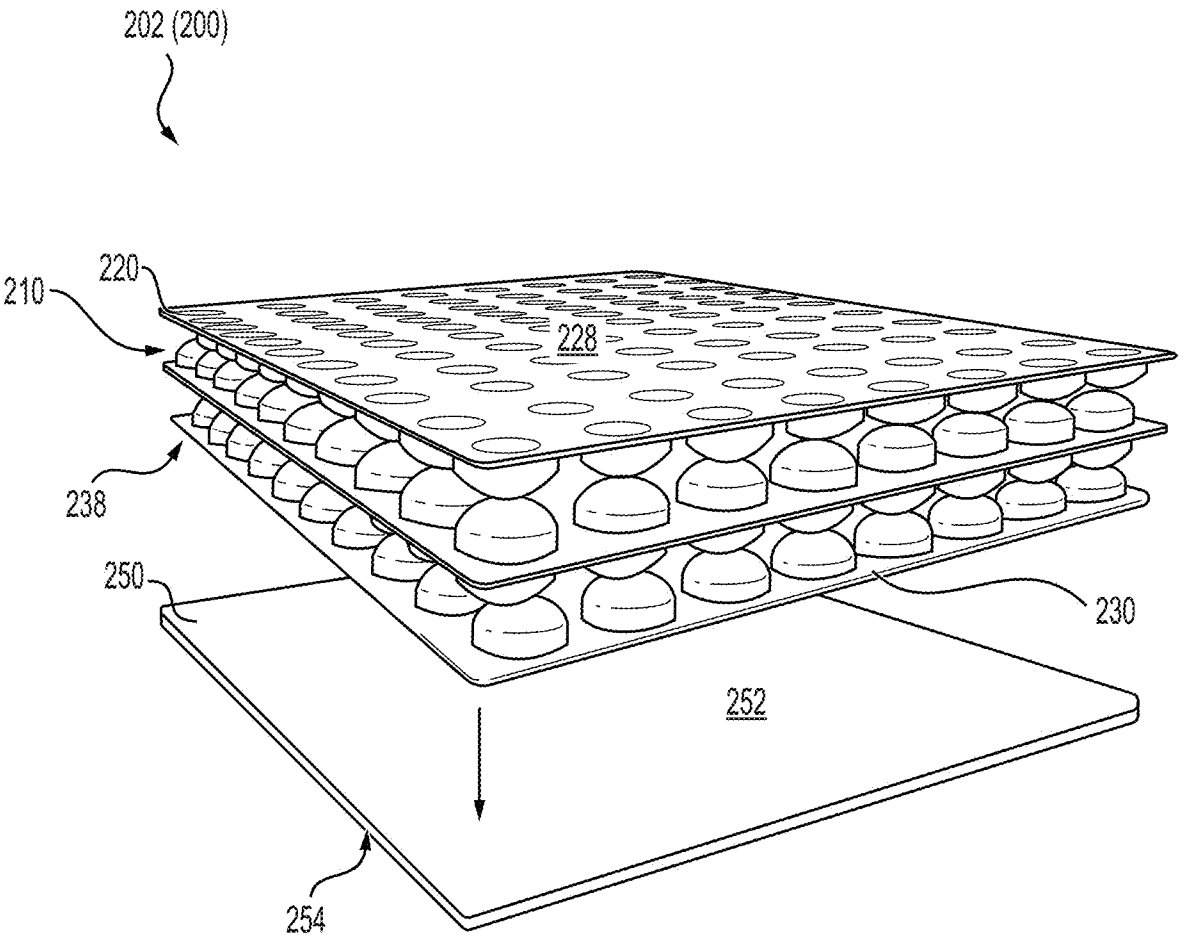
FIG. 12 is an exploded view of a cushioning block that can be used to form the packing materials.

FIG. 12 shows a cushioning block 202 that can be used as a cushioning block 200 of the packing materials 100 (FIG. 1) discussed herein. As noted above, the cushioning block 202 can be a composite cushioning block having one or more cushioning layers 210 in combination with at least one other layer that is a different construction, such as having a different material or a different structure. The other layer, shown in this embodiment, is a cellulosic sheet 250. The cellulosic sheet 250 can be a paper sheet having various basis weights. Thicker and stiffer cellulosic sheets 250 can be used, including, for example, fiberboard sheets. The cellulosic sheet 250 can abut and be attached to the cushioning layer 210. More specifically, the cellulosic sheet 250 can abut and be directly attached to one of the outer side 228 of the first cushioning panel 220 or the outer side 238 of the second cushioning panel 230. The cellulosic sheet 250 can include a first surface 252 and a second surface 254. The first surface 252 can abut and be directly attached to one of the outer side 228 of the first cushioning panel 220 or the outer side 238 of the second cushioning panel 230. An adhesive may be applied to the first surface 252 of the cellulosic sheet 250, to one of the outer side 228 of the first cushioning panel 220 or the outer side 238 of the second cushioning panel 230, or both to directly attach the cellulosic sheet 250 to the cushioning layer 210.

A plurality of cellulosic sheets 250 can be used in different arrangements. In some arrangements, a first cellulosic sheet and a second cellulosic sheet can abut and be directly attached to the outer side 228 of the first cushioning panel 220 and the outer side 238 of the second cushioning panel 230, respectively. In some embodiments, the cellulosic sheet 250 is formed on an outer side of the cushioning block 202 and can be referred to as a cover layer.

Figure 13:
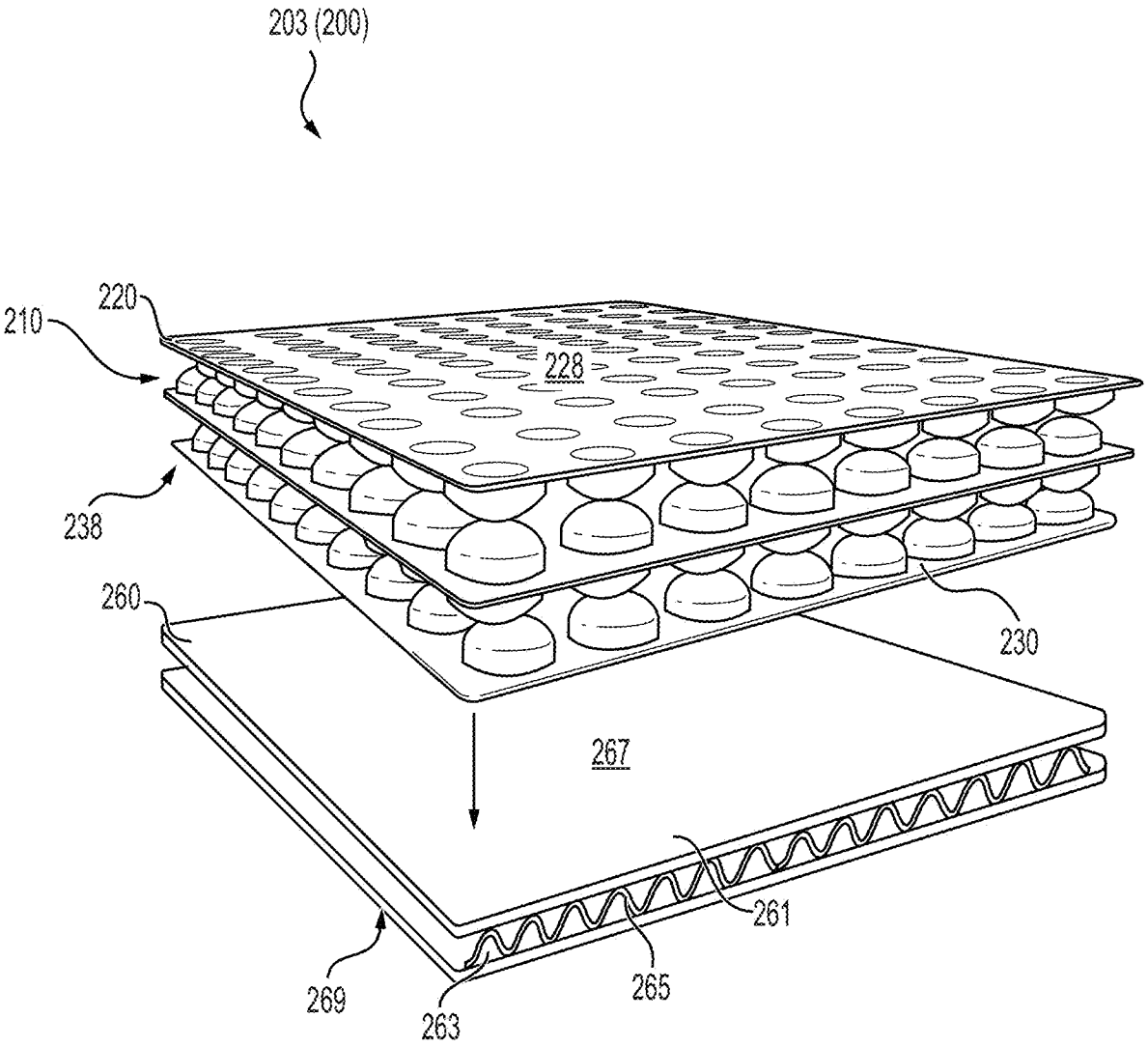
FIG. 13 is an exploded view of a cushioning block that can be used to form the packing materials

FIG. 13 shows a cushioning block 203 that can be used as a cushioning block 200 of the packing materials 100 (FIG. 1) discussed herein. The cushioning block 203 shown in FIG. 13 is also a composite cushioning block, but instead of using the cellulosic sheet 250, the cushioning block 203 can be a corrugated fiberboard sheet 260, also referred to as corrugated cardboard. The corrugated fiberboard sheet 260, shown in FIG. 13, is a single-walled corrugated fiberboard sheet, but other corrugated fiberboard sheets 260 can be used, including, for example, double-walled corrugated fiberboard sheets and triple-walled corrugated fiberboard sheets. The corrugated fiberboard sheet 260 includes a top sheet 261, a bottom sheet 263, and a corrugated sheet 265 sandwiched between the top sheet 261 and the bottom sheet 263. When the corrugated fiberboard sheet 260 is a double-walled corrugated fiberboard sheet or a triple-walled corrugated fiberboard sheet, the corrugated fiberboard sheet 260 can include a plurality of corrugated sheets 265 sandwiched between the top sheet 261 and the bottom sheet 263 with intermediate or middle sheets separating the corrugated sheet 265.

Each of the liners (e.g., the top sheet 261, the bottom sheet 263, and the middle or intermediate sheets) and the corrugated sheets 265 can be suitable sheets made from cellulosic fibers that are typically used in the construction of cardboard shipping boxes. The corrugated sheets 265 each include a plurality of flutes. Any suitable standard flute shape typically used in the construction of cardboard shipping boxes may be used. These flutes are referred to herein as interior flutes to distinguish them from other flutes formed in the packing materials discussed below.

The corrugated fiberboard sheet 260 can be positioned and arranged in a manner similar to the cellulosic sheet 250 discussed above. More specifically, the corrugated fiberboard sheet 260 can include a first surface 267, which is an outward-facing surface of the top sheet 261, and a second surface 269, which is an outward-facing surface of the bottom sheet 263. The first surface 267 and the second surface 269 of the corrugated fiberboard sheet 260 can be positioned and arranged similarly to the first surface 252 and the second surface 254 of the cellulosic sheet 250 discussed above. In some embodiments, the corrugated fiberboard sheet 260 is formed on an outer side of the cushioning block 202 and, like the cellulosic sheet 250, can be referred to as a cover layer. The corrugated fiberboard sheet 260 can also be a structural layer of the cushioning block 203.

For some applications, including the TV application discussed above, a combination of both strong and rigid protection with cushioning may be desired. Accordingly, in some embodiments, one or more cushioning panels 300 (FIGS. 3A to 3G), arranged and constructed in the manner discussed above, can be used in conjunction with additional layers of a stronger, more rigid construction. For example, a composite cushioning block can be formed using a cushioning layer 210 (FIG. 2) having one or more cushioning panels 300, with another panel or sheet panel, having a stronger, more rigid construction than the cushioning panels 300 and cushioning layer 210. These sheet panels are referred to herein as rigid sheet panels 400 (FIG. 14A) to distinguish them from the cushioning panels 300, and the rigid sheet panels 400 have a rigidity greater than that of the cushioning panels 300, the cushioning layer 210, or both, when a load is applied in the thickness direction of the rigid sheet panels 400, the cushioning panels 300, or cushioning layer 210. The composite cushioning blocks can include one or more rigid layer 270 (FIGS. 15A to 15D) formed from one or more rigid sheet panels 400. Various different rigid sheet panels 400 that can be used to form the rigid layer 270 are discussed further below, and reference numeral 400 is used herein to refer generally to the various different rigid panels.

Figure 14A:
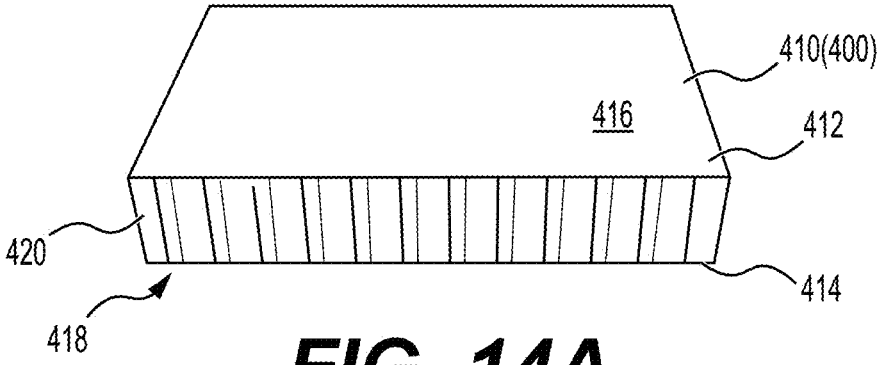
FIG. 14A is a schematic view of a rigid sheet panel and, more specifically, a honeycomb panel that can be used to form the cushioning blocks.

FIG. 14A shows a rigid sheet panel 400 that can be used to form the cushioning blocks 200 and the packing materials 100 (FIG. 1). The rigid sheet panel 400 shown in FIG. 14A is a honeycomb panel 410. The honeycomb panel 410 includes a top sheet 412 and a bottom sheet 414. The honeycomb panel 410 can include a first surface 416, which is an outward-facing surface of the top sheet 412, and a second surface 418, which is an outward-facing surface of the bottom sheet 414. Each of the top sheet 412 and the bottom sheet 414 are cellulosic sheets, and the discussion of the cellulosic sheet 250 above applies to these sheets. The honeycomb panel 410 also includes a core 420 sandwiched between the top sheet 412 and bottom sheet 414.

Figure 14B:
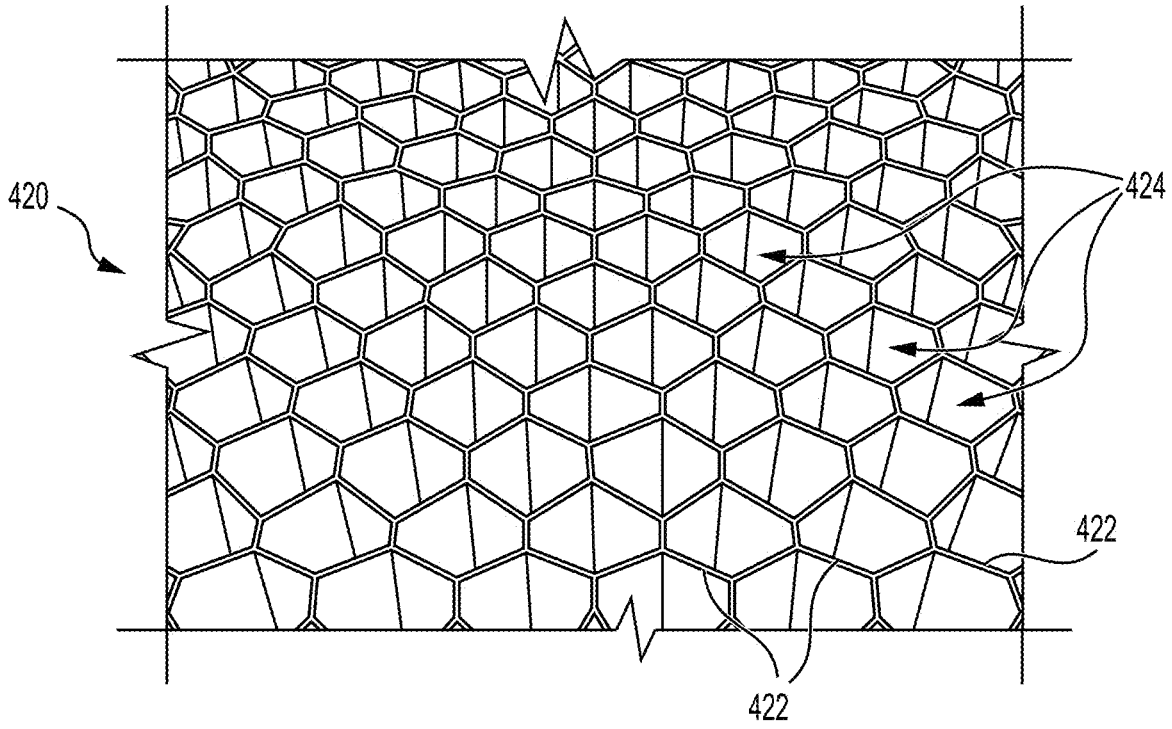
FIG. 14B is a schematic view showing the core of the honeycomb panel.

FIG. 14B shows the core 420 of the honeycomb panel 410. The core 420 includes a plurality of bands 422. The bands 422 are cellulosic bands of cellulosic sheet materials, and the discussion of the cellulosic sheet 250 above applies to these cellulosic bands. The core 420 is formed by attaching, such as by using an adhesive, the bands 422 together to form a plurality of cells 424 defined by the bands 422. In FIG. 14B, the cells 424 have a hexagonal shape, but other shapes can be used. The bands 422 can be oriented in a direction transverse to the top sheet 412 and the bottom sheet 414, such as in a direction normal to the top sheet 412 and bottom sheet 414. The cells 424 are also oriented in a direction transverse to the top sheet 412 and the bottom sheet 414, such as in a direction normal to the top sheet 412 and bottom sheet 414. The top sheet 412 and the bottom sheet 414 can have a thickness greater than the bands 422.

Figure 15A:
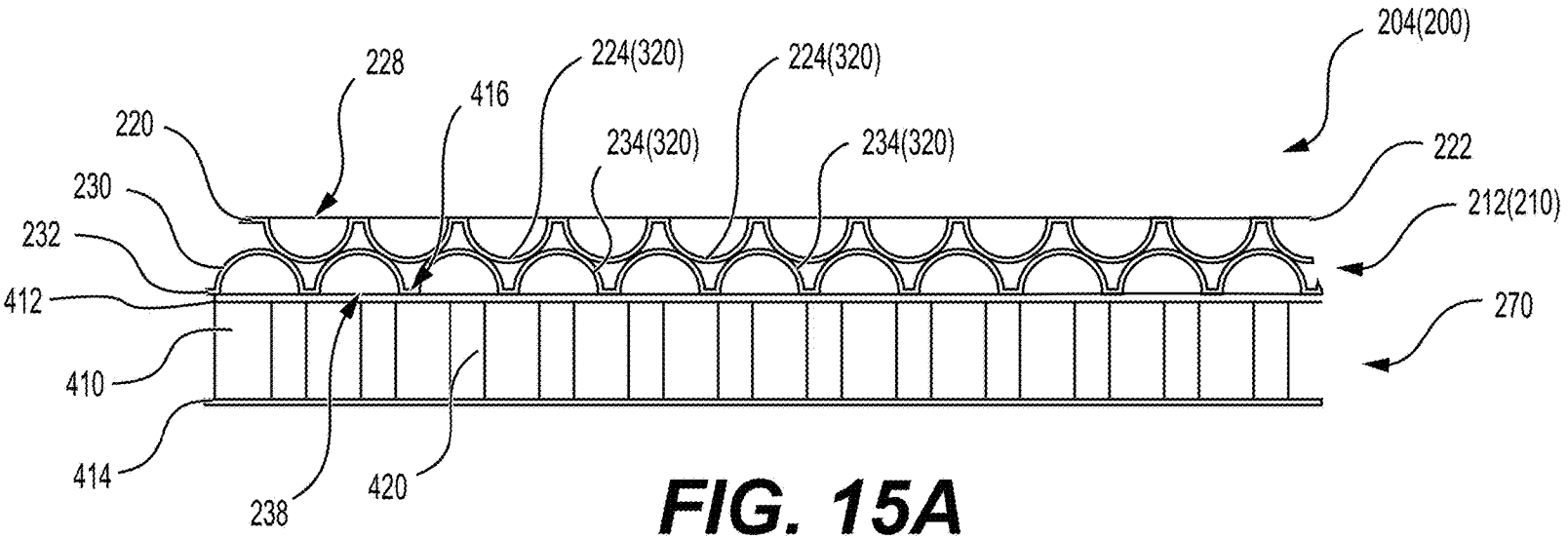
FIG. 15A is a cross-sectional view of a cushioning block using with a rigid layer using the honeycomb panel, taken from a perspective similar to FIG. 4B.

FIGS. 15A to 15D show cushioning blocks 200 and, more specifically, composite cushioning blocks formed with one or more cushioning layers 210 in combination with one or more rigid layers 270. FIG. 15A shows a cushioning block 204 having the cushioning layer 212 discussed above and a rigid layer 270 formed using one honeycomb panel 410. The rigid layer 270 and, more specifically, the honeycomb panel 410 is shown in FIG. 15A as contacting the cushioning layer 210. As noted above, the honeycomb panel 410 includes a top sheet 412 with a first surface 416. The top sheet 412 can be positioned to abut the second cushioning panel 230 of the cushioning layer 210. The first surface 416 of the top sheet 412 can abut and be directly attached to one of the outer sides 228 of the first cushioning panel 220 or the outer side 238 of the second cushioning panel 230. An adhesive may be applied to the first surface 416 of the honeycomb panel 410 to one of the outer side 228 of the first cushioning panel 220 or the outer side 238 of the second cushioning panel 230, or both to directly attach the honeycomb panel 410 to the cushioning layer 210. In FIG. 15A, the top sheet 412 abuts the second base layer 232 of the cushioning layer 210.

The projections 320, such as the first projections 224, the second projections 234, or both, can be oriented in the same direction as the cells 424 (FIG. 14B) of the honeycomb panel 410. The first projections 224, the second projections 234, the cells 424, or combinations thereof can be oriented in a thickness direction of the cushioning block 204.

Figure 15B:
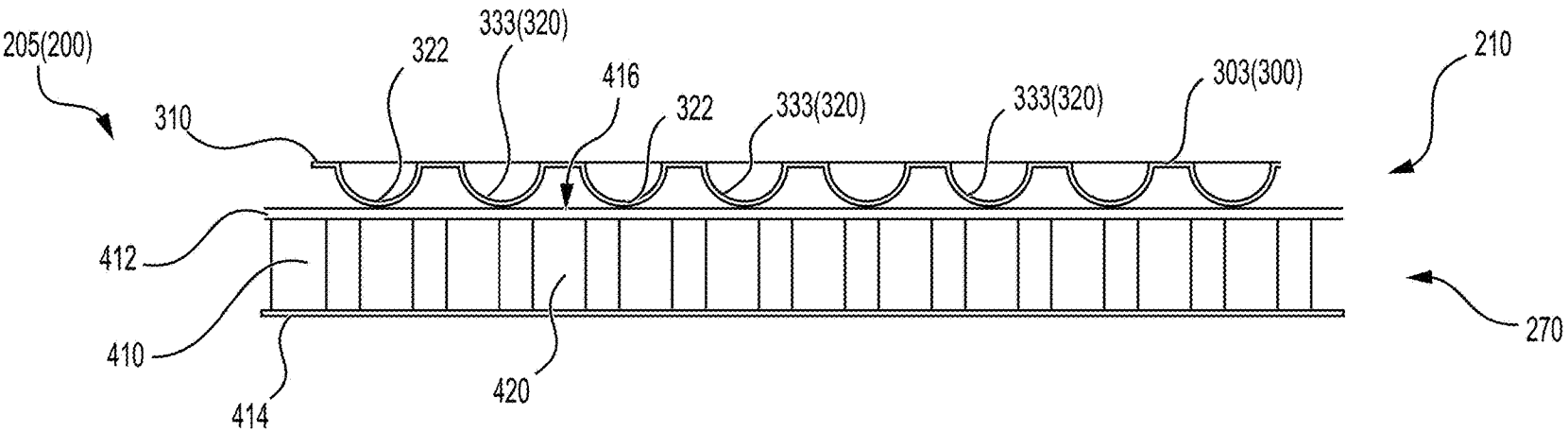
FIG. 15B is a cross-sectional view of a cushioning block using with a rigid layer using the honeycomb panel, taken from a perspective similar to FIG. 4B.

FIG. 15B shows a cushioning block 205 with the rigid layer 270 formed using one honeycomb panel 410. The cushioning block 205 is similar to the cushioning block 204 discussed above with reference to FIG. 15A, but as shown in FIG. 15B, the cushioning layer 210 is formed with one cushioning panel 300, such as the cushioning panel 303 discussed above. The cushioning panel 303 can be positioned in different orientations, such as with the projections 320 extending towards the honeycomb panel 410, such as with the distal ends 322 of the projections 320 contacting the first surface 416 of the top sheet 412.

Figure 15C:
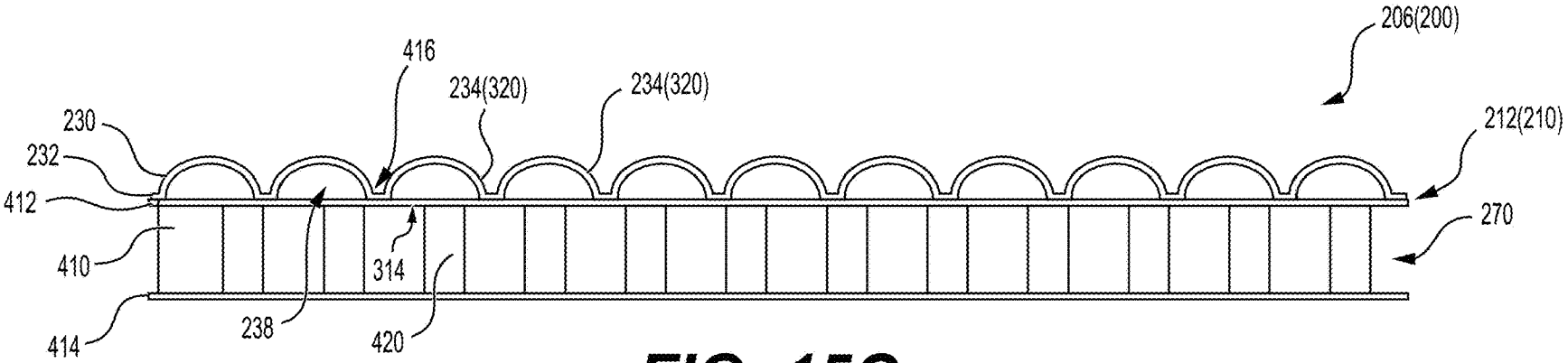
FIG. 15C is a cross-sectional view of a cushioning block using with a rigid layer using the honeycomb panel, taken from a perspective similar to FIG. 4B.

FIG. 15C shows another cushioning block 206 with the rigid layer 270 being the honeycomb panel 410. The cushioning block 206 shown in FIG. 15C is similar to the cushioning block 205 discussed above with reference to FIG. 15B, but here, the projections 320 project away from the honeycomb panel 410. The base layer 310 can abut the honeycomb panel 410, such as the top sheet 412. More specifically, the back-side surface 314 can be positioned to abut and directly contact the first surface 416.

Figure 15D:
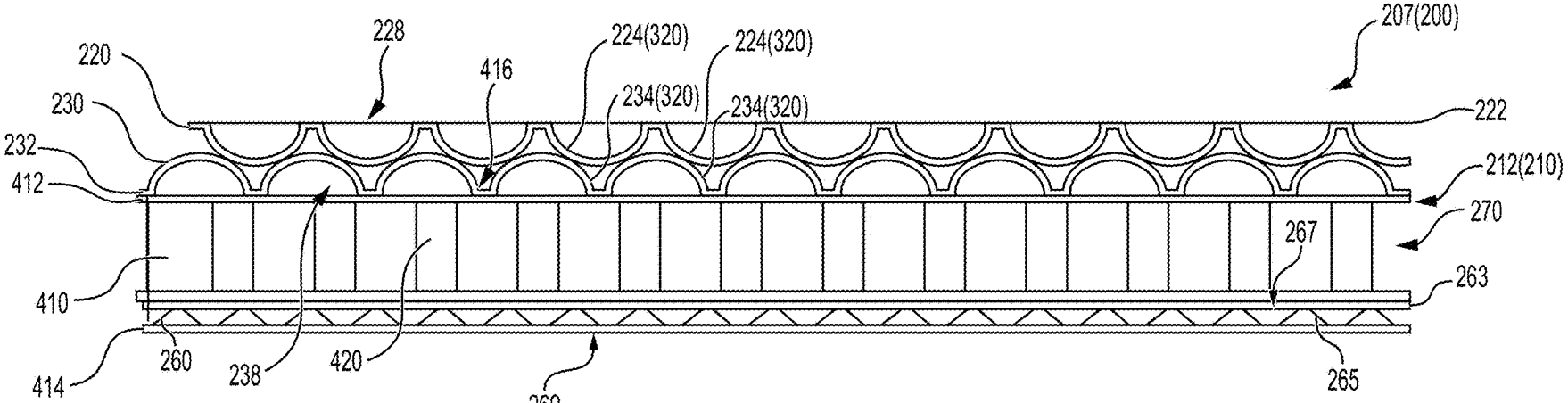
FIG. 15D is a cross-sectional view of a cushioning block using with a rigid layer using the honeycomb panel, taken from a perspective similar to FIG. 4B.

FIG. 15D shows another cushioning block 207. The cushioning block 207 is similar to the cushioning block 204 discussed above with reference to FIG. 15A. The cushioning block 207 includes a corrugated fiberboard sheet 260 in addition to the cushioning layer 210 and the rigid layer 270. The corrugated fiberboard sheet 260 can be integrated in various locations within the cushioning block 207. The corrugated fiberboard sheet 260 can be positioned adjacent to, such as to abut, the cushioning layer 210, the rigid layer 270, or both. The corrugated fiberboard sheet 260 can be positioned on an outer surface of the cushioning block 207, such as on an outer side of the cushioning layer 210 or the rigid layer 270, but the corrugated fiberboard sheet 260 can be positioned between the cushioning layer 210 and the rigid layer 270. As shown in FIG. 15D, for example, the corrugated fiberboard sheet 260 is positioned adjacent to the rigid layer 270 and, more specifically, to abut the honeycomb panel 410 of the rigid layer 270.

As noted above, the packing materials 100 (FIG. 1) discussed herein can be formed from one or more cushioning blocks 200. The cushioning blocks 200 can be arranged in various ways and in various combinations around the product 10 (FIG. 1). In the following discussion, the packing materials 100 will be described as being formed into unitary structures with the cushioning blocks 200 connected to each other, such as by a corrugated fiberboard sheet 260. The cushioning blocks 200 can be arranged around the product 10 in the manner discussed below without being connected to each other.

Figure 16A:
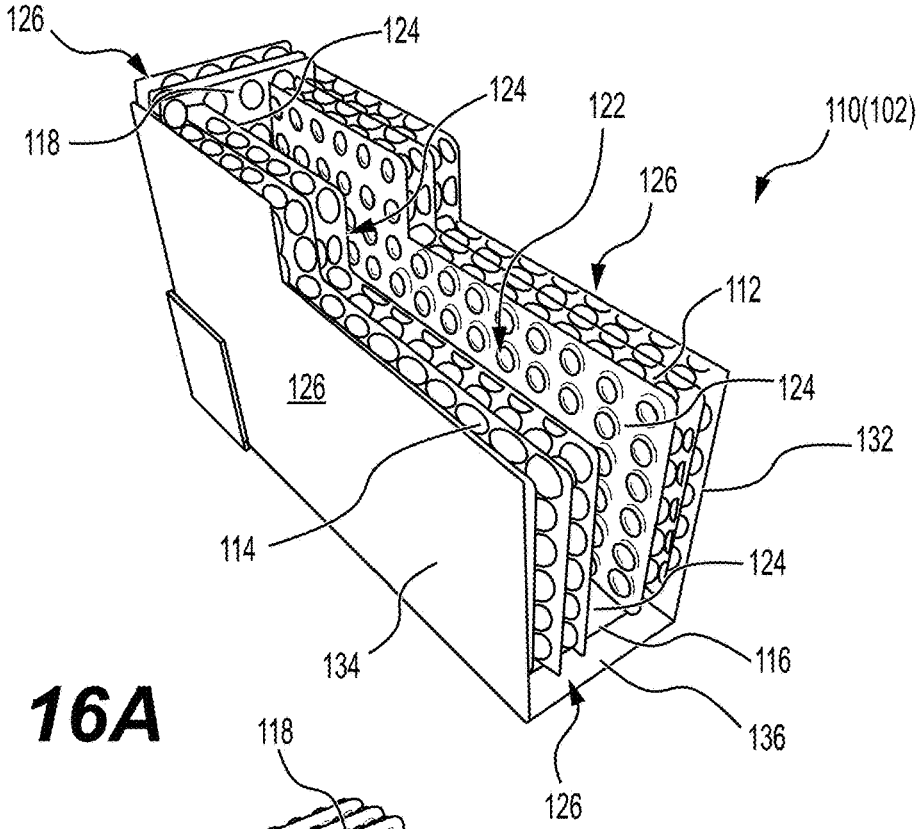
FIG. 16A is a schematic view of a corner-shaped packing material.
Figure 16B:
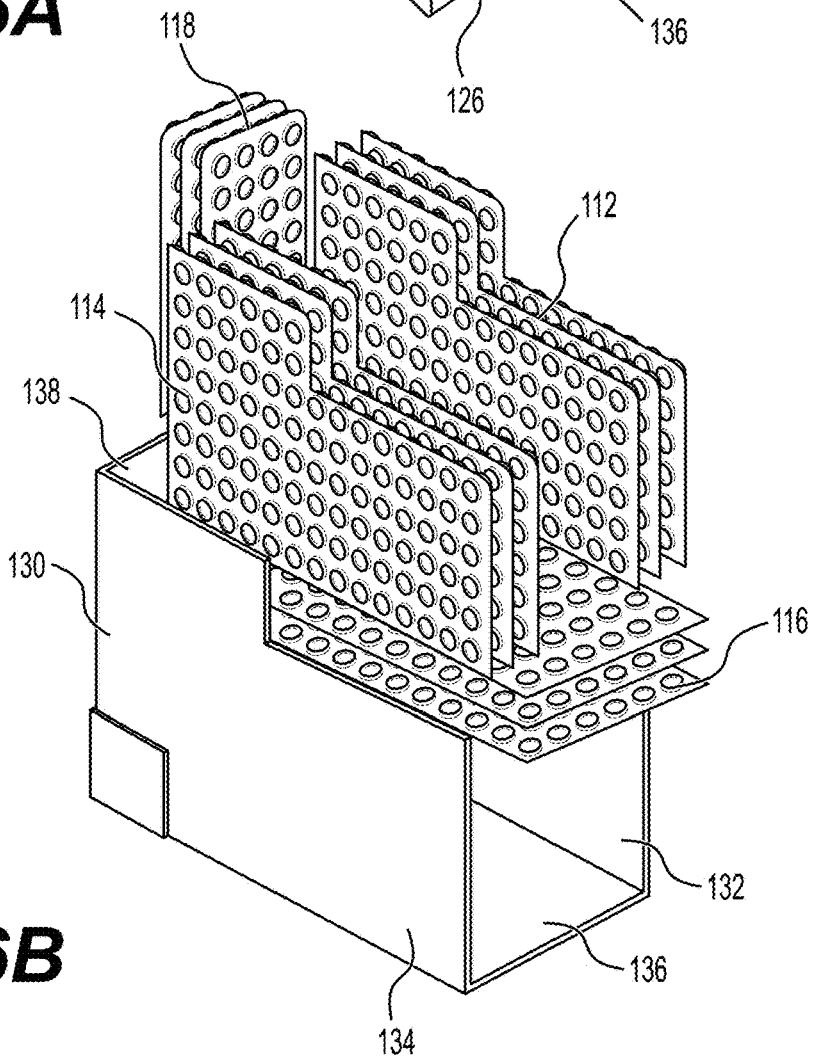
FIG. 16B is an exploded view of the corner-shaped packing material shown in FIG. 16A.

FIGS. 16A and 16B show a corner-shaped packing material 110 that can be used as, for example, one of the corner-shaped packing materials 102 discussed above with reference to FIG. 1. FIG. 16B is an exploded view of the corner-shaped packing material 110. The corner-shaped packing material 110 includes one or more cushioning blocks capable of being positioned around the product 10. More specifically, the corner-shaped packing material 110 includes a plurality of cushioning blocks including a first cushioning block 112, a second cushioning block 114, a third cushioning block 116, and a fourth cushioning block 118. Each of these cushioning blocks 112, 114, 116, and 118 includes one or more cushioning layers 210 and, more specifically, as depicted in FIGS. 16A and 16B, two cushioning layers 210. The cushioning layers depicted in FIGS. 16A and 16B are the cushioning layers 211 shown and described above with reference to FIGS. 4A to 4C, but other cushioning layers 210 may be used, and each of these cushioning blocks 112, 114, 116, and 118 includes the first cushioning layer 211*a* and the second cushioning layer 211*b*.

The first cushioning block 112 and the second cushioning block 114 are positioned to oppose each other with a product cavity 122 therebetween. The first cushioning block 112 and the second cushioning block 114 can be oriented parallel to each other, with a thickness direction of each of the first cushioning block 112 and the second cushioning block 114 being oriented in the same direction. The first cushioning block 112 can be a front cushioning block and the second cushioning block 114 can be a back cushioning block. The first cushioning block 112 and the second cushioning block 114 can have different shapes, and, as depicted in FIGS. 16A and 16B, the first cushioning block 162 and the second cushioning block 114 each have the same shape, which is an L-shape.

The third cushioning block 116 is positioned along one edge of each of the first cushioning block 112 and the second cushioning block 114 to form a bottom cushioning block. The third cushioning block 116 can be positioned on a long side of the first cushioning block 112 and the second cushioning block 114. The third cushioning block 116 is positioned transverse and, more specifically, orthogonal to the first cushioning block 112 and the second cushioning block 114.

The fourth cushioning block 118 is positioned along one edge of each of the first cushioning block 112 and the second cushioning block 114 to form a side cushioning block. The fourth cushioning block 118 can be positioned on a short side of the first cushioning block 112 and the second cushioning block 114. The fourth cushioning block 118 is positioned transverse and, more specifically, orthogonal to the first cushioning block 112 and the second cushioning block 114. The third cushioning block 116 and the fourth cushioning block 118 also are positioned transverse and, more specifically, orthogonal to each other.

The third cushioning block 116 and the fourth cushioning block 118 also define boundaries of the product cavity 122. The product cavity 122 shown in FIG. 16A is a slot, but other shapes may be formed with the arrangement of the product cavity 122. In the depicted arrangement, each of the cushioning blocks 112, 114, 116, and 118 define the product cavity 122 in which the product 10 can be placed. The cushioning blocks 112, 114, 116, and 118 include a product side and a product-side surface 124, which is a surface of each of the cushioning blocks 112, 114, 116, and 118 facing the product cavity 122.

The cushioning blocks 112, 114, 116, and 118 also include a container side and a container-side surface 126, which is a surface outward from the corner-shaped packing material 110 and away from the product cavity 122. Each of the cushioning blocks 112, 114, 116, and 118 include a backing sheet, such as a corrugated fiberboard sheet 260, positioned on the container side of the cushioning blocks 112, 114, 116, and 118. More specifically, the corner-shaped packing material 110 includes a first corrugated fiberboard sheet portion 132, a second corrugated fiberboard sheet portion 134, a third corrugated fiberboard sheet 1 portion 36, and a fourth corrugated fiberboard sheet portion 138 corresponding to the first cushioning block 112, the second cushioning block 114, the third cushioning block 116, and the fourth cushioning block 118, respectively, and arranged in the manner discussed above. Although the corrugated fiberboard sheet portions 132, 134, 136, and 138 can be independently formed on the cushioning blocks 112, 114, 116, and 118 as individual sheets, the corrugated fiberboard sheet portions 132, 134, 136, and 138 are illustrated in FIGS. 16A and 16B as portions of a corrugated fiberboard sheet 130 that are connected to each other and folded in a manner to form an open box shaped structure.

Figure 17:
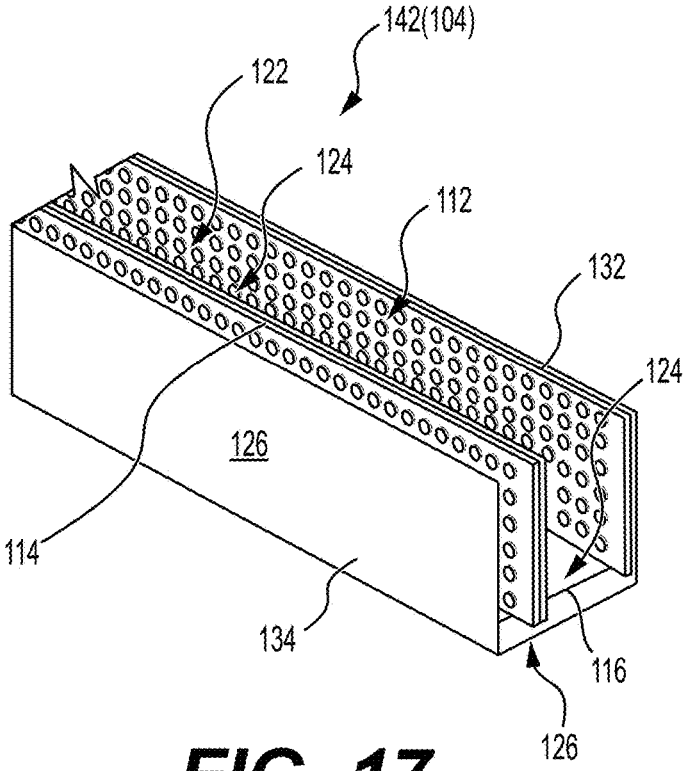
FIG. 17 is a schematic view of a U-shaped packing material.

FIG. 17 shows a U-shaped packing material 142 that can be used as, for example, one of the U-shaped packing materials 104 discussed above with reference to FIG. 1. The U-shaped packing material 142 is formed similarly to the corner-shaped packing material 110 discussed above with reference to FIGS. 16A and 16B. The U-shaped packing material 142 includes the first cushioning block 112, the second cushioning block 114, and the third cushioning block 116 arranged in a U-shape similar to the arrangement discussed above. The shape of each of the first cushioning block 112 and the second cushioning block 114 are depicted as elongated rectangular blocks to form an elongated product cavity 122.

Figure 18:
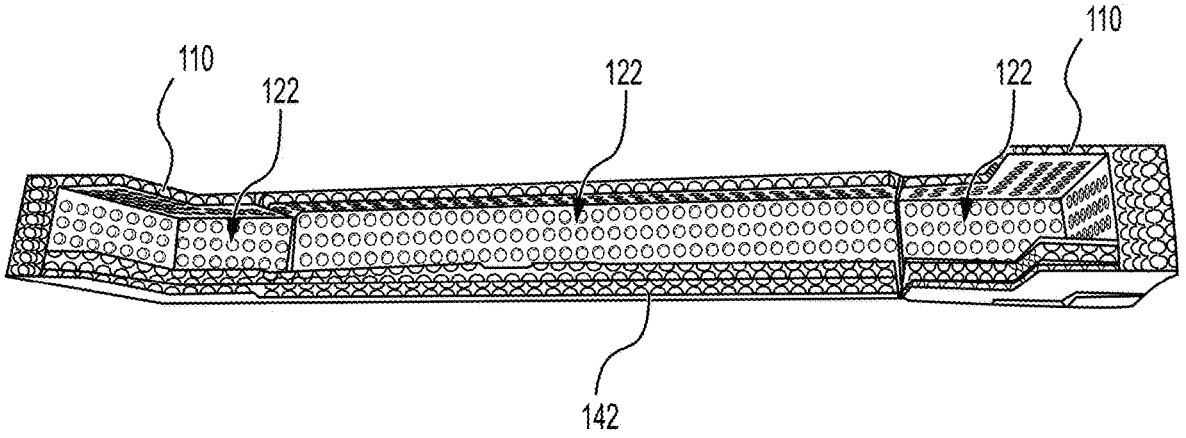
FIG. 18 is a schematic view of two corner-shaped packing materials and a U-shaped packing material arranged next to each other.

FIG. 18 shows two corner-shaped packing materials 110 and a U-shaped packing material 142 arranged next to each other. The product cavities 122 of the corner-shaped packing materials 110 and the U-shaped packing material 142 can be aligned with each other to form a continuous cavity for the product 10 (FIG. 1). While shown adjacent to each other in FIG. 18 (and also in FIG. 1), the packing materials 100, such as the corner-shaped packing materials 110 and the U-shaped packing material 142, can be spaced apart from each other with gaps therebetween.

Figure 19A:
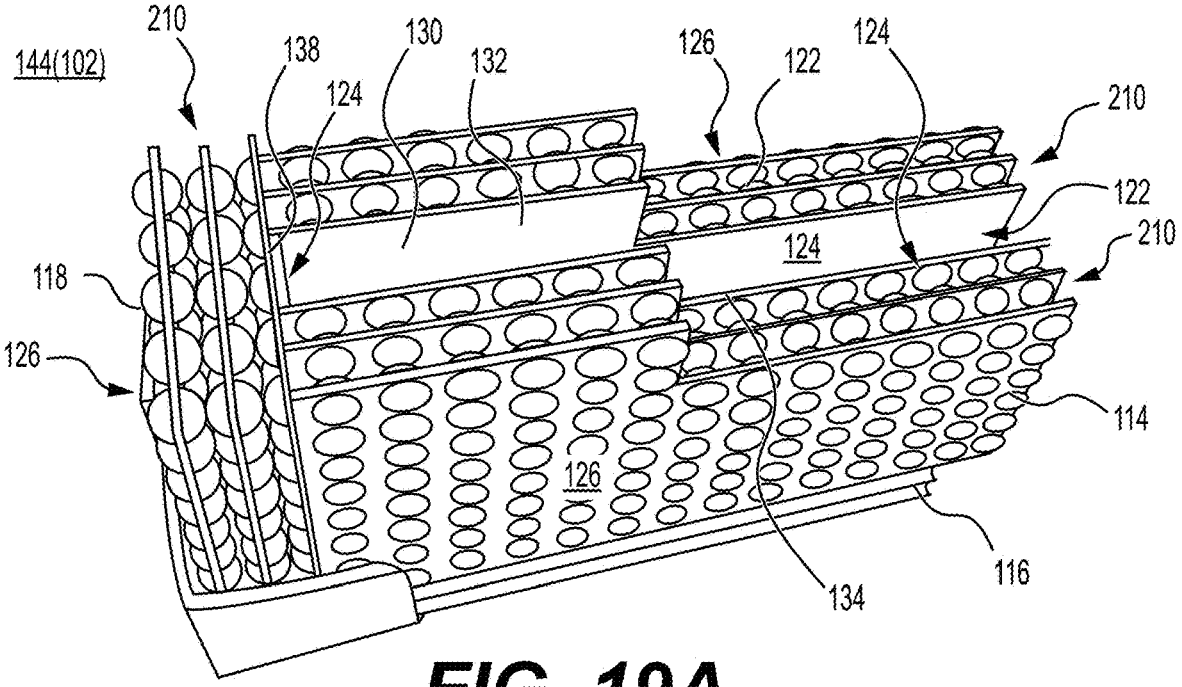
FIG. 19A is a schematic view of a corner-shaped packing material.
Figure 19B:
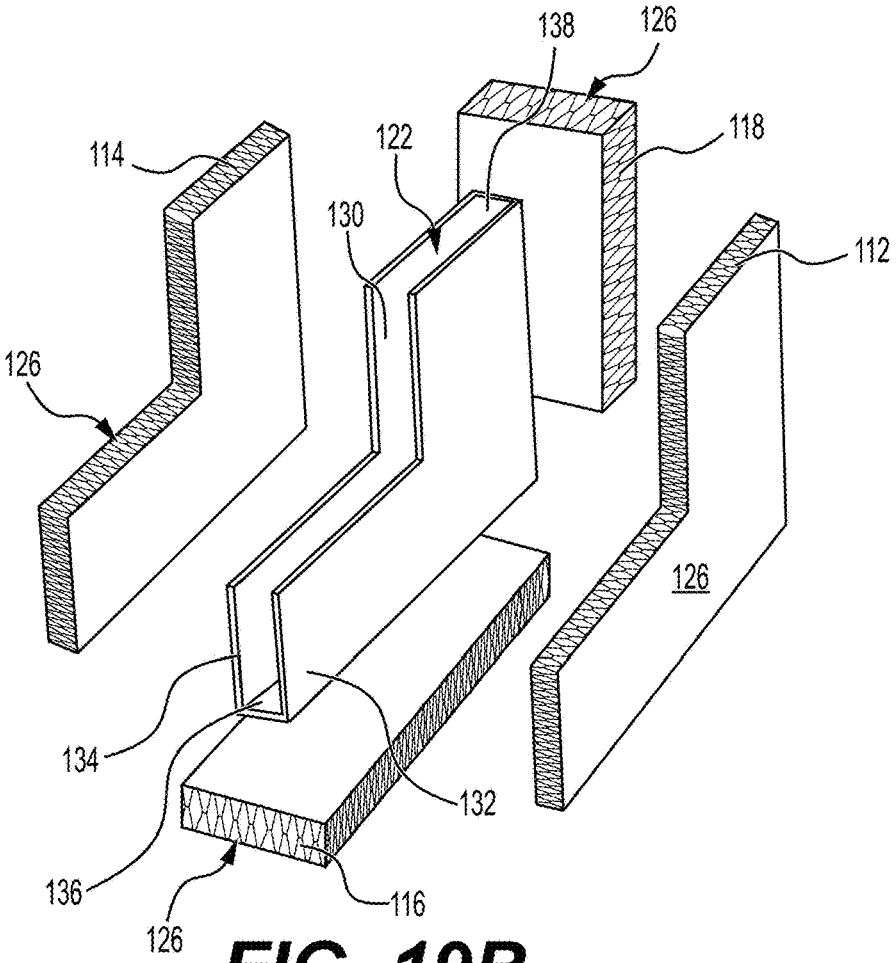
FIG. 19B is an exploded view of the corner-shaped packing material shown in FIG. 19A.

FIGS. 19A and 19B show another corner-shaped packing material 144 that can be used as, for example, one of the corner-shaped packing materials 102 discussed above with reference to FIG. 1. FIG. 19B is an exploded view of the corner-shaped packing material 144. The corner-shaped packing material 144 shown in FIGS. 19A and 19B is similar to the corner-shaped packing material 110 discussed above with reference to FIGS. 16A and 16B, and that discussion applies here. In this corner-shaped packing material 144, the first corrugated fiberboard sheet portion 132, the second corrugated fiberboard sheet portion 134, the third corrugated fiberboard sheet portion 136, and the fourth corrugated fiberboard sheet portion 138 are formed on the product-side surface 124 of each cushioning block 112, 114, 116, and 118, instead of the container-side surface 126. In this embodiment, the corrugated fiberboard sheet 130 and, more specifically, the corrugated fiberboard sheet portions 132, 134, 136, and 138 define the cavity instead of a surface of the cushioning layers 210. In still other embodiments, the corrugated fiberboard sheet portions 132, 134, 136, and 138 can be formed on either side of the cushioning layers 210 (e.g., combining the features of FIGS. 16A and 16B with FIGS. 19A and 19B).

Figure 20A:
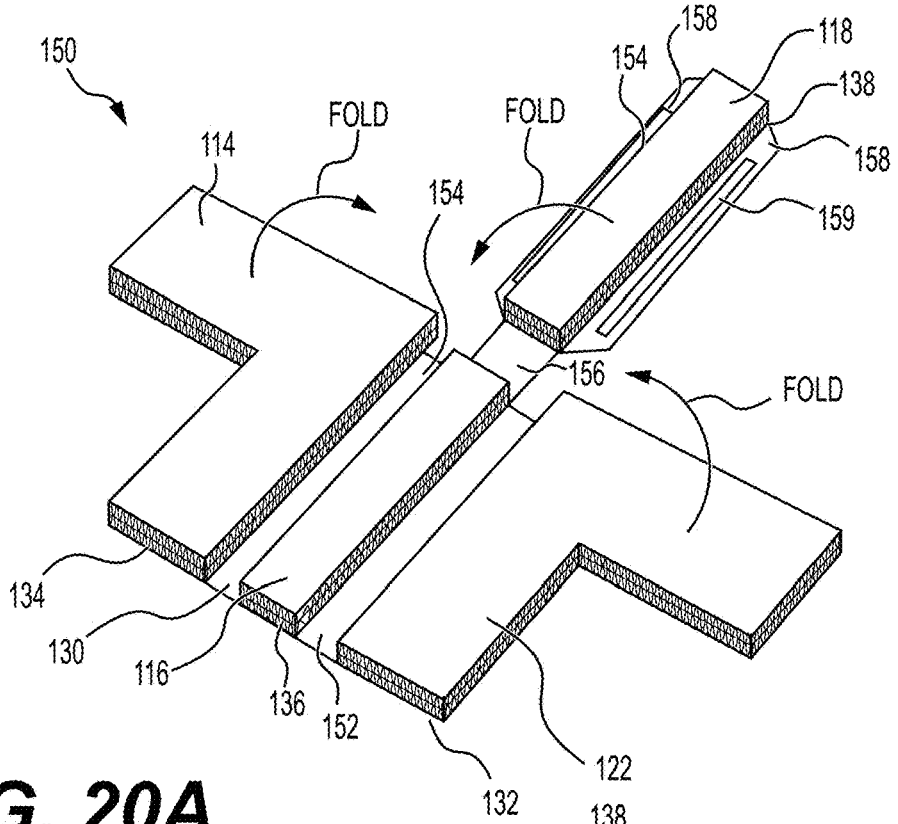
FIG. 20A is a schematic view of a corner-shaped packing material in a flat configuration.
Figure 20B:
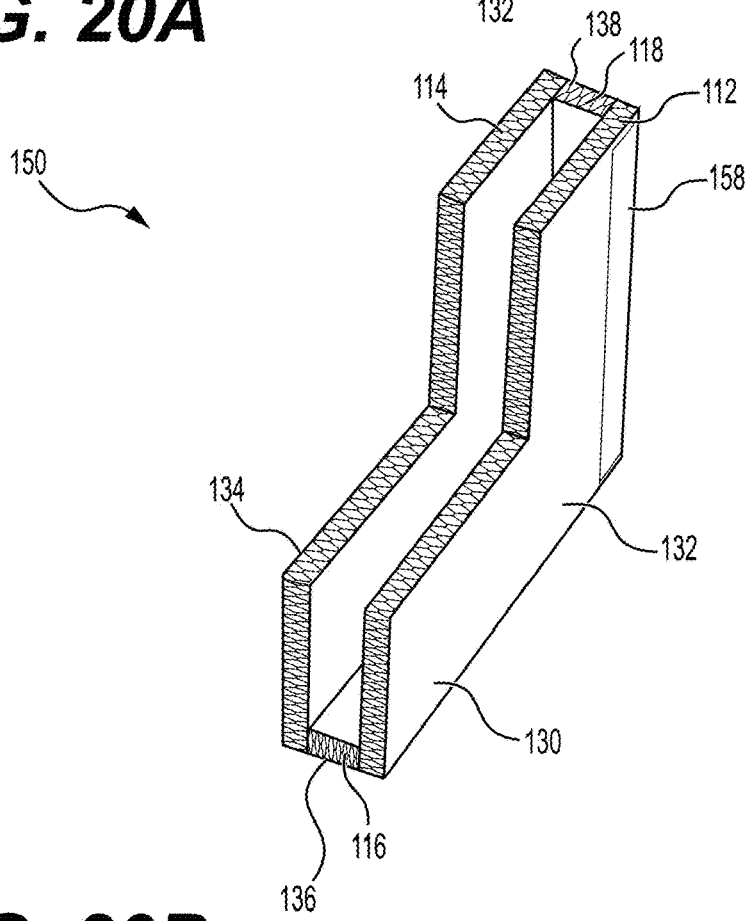
FIG. 20B is a schematic view of the corner-shaped packing material of FIG. 20A in a folded configuration.

FIGS. 20A and 20B show another corner-shaped packing material 150 that can be used as, for example, one of the corner-shaped packing materials 102 discussed above with reference to FIG. 1. The corner-shaped packing material 150 shown in FIGS. 20A and 20B is similar to the corner-shaped packing material 110 discussed above with reference to FIGS. 16A and 16B. As noted above, the first corrugated fiberboard sheet portion 132, the second corrugated fiberboard sheet portion 134, the third corrugated fiberboard sheet portion 136, and the fourth corrugated fiberboard sheet portion 138 can be portions of a corrugated fiberboard sheet 130. An advantage of using the corrugated fiberboard sheet 130 is that the cushioning blocks 112, 114, 116, and 118 can be attached to a surface, such as an internal surface, of the corrugated fiberboard sheet 130, and then the corrugated fiberboard sheet 130 can be folded from a flat configuration to a folded configuration to form the corner-shaped packing material 150. Suitable means of attachment include, for example, an adhesive to attach the cushioning blocks 112, 114, 116, and 118 (or portions thereof such as the cushioning layers) to the surface of the corrugated fiberboard sheet 130. The corner-shaped packing material 150 shown in FIGS. 20A and 20B is configurable in a flat configuration and a folded configuration. The flat configuration is shown in FIG. 20A, and the folded configuration is shown in FIG. 20B. In the folded configuration, the corner-shaped packing material 150 is shaped as discussed above with reference to FIGS. 16A and 16B.

In the flat configuration shown in FIG. 20A, the first cushioning block 112 can be spaced apart from the third cushioning block 116 with a gap therebetween. The corrugated fiberboard sheet 130 includes a first connection portion 152 that spans between the first cushioning block 112 and the third cushioning block 116. A connection portion of the corrugated fiberboard sheet 130, such as the first connection portion 152, is a portion of the corrugated fiberboard sheet 130 without a cushioning block attached thereto and allows the first cushioning block 112 to be folded relative to the third cushioning block 116. The first connection portion 152 connects the first corrugated fiberboard sheet portion 132 with the third corrugated fiberboard sheet portion 136. In a similar manner, the second cushioning block 114 is spaced apart from the third cushioning block 116, with a second connection portion 154 connecting the second corrugated fiberboard sheet portion 134 with the third corrugated fiberboard sheet portion 136 to allow the second cushioning block 114 to be folded relative to the third cushioning block 116. Similarly, the fourth cushioning block 118 is spaced apart from the third cushioning block 116, with a third connection portion 156 connecting the fourth corrugated fiberboard sheet portion 138 with the third corrugated fiberboard sheet portion 136 to allow the fourth cushioning block 118 to be folded relative to the third cushioning block 116.

To move from the flat configuration in FIG. 20A to the folded configuration in FIG. 20B, the first cushioning block 112, the second cushioning block 114, and the fourth cushioning block 118 are folded relative to the third cushioning block 116, as indicated by the arrows. Although shown as being folded relative to the third cushioning block 116, the cushioning blocks 112, 114, 116, and 118 can be attached to one another in other configurations to be folded in different orientations, such as the first cushioning block 112, the second cushioning block 114, and the third cushioning block 116 being connected to the fourth cushioning block 118 by the corrugated fiberboard sheet 130 to fold relative to the fourth cushioning block 118. Additionally, although described with reference to the corrugated fiberboard sheet 130, other backing materials or connecting materials can be used, such as paper sheets. More generally, one cushioning bock (e.g., the first cushioning block 112) can be connected to another cushioning block (e.g., the third cushioning block 116) by a connecting material, with a gap formed therebetween to allow the one cushioning block (e.g., the first cushioning block 112) to be folded from a flat configuration to a folded configuration.

To hold the corner-shaped packing material 150 in the folded configuration, the corrugated layer 130 may include tabs 158 that are, for example, connected to or a part of the corrugated fiberboard sheet 130, such as a portion of the fourth corrugated fiberboard sheet portion 138. A peelable adhesive strip 159 can be applied to an inner surface of each tab 158 and used as an adhesive strip to hold the corner-shaped packing material 150 in the folded configuration. Instead of (or in addition to) a peelable adhesive strip 159, other means of holding the corner-shaped packing material 150 in the folded configuration can be used. For example, instead of a peelable adhesive strip 159, an adhesive can be applied to various locations of the corner-shaped packing material 150, such as to the inner surface of the tabs 158, for example. Additionally, or alternatively, an adhesive strip (e.g., tape) can be used. When an adhesive strip such as tape is used, the tabs 158 can be omitted.

Figure 21A:
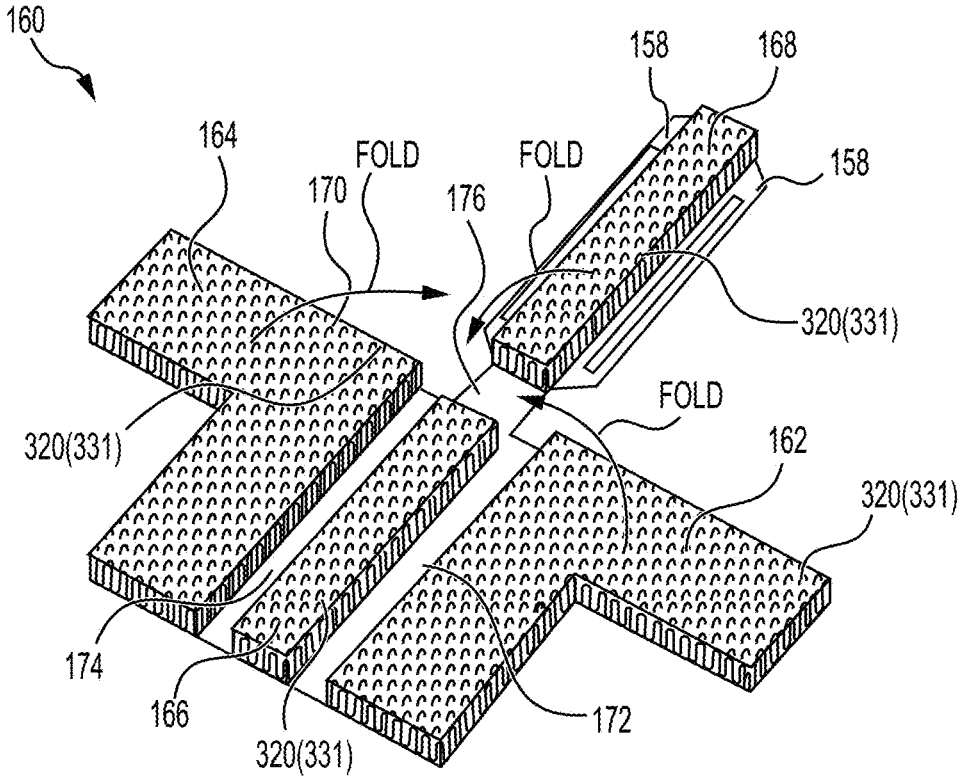
FIG. 21A is a schematic view of a corner-shaped packing material in a flat configuration.
Figure 21B:
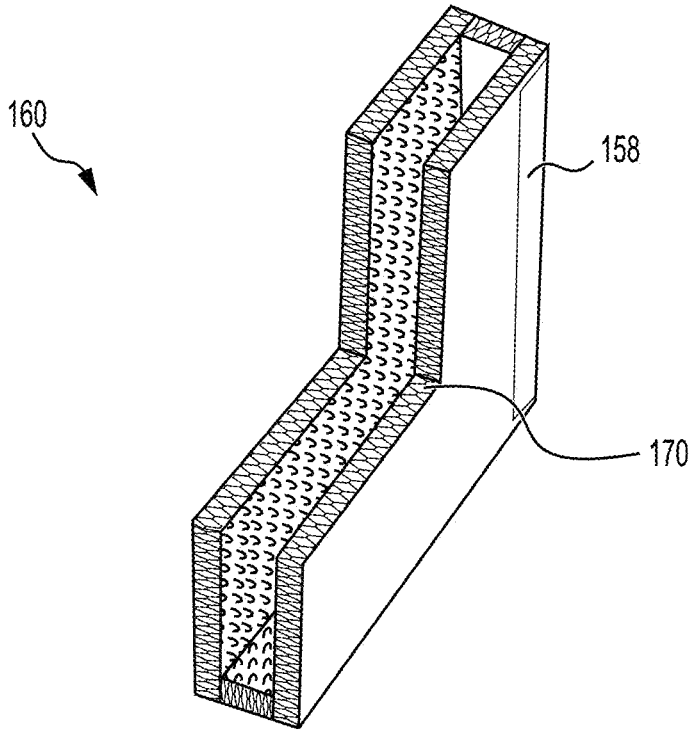
FIG. 21B is a schematic view of the corner-shaped packing material of FIG. 21A in a folded configuration.

FIGS. 21A and 21B show another corner-shaped packing material 160 that can be used as, for example, one of the corner-shaped packing materials 102 discussed above with reference to FIG. 1. The corner-shaped packing material 160 is similar to the corner-shaped packing material 150 shown in FIGS. 20A and 20B and is configurable in a flat configuration and a folded configuration. The flat configuration is shown in FIG. 21A and the folded configuration is shown in FIG. 21B. As noted above, a single molded pulp cushioning panel can be used in the formation of the corner-shaped packing material 160, and the corner-shaped packing material 160, shown in FIGS. 21A and 21B, is formed from a single, foldable molded cushioning panel 170, such as the cushioning panel 301 discussed above with reference to FIGS. 3A and 3B. Although described with reference to cushioning panel 301 (FIGS. 3A and 3B), any of the cushioning panels 300 (e.g., FIGS. 3A to 3G) discussed herein may be used.

The foldable molded cushioning panel 170 includes a first projection section 162, a second projection section 164, a third projection section 166, and a fourth projection section 168 arranged in a manner similar to the first cushioning block 112, the second cushioning block 114, the third cushioning block 116, and the fourth cushioning block 118, respectively, discussed above with respect to FIGS. 20A and 20B. Each of these projection sections 162, 164, 166, and 168 are sections containing projections 320, such as the cylindrical projections 331.

The foldable molded cushioning panel 170 includes a first connection portion 172 that spans between the first projection section 162 and the third projection section 166. A connection portion of the foldable molded cushioning panel 170, such as the first connection portion 172, can be a portion of the cushioning panel 170 without the projections 320 formed thereon. The connecting portions can be a flat sheet portion of the foldable molded cushioning panel 170. The first connection portion 172 connects the first projection section 162 with the third projection section 166 and allows the first projection section 162 to be folded, or otherwise rotated, relative to the third projection section 166. In a similar manner, the second projection section 164 is spaced apart from and connected to the third projection section 166 by a second connection portion 174 to allow the second connection portion 174 to be folded, or otherwise rotated, relative to the third corner-shaped packing material 146. Similarly, the fourth projection section 168 is spaced apart from and connected to the third projection section 166 by a third connection portion 176 to allow the fourth projection section 168 to be folded, or otherwise rotated, relative to the third projection section 166.

The foldable molded cushioning panel 170 can be folded from the flat configuration to the folded configuration and held in the folded configuration in a manner similar to the corner-shaped packing material 150 discussed above with reference to FIGS. 20A and 20B, and that discussion applies here. Additional layers discussed herein can be attached to each of the projection sections 162, 164, 166, and 168 to form the various cushioning blocks discussed herein.

Figure 22A:
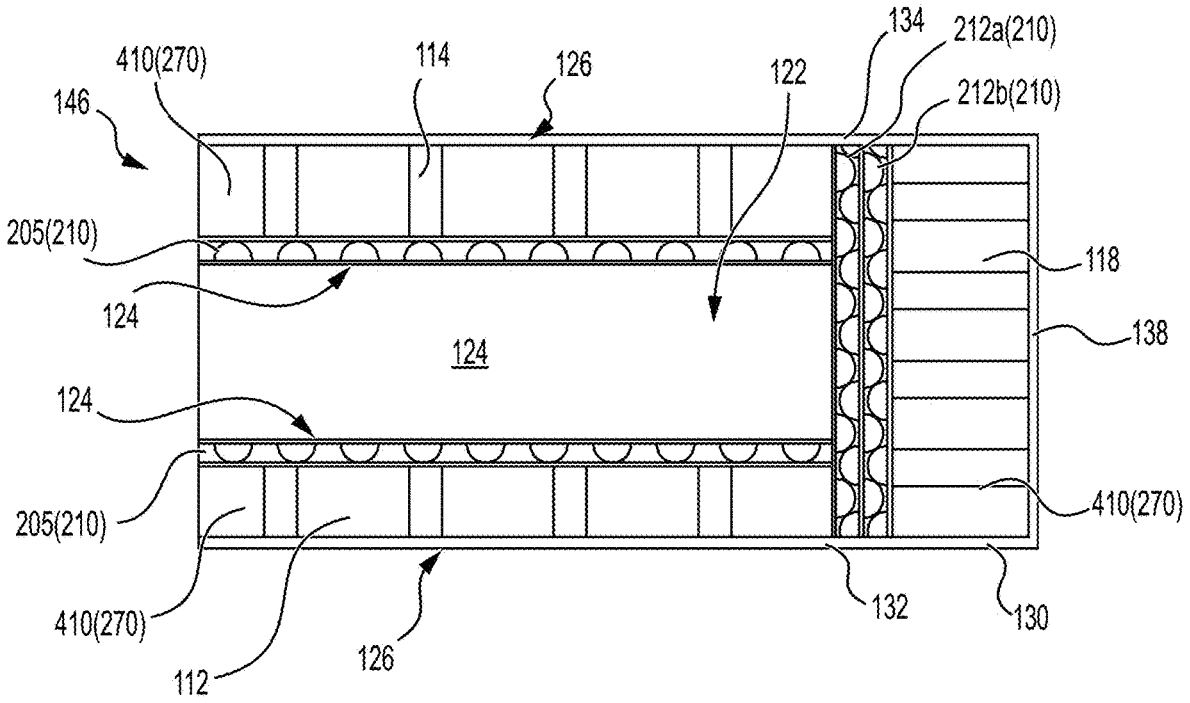
FIG. 22A is a top view of a corner-shaped packing material.
Figure 22B:
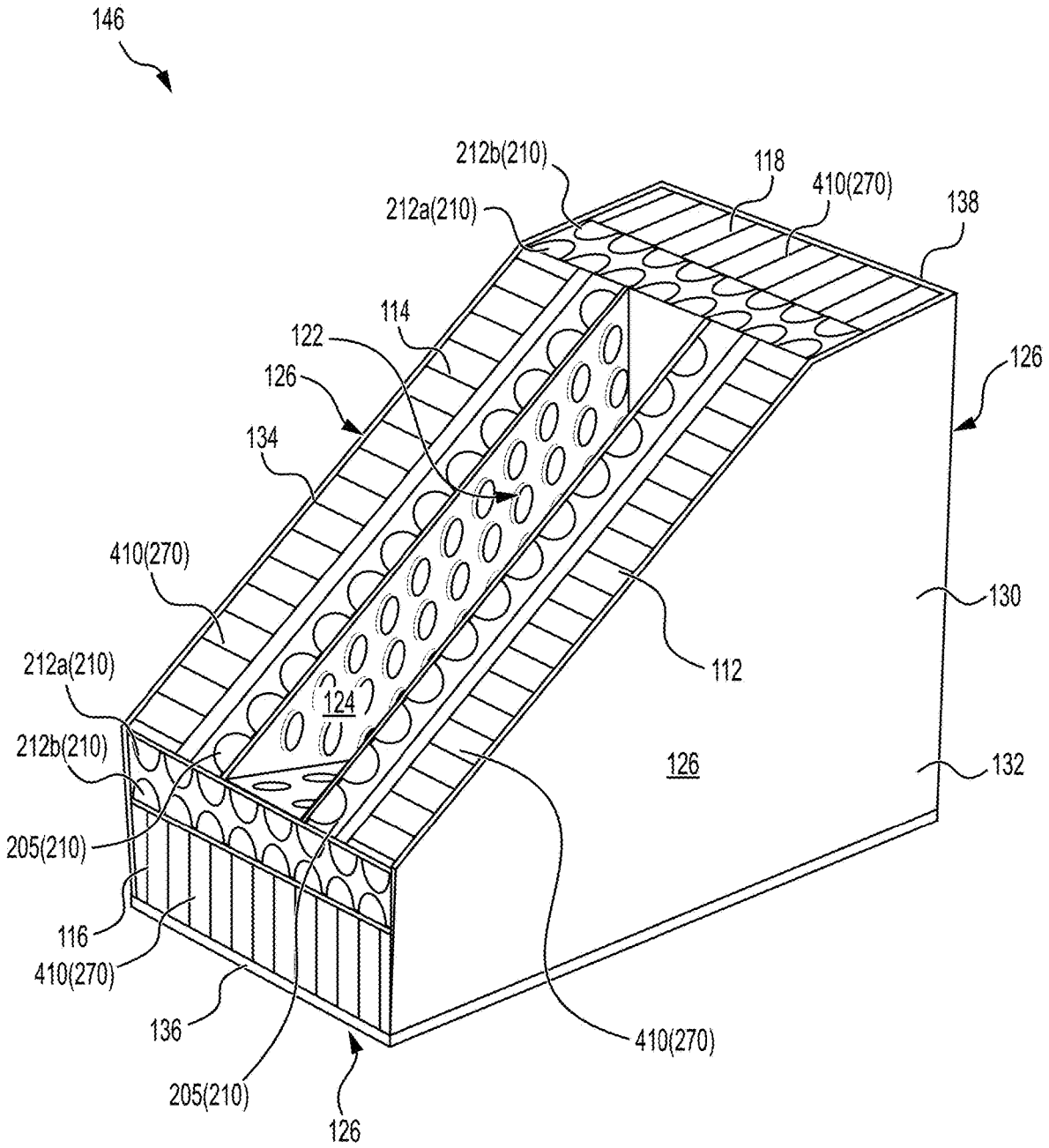
FIG. 22B is a schematic view of the corner-shaped packing material shown in FIG. 22A.

FIGS. 22A and 22B show another corner-shaped packing material 146 that can be used as, for example, one of the corner-shaped packing materials 102 discussed above with reference to FIG. 1. FIG. 22A is a top view of the corner-shaped packing material 146, and FIG. 22B is a perspective view of the corner-shaped packing material 146. The corner-shaped packing material 146, shown in FIGS. 22A and 22B, is similar to the corner-shaped packing material 110 discussed above with reference to FIGS. 16A and 16B, and that discussion applies here. In the corner-shaped packing material 146, shown in FIGS. 22A and 22B, however, each of the cushioning blocks 112, 114, 116, and 118 are composite cushioning blocks, including a rigid layer 270. The rigid layer 270 shown in FIGS. 22A and 22B includes one or more honeycomb panels 410, but any of the rigid sheet panels 400 discussed herein can be used.

More specifically, the first cushioning block 112 and the second cushioning block 114 include the cushioning block 205 discussed above with reference to FIG. 15B. The third cushioning block 116 and the fourth cushioning block 118 include the cushioning block 204 discussed above with reference to FIG. 15A, but with a plurality of cushioning layers 210, such as the first cushioning layer 212*a* and the second cushioning layer 212*b* discussed above with reference to FIG. 5B. As noted above, however, different arrangements and numbers of cushioning layers 210 can be used.

In each of the cushioning blocks 112, 114, 116, and 118, the cushioning layers 210 can be positioned on the product side. More specifically, the cushioning layers 210 are positioned adjacent to the product cavity 122 and positioned to define the product cavity 122 in the manner discussed above with reference to FIGS. 16A and 16B. Also, the rigid layer 270 and, more specifically, the honeycomb panel 410, is positioned between the cushioning layers 210 and the corrugated fiberboard sheet 130, which forms the container side of the corner-shaped packing material 146.

In some embodiments, the third cushioning block 116 and the fourth cushioning block 118 form peripheral edges of the packing materials 100 (FIG. 1). The inventors have found that additional cushioning, such as additional cushioning layers 210, can advantageously be placed around the peripheral edges as opposed to the face of the product 10 (FIG. 1). The third cushioning block 116 and the fourth cushioning block 118 forming the peripheral edges can thus have more cushioning layers 210 than the first cushioning block 112 and the second cushioning block 114.

Figure 23:
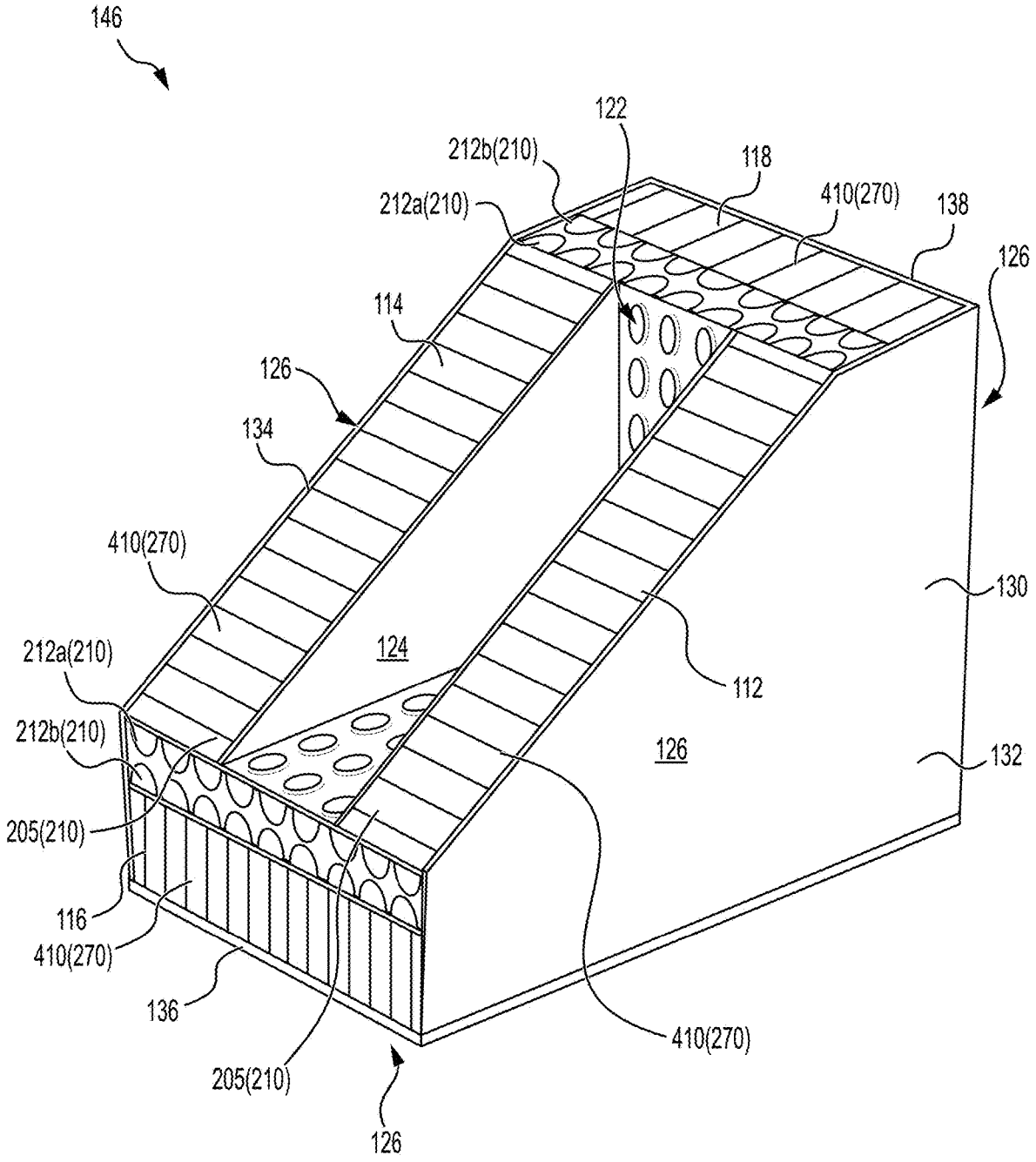
FIG. 23 is a schematic view of a corner-shaped packing material.

FIG. 23 shows another corner-shaped packing material 148 that can be used as, for example, one of the corner-shaped packing materials 102 discussed above with reference to FIG. 1. As noted above, additional cushioning layers 210 can be placed on the peripheral edges as opposed to the face of the product 10 (FIG. 1). The corner-shaped packing material 148 shown in FIG. 23 is similar to the corner-shaped packing material 146 shown in FIGS. 22A and 22B, but here, the cushioning layers 210 are omitted from the first cushioning block 112 and the second cushioning block 114, resulting in only a honeycomb panel 410 and the corrugated fiberboard sheet 130.

Figure 24A:
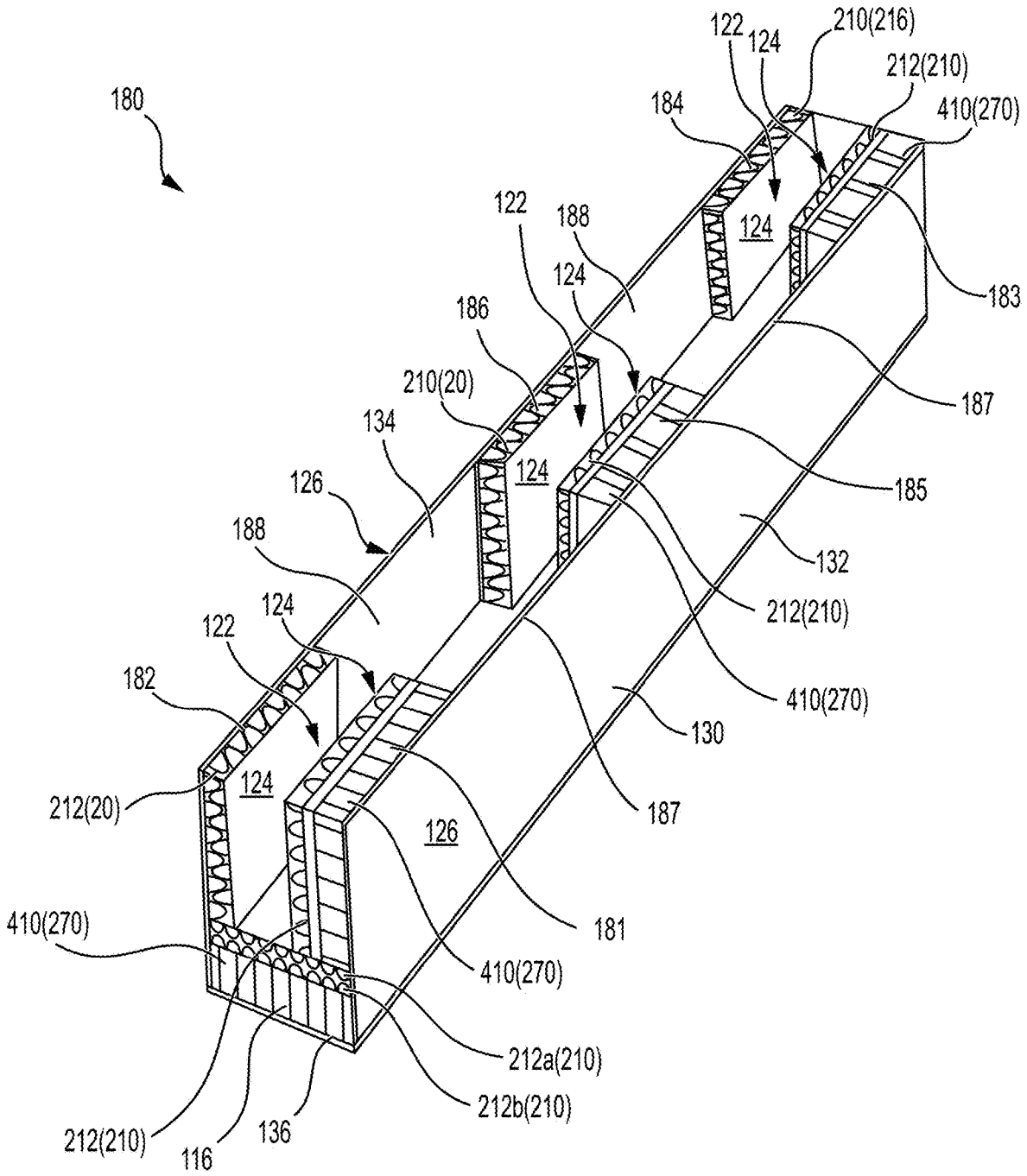
FIG. 24A is a schematic view of a U-shaped packing material.

FIG. 24A shows a U-shaped packing material 180 that can be used as, for example, one of the U-shaped packing materials 104 discussed above with reference to FIG. 1. The U-shaped packing material 180 is formed similarly to the U-shaped packing material 142 discussed above with reference to FIG. 17. The U-shaped packing material 180 includes a third cushioning block 116 positioned as discussed above with reference to FIG. 17. As with the corner-shaped packing material 146 discussed above with reference to FIGS. 22A and 22B, the third cushioning block 116 is a composite cushioning block including a rigid layer 270. The rigid layer 270 of the third cushioning block 116 and the other cushioning blocks shown in FIG. 24 includes one or more honeycomb panel 410, but any of the rigid sheet panels 400 discussed herein can be used. More specifically, the third cushioning block 116 includes the cushioning block 204 discussed above with reference to FIG. 15A, but with a plurality of cushioning layers 210, such as the first cushioning layer 212*a* and the second cushioning layer 212*b* discussed above with reference to FIG. 5B.

The U-shaped packing material 180 also includes a plurality of cushioning blocks positioned on a first side of the U-shaped packing material 180 similarly to the first cushioning block 112 discussed above with reference to FIG. 17. More specifically, the U-shaped packing material 180 includes, on the first side, a first-side first-end cushioning block 181, a first-side second-end cushioning block 183, and a first-side intermediate cushioning block 185. Each of the first-side first-end cushioning block 181, the first-side second-end cushioning block 183, and the first-side intermediate cushioning block 185 shown in FIG. 25 are composite cushioning blocks formed with one or more cushioning layers 210, such as the cushioning layer 212 discussed above with reference to FIG. 5B, and one or more rigid layers 270, such as the honeycomb panel 410. The first-side first-end cushioning block 181, the first-side second-end cushioning block 183, and the first-side intermediate cushioning block 185 are connected to each other by a corrugated fiberboard sheet 130 and, more specifically, a first corrugated fiberboard sheet portion 132 positioned on the first side of the U-shaped packing material 180. Each of the first-side first-end cushioning block 181 and the first-side second-end cushioning block 183 is separated from the first-side intermediate cushioning block 185 by a first-side connection portion 187 of the corrugated fiberboard sheet 130.

Similarly, the U-shaped packing material 180 includes a plurality of cushioning blocks positioned on a second side of the U-shaped packing material 180, similarly to the second cushioning block 114 discussed above with reference to FIG. 17. More specifically, the U-shaped packing material 180 includes, on the first side, a second-side first-end cushioning block 182, a second-side second-end cushioning block 184, and a second-side intermediate cushioning block 186. Each of the second-side first-end cushioning block 182, the second-side second-end cushioning block 184, and the second-side intermediate cushioning block 186 shown in FIG. 25 are formed with one or more cushioning layers 210, such as the cushioning layer 212 discussed above with reference to FIG. 5B. The second-side first-end cushioning block 182, the second-side second-end cushioning block 184, and the second-side intermediate cushioning block 186 are connected to each other by a corrugated fiberboard sheet 130 and, more specifically, a second corrugated fiberboard sheet portion 134 positioned on the second side of the U-shaped packing material 180. Each of the second-side first-end cushioning block 182 and the second-side second-end cushioning block 184 is separated from the second-side intermediate cushioning block 186 by a second-side connection portion 188 of the corrugated fiberboard sheet 130.

The first-side first-end cushioning block 181 is positioned to oppose the second-side first-end cushioning block 182 with the product cavity 122 therebetween. The first-side second-end cushioning block 183 is positioned to oppose the second-side second-end cushioning block 184 with the product cavity 122 therebetween. The first-side intermediate cushioning block 185 is positioned to oppose the second-side intermediate cushioning block 186 with the product cavity 122 therebetween.

While shown with certain configurations of cushioning blocks, the first-side first-end cushioning block 181, the second-side first-end cushioning block 182, the first-side second-end cushioning block 183, the second-side second-end cushioning block 184, the first-side intermediate cushioning block 185, and the second-side intermediate cushioning block 186 can be formed using other cushioning blocks discussed herein. Indeed, the cushioning protection afforded by the first cushioning layer 212*a* and the second cushioning layer 212*b* of the third cushioning block 116 may be sufficient, and in such a case, the sides of the U-shaped packing material 180 can include a rigid layer 270, like the honeycomb panel 410, without a cushioning layer. Similarly, although shown as separate cushioning blocks, the first-side first-end cushioning block 181, the first-side second-end cushioning block 183, and the first-side intermediate cushioning block 185 can be one continuous elongated cushioning block, and similarly, the second-side first-end cushioning block 182, the second-side second-end cushioning block 184, and the second-side intermediate cushioning block 186 can be one continuous elongated cushioning block.

Figure 24B:
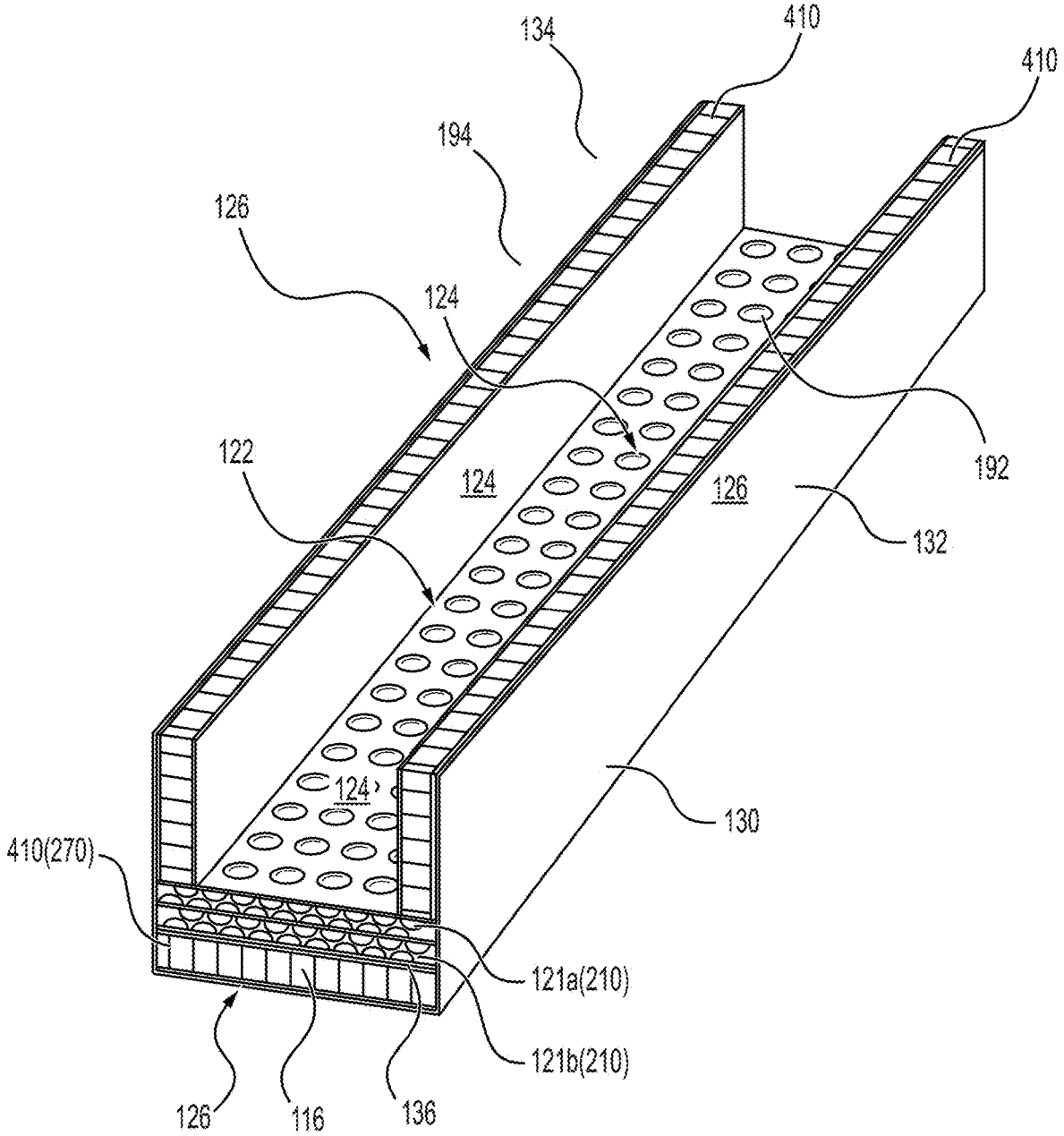
FIG. 24B is a schematic view of a U-shaped packing material.

FIG. 24B shows a U-shaped packing material 190 that can be used as, for example, one of the U-shaped packing materials 104 discussed above with reference to FIG. 1. The U-shaped packing material 190 is formed similarly to the U-shaped packing material 180 discussed above with reference to FIG. 24A. Instead of having a plurality of cushioning blocks on the first side and the second side of the U-shaped packing material 190, the U-shaped packing material 190 has one block on the first side, a first side bock 192, and one block on the second side, a second side bock 194. Each of the first side block 192 and the second side block 194 includes a rigid panel 400 and, more specifically, a rigid panel without a cushioning layer. The rigid panel 400 shown in FIG. 24B is a honeycomb panel 410, but any of the rigid panels discussed herein may be used. Where packing materials with only rigid panels, such as honeycomb panels have been known to fail, the addition of the cushioning layer on the underside (the third cushioning block 116) has been found to provide sufficient cushioning for products 10, such as TVs. Although shown with only a rigid panel 400, the first side block 192 and the second side block 194 can include any of the cushioning blocks, such as the composite cushioning blocks discussed herein.

Figure 25A:
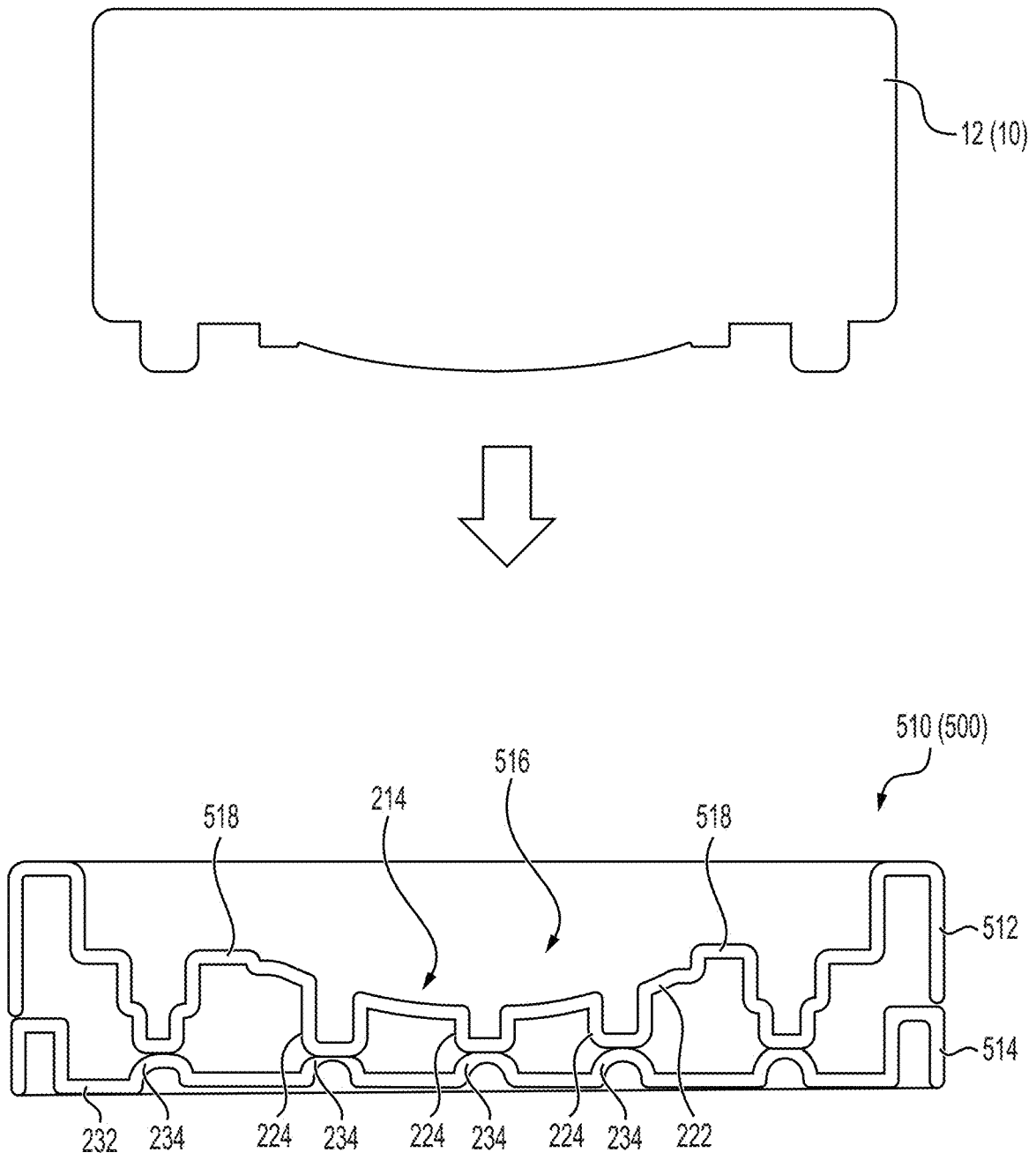
FIG. 25A is a cross-sectional view of an irregular cushioning layer, taken from a perspective similar to FIG. 4B.
Figure 25B:
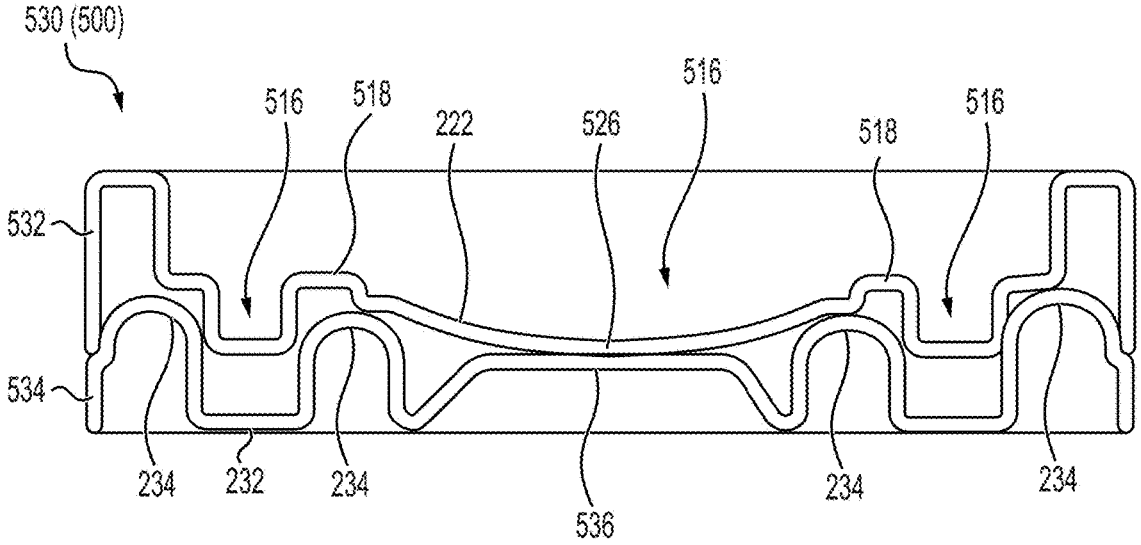
FIG. 25B is a cross-sectional view of an irregular cushioning layer, taken from a perspective similar to FIG. 4B.
Figure 25C:
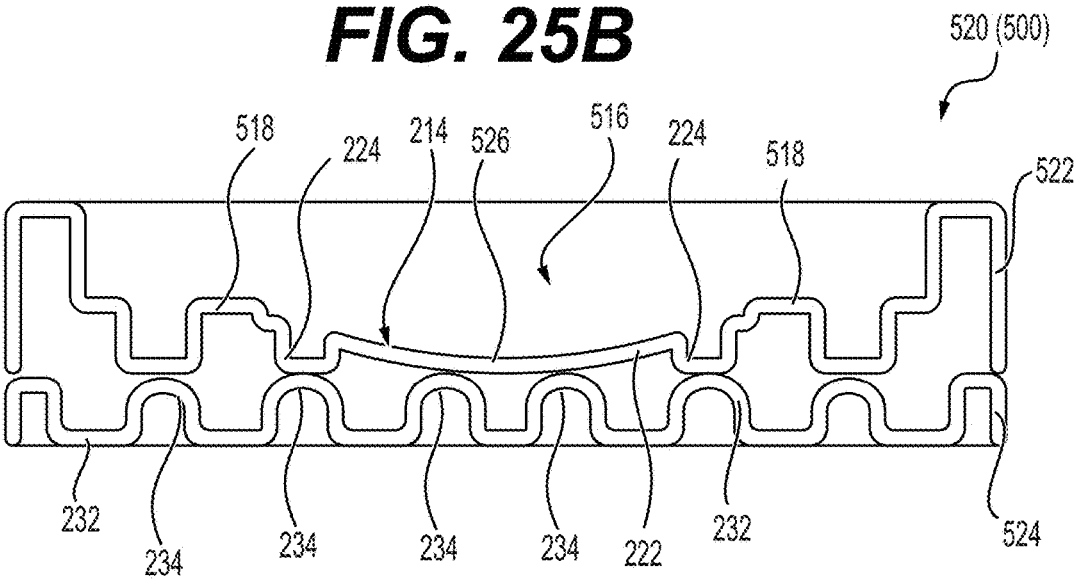
FIG. 25C is a cross-sectional view of an irregular cushioning layer, taken from a perspective similar to FIG. 4B.

FIG. 25A to 25C show other cushioning layers, which are referred to herein as irregular cushioning layers 500, formed from a first cushioning panel 512 and a second cushioning panel 514. The irregular cushioning layers 500 discussed herein can be used as any one of the cushioning layers discussed above, particularly where the cushioning layers abut or otherwise come into contact with the product 10. FIG. 25A shows an irregular cushioning layer 510 that can be used to form a cushioning block. The first cushioning panel 512 and the second cushioning panel 514 are similar to the first cushioning panel 220 (see, e.g., FIG. 2) and the second cushioning panel 230 (see, e.g., FIG. 2). When the cushioning panel, such as the first cushioning panel 512, is a molded cushioning panel, the first cushioning panel 512 can be molded to a variety of shapes. For example, the first cushioning panel 512 and, more specifically, the product side and a product-side surface 124 of a cushioning block formed using the irregular cushioning layer 510 can be shaped to conform to the shape of the product 10, such as an irregularly shaped product 12. Accordingly, the irregular cushioning layer 510 and, more specifically, the first cushioning panel 512 formed therefrom can include product-side recesses 516, product-side protrusions 518, or both formed on the product side of a cushioning block formed using the irregular cushioning layer 510. The product-side recesses 516 and product-side protrusions 518 can thus be formed on the back-side surface 314 of the first cushioning panel 512.

FIG. 25B shows another irregular cushioning layer 520 that is similar to the irregular cushioning layer 510 discussed above with reference to FIG. 25A. The irregular cushioning layer 520 is formed from a first cushioning panel 522 and a second cushioning panel 524, similar to the first cushioning panel 512 and the second cushioning panel 514, respectively. In the first cushioning panel 512 and the second cushioning panel 514 discussed above, the projections 320 (e.g., the first projections 224 and the second projections 234) on the projection side of the first cushioning panel 512 and second cushioning panel 514 can have a repeating or regular pattern arrangement. As depicted in FIG. 25B, however, the first projections 224 can be a non-repeating pattern, such as omitted over a projection free portion 526 of the first cushioning panel 522, such as a portion of the first cushioning panel 522 that includes a product-side recesses 516.

FIG. 25C shows another irregular cushioning layer 530 that is similar to the irregular cushioning layer 520 discussed above with reference to FIG. 25B. The irregular cushioning layer 530 is formed from a first cushioning panel 532 and a second cushioning panel 534, similar to the first cushioning panel 522 and the second cushioning panel 524, respectively. In FIG. 25C, the first projections 224 of the first cushioning panel 532 are omitted and the second projections 234 of the second cushioning panel 534 have a non-repeating pattern, such as an enlarged projection 536 abutting the projection free portion 526.

FIGS. 26A to 30C show various configurations of the cushioning blocks discussed herein forming a shipping container. While the packing materials 100 (FIG. 1) discussed herein may be separate from the shipping box 20 (FIG. 1) and placed inside the shipping box 20, other configurations may be used, such as those discussed below, to form a shipping container.

Figure 26A:
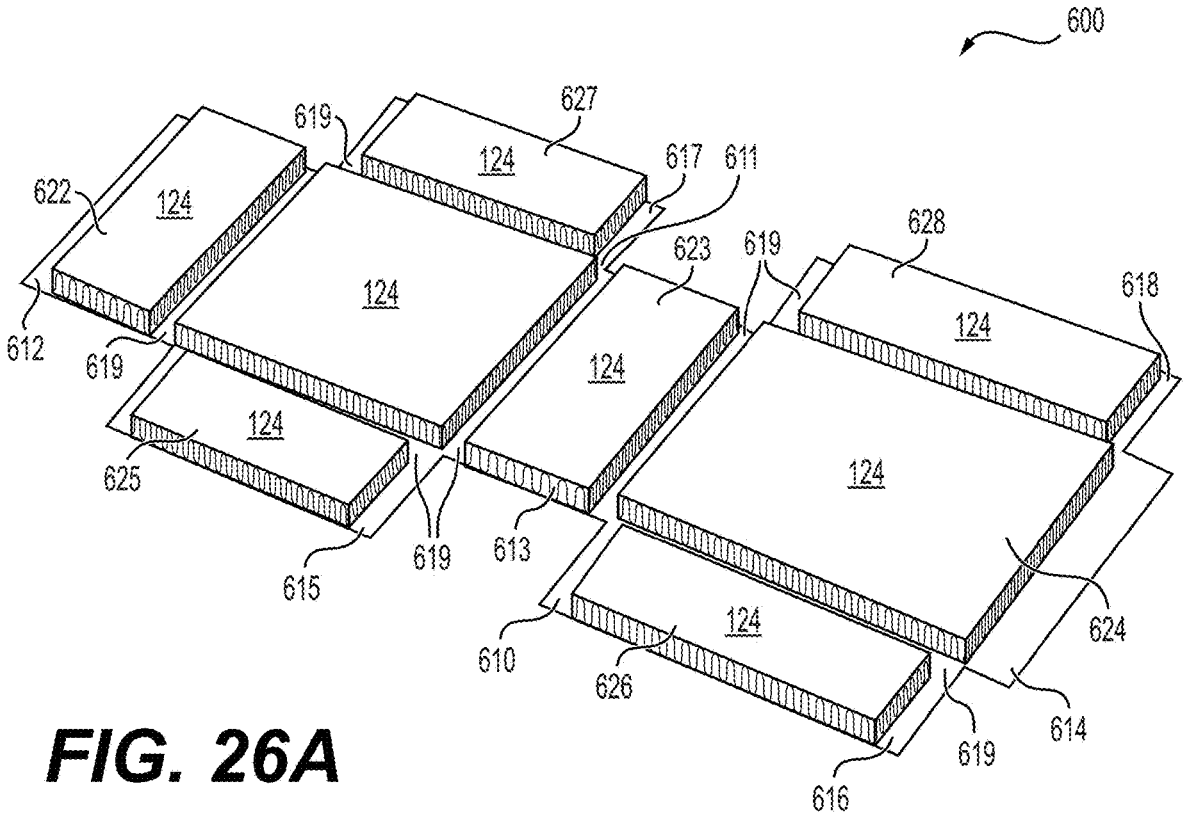
FIG. 26A is a schematic view of a shipping container with cushioning blocks in a flat configuration.
Figure 26B:
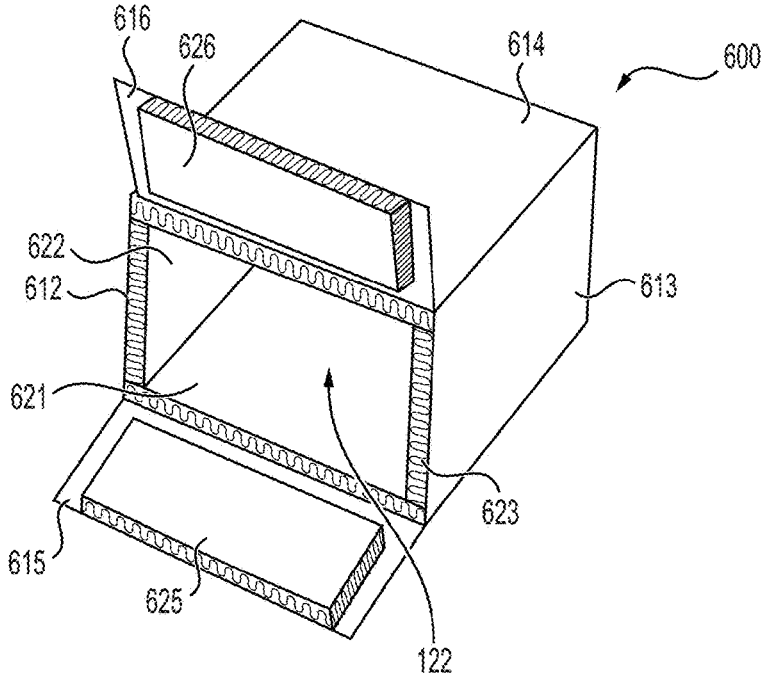
FIG. 26B is a schematic view of the shipping container of FIG. 26A in a folded configuration.

FIGS. 26A and 26B show a shipping container 600 formed using the cushioning blocks 200 (see, e.g., FIG. 2) discussed herein. The shipping container 600 is configurable in a flat configuration and a folded configuration. The flat configuration is shown in FIG. 26A and the folded configuration is shown in FIG. 26B. The shipping container 600 includes a corrugated fiberboard sheet 610, similar to the corrugated fiberboard sheet 130 discussed above. The corrugated fiberboard sheet 610 is sectioned to form a plurality of sections that can be folded from the flat state to the folded state and form a box in the folded state. Various patterns for sectioning the fiberboard sheet 610 can be used. Although the shipping container 600 can have other shapes, the shipping container 600 shown in FIG. 26B is a rectangular shipping container, and the plurality of sections of the fiberboard sheet 610 include a front section 611, a left-side section 612, a right-side section 613, a back section 614, a first top flap 615, a second top flap 616, a first bottom flap 617, and a second bottom flap 618. A cushioning block 200 can be attached to each section of the plurality of sections of the fiberboard sheet 610 in a manner similar to that discussed above with reference to FIGS. 20A and 20B. More specifically, the shipping container 600 can include a front cushioning block 621, a left-side cushioning block 622, a right-side cushioning block 623, a back cushioning block 624, a first top cushioning block 625, a second top cushioning block 626, a first bottom cushioning block 627, and a second bottom cushioning block 628, attached to an inner surface of the front section 611, the left-side section 612, the right-side section 613, the back section 614, the first top flap 615, the second top flap 616, the first bottom flap 617, and the second bottom flap 618, respectively.

Each of the cushioning blocks 621, 622, 623, 624, 625, 626, 627, and 628, can be separated from each other with a gap therebetween. The corrugated fiberboard sheet 610 can thus include connection portions 619 between adjacent cushioning blocks 621, 622, 623, 624, 625, 626, 627, and 628. The connection portions 619 are similar to the connection positions discussed above, such as first connection portion 152. The connection portions 619 allow adjacent cushioning blocks 621, 622, 623, 624, 625, 626, 627, and 628 to be folded relative to each other from the flat configuration shown in FIG. 26A to the folded configuration shown in FIG. 26B, to form the shipping container 600 with a product cavity 122 formed therein for a product to be shipped. The shipping container 600 can be held in the folded configuration using the methods for shipping boxes, such as a strip of adhesive (e.g., tape) or adhesive applied to overlapping portions of the shipping container 600.

Figure 27A:
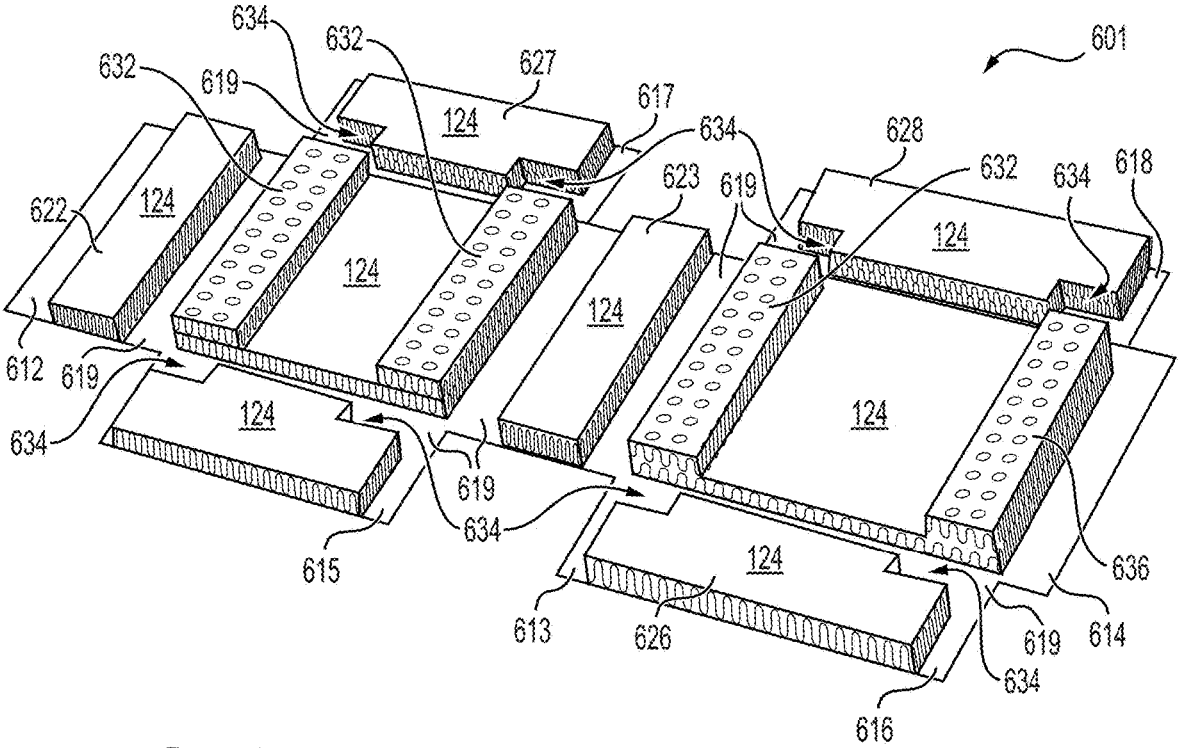
FIG. 27A is a schematic view of a shipping container with cushioning blocks in a flat configuration.
Figure 27B:
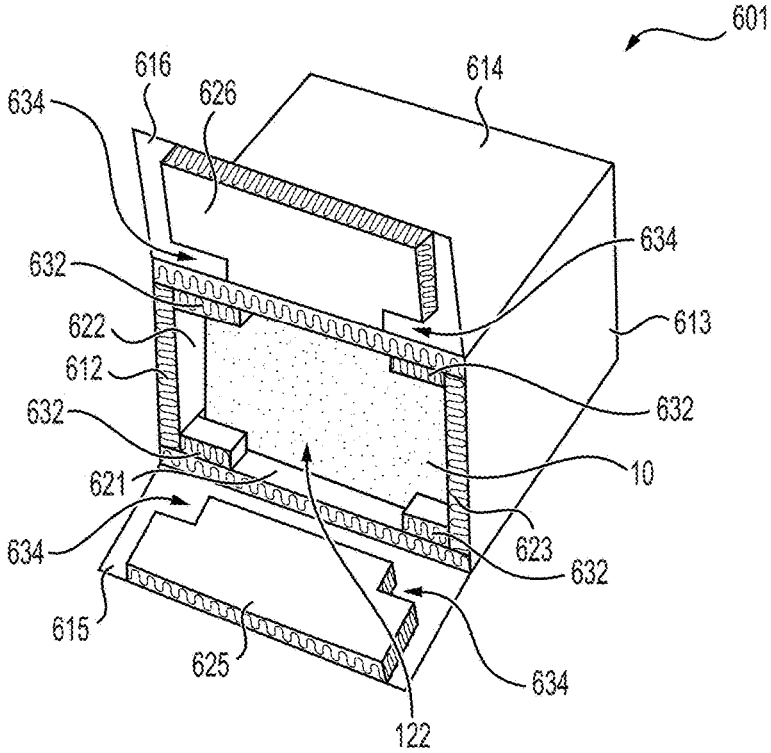
FIG. 27B is a schematic view of the shipping container of FIG. 27A in a folded configuration.

FIGS. 27A and 27B show a shipping container 601 formed using the cushioning blocks 200 (see, e.g., FIG. 2) discussed herein. The shipping container 601 is similar to the shipping container 600 discussed above with reference to FIGS. 26A and 26B. The shipping container 601 is configurable in a flat configuration and a folded configuration. The flat configuration is shown in FIG. 27A and the folded configuration is shown in FIG. 27B. An advantage of using the cushioning blocks 200 discussed herein is that the cushioning blocks 200 can be configurated to conform more directly to the product 10 and, in particular, a product 10 that does not have a rectangular shape. The cushioning blocks 621, 622, 623, 624, 625, 626, 627, and 628 can have positions with additional layers added thereto to better conform to the shape of the product 10 and form a product cavity 122 that has a non-rectangular cross-sectional. As shown in FIGS. 27A and 27B, for example, the front cushioning block 621 and the back cushioning block 624 each include portions with additional layers 632, such as additional cushioning layers, formed thereon. To accommodate additional layers 632, other cushioning blocks 621, 622, 623, 624, 625, 626, 627, and 628, such as the first top cushioning block 625, the second top cushioning block 626, the first bottom cushioning block 627, and the second bottom cushioning block 628, can include cutouts 634 to accommodate additional layers 632.

Figure 28A:
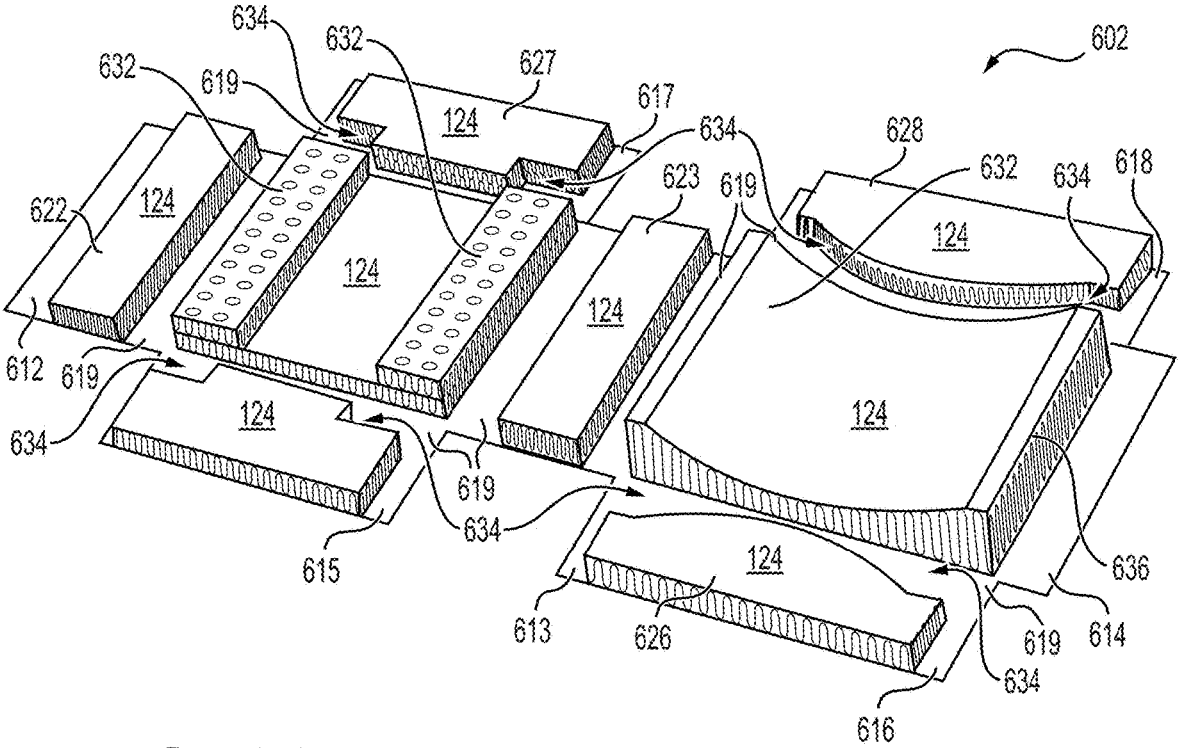
FIG. 28A is a schematic view of a shipping container with cushioning blocks in a flat configuration.
Figure 28B:
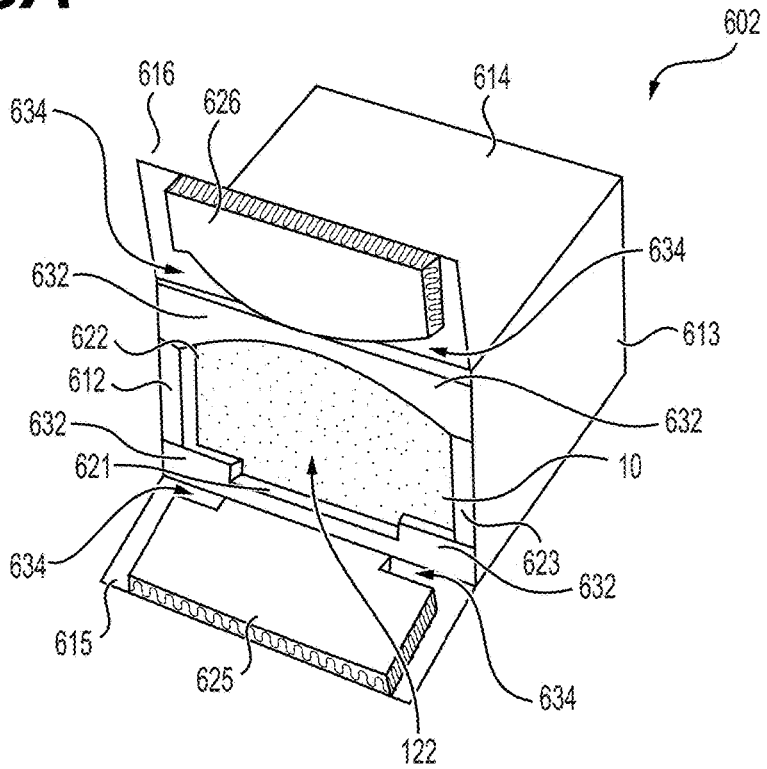
FIG. 28B is a schematic view of the shipping container of FIG. 28A in a folded configuration.

FIGS. 28A and 28B show a shipping container 602 formed using the cushioning blocks 200 (see, e.g., FIG. 2) discussed herein. The shipping container 602 is similar to the shipping container 601 discussed above with reference to FIGS. 27A and 27B. The shipping container 602 is configurable in a flat configuration and a folded configuration. The flat configuration is shown in FIG. 28A, and the folded configuration is shown in FIG. 28B. As noted above, irregular cushioning layers 500 can be advantageously used to form irregular cushioning blocks 636. As shown in FIGS. 28A and 28B, one or more of the cushioning blocks can be an irregular cushioning block 636, such as the back cushioning block 624, for example. Other cushioning blocks, such as the second top cushioning block 626 and the second bottom cushioning block 628, can be shaped to accommodate the irregular cushioning blocks 636 when in the folded configuration.

Figure 29A:
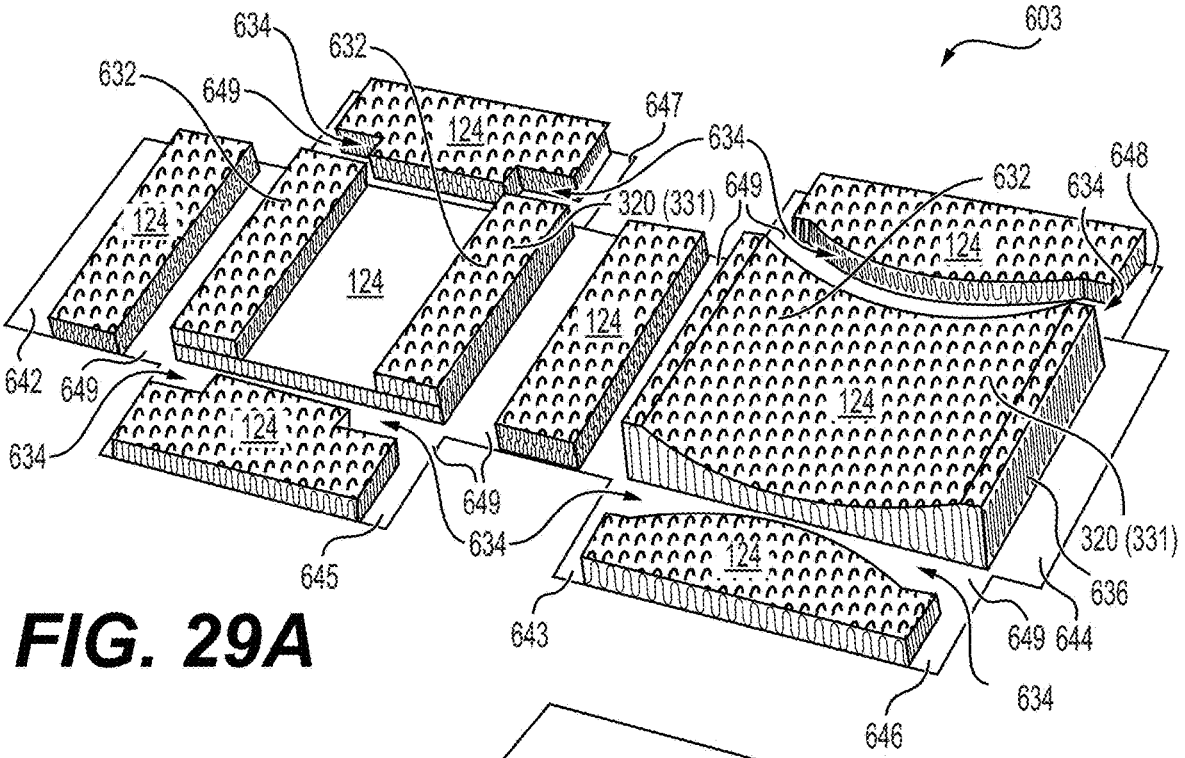
FIG. 29A is a schematic view of a shipping container with cushioning blocks in a flat configuration.
Figure 29B:
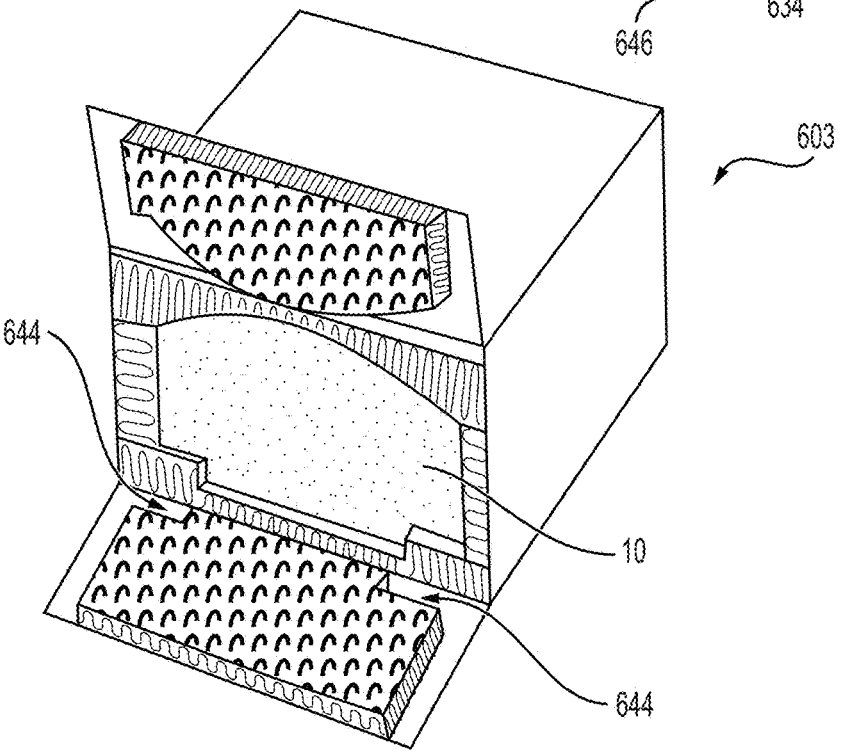
FIG. 29B is a schematic view of the shipping container of FIG. 29A in a folded configuration.

FIGS. 29A and 29B show another shipping container 603. The shipping container 603 is similar to the shipping container 602 shown in FIGS. 28A and 28B and is configurable in a flat configuration and a folded configuration. The flat configuration is shown in FIG. 29A, and the folded configuration is shown in FIG. 29B. Instead of using the corrugated fiberboard sheet 610, the shipping container 603 is formed from a single, foldable molded cushioning panel 640, similar to the cushioning panel 301 discussed above with reference to FIGS. 3A and 3B, and the corner-shaped packing material 160 discussed above with reference to FIGS. 21A and 21B. Although described with reference to cushioning panel 301 (FIGS. 3A and 3B), any of the cushioning panels 300 (e.g., FIGS. 3A to 3G) discussed herein may be used.

The foldable molded cushioning panel 640 includes a front projection section 641, a left-side projection section 642, a right-side projection section 643, a back projection section 644, a first top flap projection section 645, a second top flap projection section 646, a first bottom flap projection section 647, and a second bottom flap projection section 648 arranged in a manner similar to the front section 611, the left-side section 612, the right-side section 613, the back section 614, the first top flap 615, the second top flap 616, the first bottom flap 617, and the second bottom flap 618, discussed above. Each of these projection sections 641, 642, 643, 644, 645, 646, 647, and 648 are sections containing projections 320, such as the cylindrical projections 331.

The foldable molded cushioning panel 640 also includes connection portions 649 similar to the first connection portion 172 discussed above with reference to FIGS. 21A and 21B. The connection portions 649 are positioned between adjacent projection sections 641, 642, 643, 644, 645, 646, 647, and 648 to allow the projection sections 641, 642, 643, 644, 645, 646, 647, and 648 to be folded relative to each other in the manner discussed above, as with the foldable molded cushioning panel 170 in FIGS. 21A and 21B, additional layers discussed herein can be attached to each of the projection sections 641, 642, 643, 644, 645, 646, 647, and 648 to form the various cushioning blocks discussed herein.

Figure 30A:
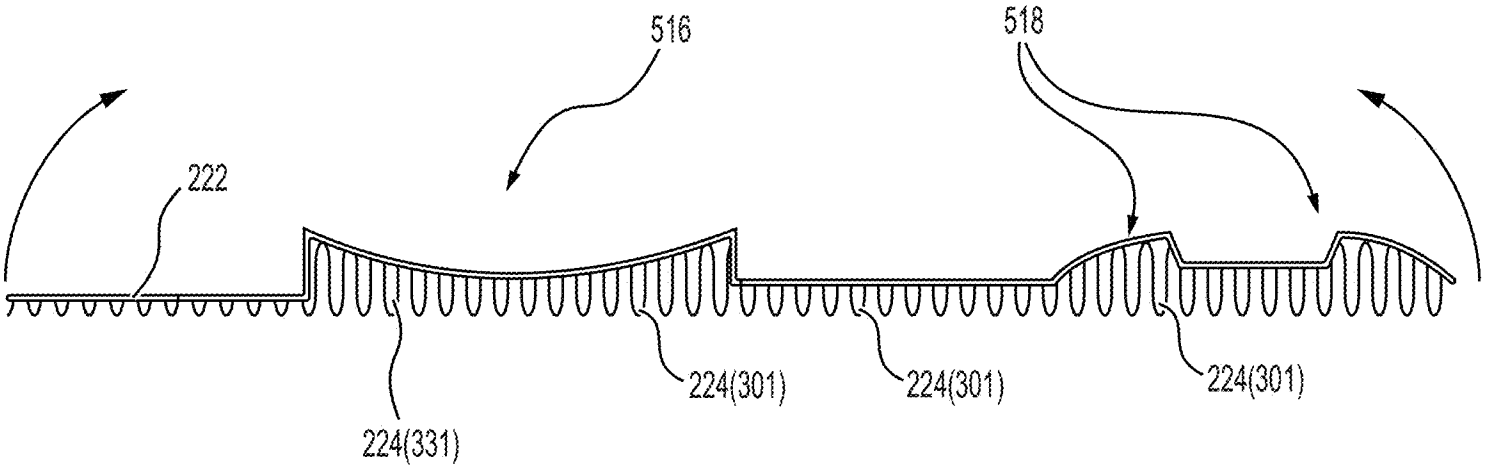
FIG. 30A is a cross-sectional view of a first foldable molded cushioning panel, taken from a perspective similar to FIG. 3B.
Figure 30B:
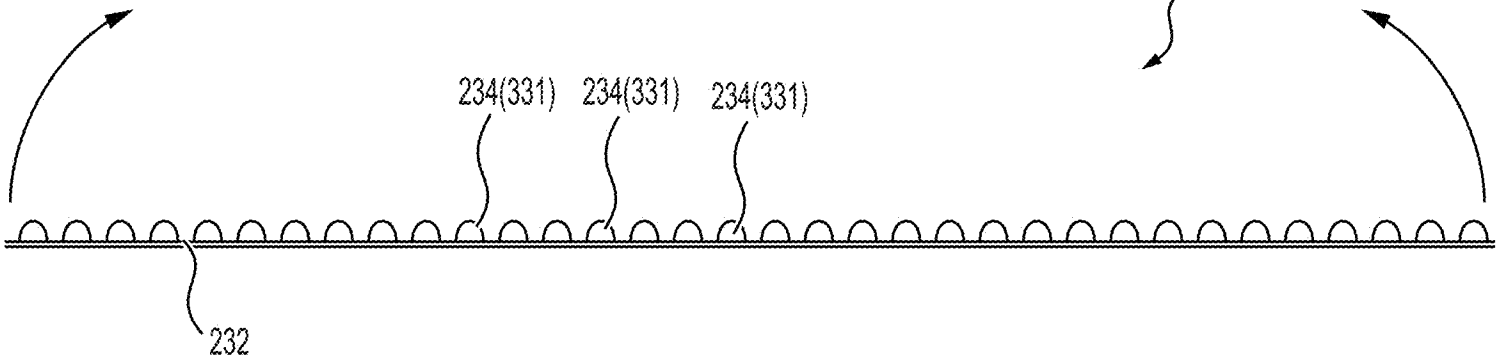
FIG. 30B is a schematic view of a second foldable molded cushioning panel, taken from a perspective similar to FIG. 3B.
Figure 30C:
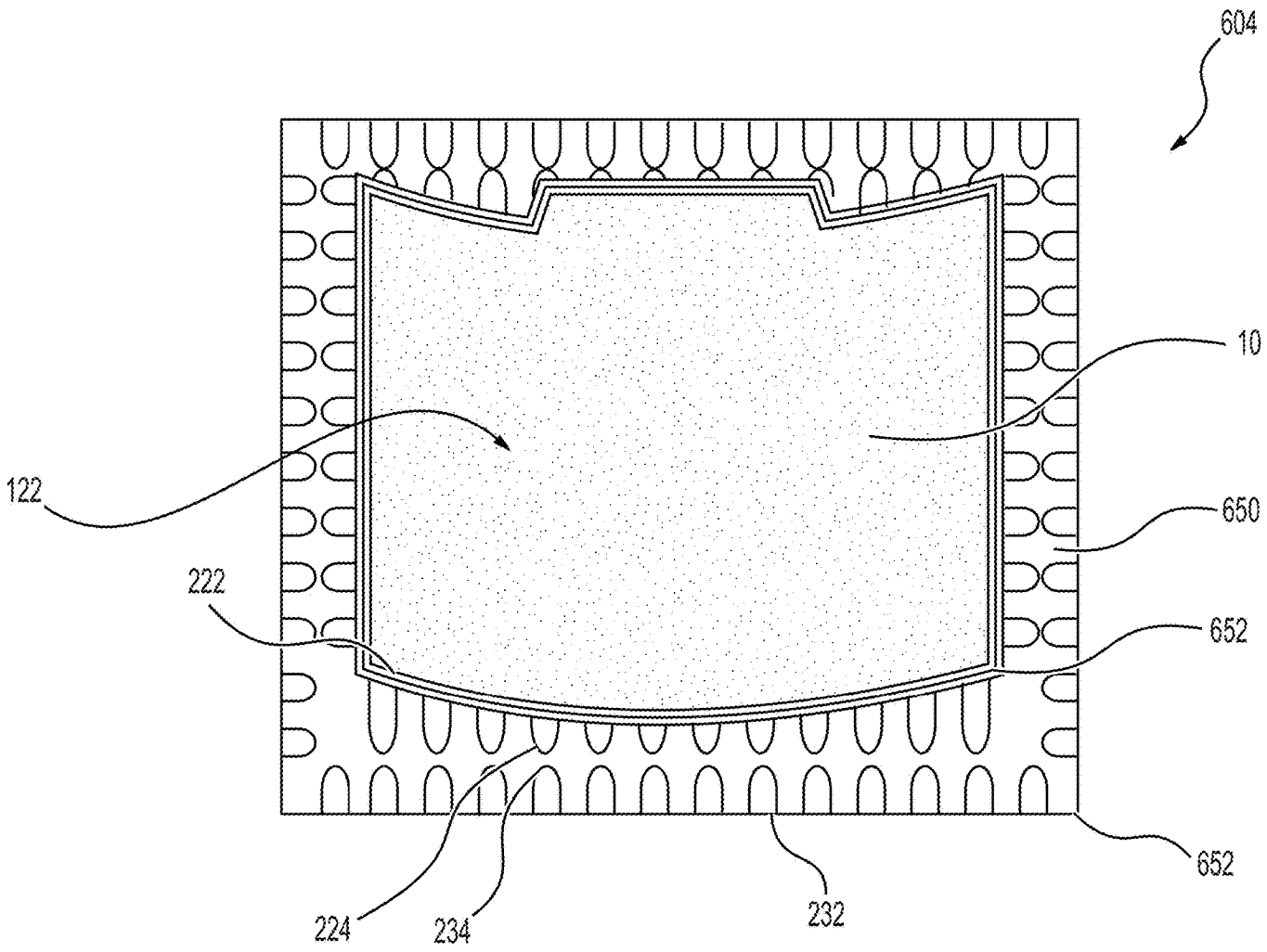
FIG. 30C is a schematic end view of a shipping container formed using the first foldable molded cushioning panel of FIG. 30A and the second foldable molded cushioning panel of FIG. 30B.

FIGS. 30A and 30C show another shipping container 604 (FIG. 30C). The shipping container 604 shown in FIGS. 30A and 30C is similar to the shipping container 603 discussed above with reference to FIGS. 29A and 29B. Instead of being formed from one foldable molded cushioning panel, the shipping container 603 shown in FIGS. 30A to 30C is formed from a plurality of foldable molded cushioning panels. FIG. 30A shows a first foldable molded cushioning panel 652, and FIG. 30B shows a second foldable molded cushioning panel 654. Each of the first foldable molded cushioning panel 652 and the second foldable molded cushioning panel 654 can be any of the cushioning panels 300 (e.g., FIGS. 3A to 3G) discussed herein, such as the cushioning panel 301 with cylindrical projections 331, for example. The first foldable molded cushioning panel 652 can be positioned relative to the second foldable molded cushioning panel 654 to form a cushioning layer 650 (FIG. 30C), similarly to the first cushioning panel 220 (FIG. 2) and the second cushioning panel 230 (FIG. 2) in the manner discussed above. The first foldable molded cushioning panel 652 is an inner cushioning panel that can be positioned adjacent to the product 10 (FIG. 30C) and can be an irregular cushioning sheet, similar to the first cushioning panel 512 (FIG. 16A) discussed above. The first foldable molded cushioning panel 652 is shown in a flat configuration in FIG. 30A, and the second foldable molded cushioning panel 654 is shown in a flat configuration in FIG. 30B.

FIG. 30C shows the first foldable molded cushioning panel 652 and the second foldable molded cushioning panel 654 in a folded configuration to form the shipping container 604. The first foldable molded cushioning panel 652 can be folded to form the product cavity 122. The cushioning layer 650, including each of the first foldable molded cushioning panel 652 and the second foldable molded cushioning panel 654, can be folded to surround the product 10. The first foldable molded cushioning panel 652 and the second foldable molded cushioning panel 654 can each be folded independently to form the cushioning layer 650. For example, the first foldable molded cushioning panel 652 can be folded and then the second foldable molded cushioning panel 654 can be folded around the first foldable molded cushioning panel 652 to form the cushioning layer 650 and the shipping container 604. Alternatively, the first foldable molded cushioning panel 652 and second foldable molded cushioning panel 654 can be placed together in the flat configuration and then folded together. The first foldable molded cushioning panel 652, whether alone or connected to the second foldable molded cushioning panel 654, can also be folded around the product 10.

Figure 31:
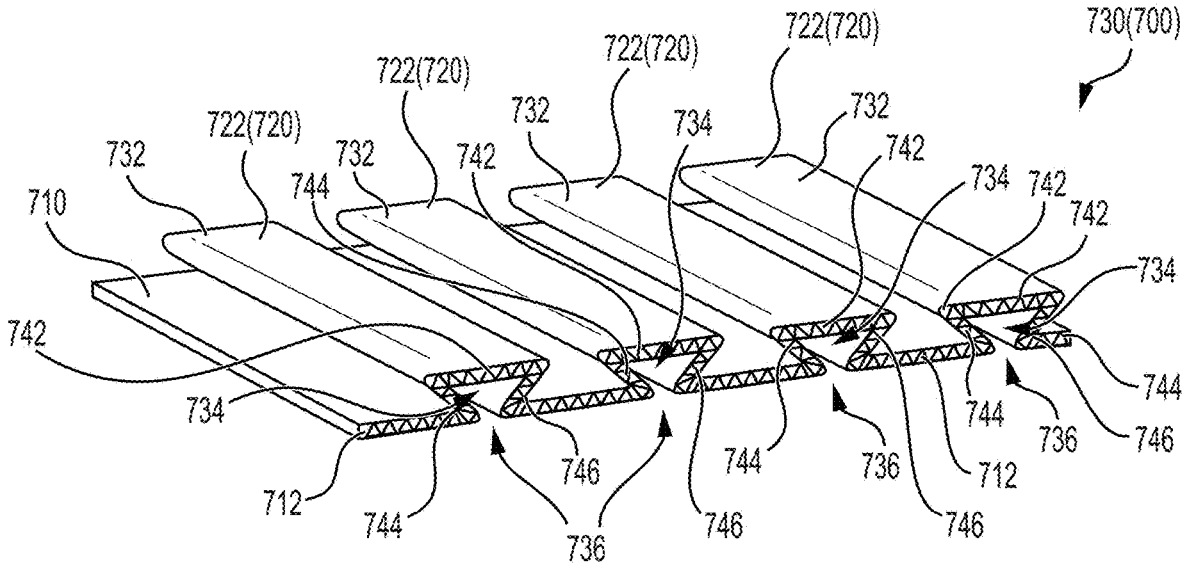
FIG. 31 is a schematic view of cushioning panel.

FIG. 31 shows an alternative cushioning panel 700. The cushioning layers 210 (FIG. 2) used in the cushioning blocks 200 (FIG. 2) discussed above are formed using the molded paper pulp panel as the cushioning panel, but other cushioning panels may be used to form the cushioning blocks. This cushioning panel 700 is formed from a sheet that includes projections 720 that are allowed to deform when a load is exerted thereon. More specifically in FIG. 31, the cushioning panel 700 includes a plurality of flutes 722 formed in the sheet that also includes a base layer 712. The base layer 712 is similar to the base layers 310 (FIG. 3B) discussed above. The flutes 722 form the projections 720 of the cushioning panel 700. These flutes 722 are spaced apart from each other, and this spaced apart configuration allows the flutes 722 to deform relative to the base layer 712, providing cushioning. The cushioning panel 700 can be formed from various cellulosic sheets discussed above. The corrugated fiberboard sheet 710 can be folded, or otherwise formed, into the flutes 722. The flutes 722 are elongated and extend parallel to each other. The flutes 722 can have various shapes, as will be discussed further below.

The cushioning panel 700 shown in FIG. 31 includes flutes 722 that are triangularly shaped, which are referred to herein as triangular flutes 732. For clarity, with other cushioning panels discussed herein, these cushioning panels are referred to as triangularly fluted cushioning panels 730. The triangular flutes 732 include a plurality of cell walls that define a triangularly shaped cell, which is referred to as a triangular cell 734. The plurality of cell walls includes a distal wall 742, forming the base of the triangle, and is similar to the distal ends 322 (see, FIG. 3B) discussed above. The first transverse wall 744 is distal from the base layer 712. The plurality of cell walls also includes a first transverse wall 744 and a second transverse wall 746. The first transverse wall 744 and the second transverse wall 746 can be a portion of the corrugated fiberboard sheet 710 that extends transversely from the base layer 712 or a surface thereof. The corrugated fiberboard sheet 710 can be a continuous sheet, and each of the first transverse wall 744 and the second transverse wall 746 connects one of the base layer 712 with the distal wall 742, forming a side of one of the triangular cells 734. The ends of the first transverse wall 744 and the second transverse wall 746 are closer to each other on the base layer 712 side than the ends on the distal wall 742, forming an apex 736 of the triangular cell 734. The first transverse wall 744 and the second transverse wall 746 can abut each other at the second transverse wall 746, but, as shown in FIG. 31, for example, the ends of each of the first transverse wall 744 and the second transverse wall 746 can be spaced apart from each other to form a gap in the base layer 712. The sizing and spacing of the flutes 722, such as the triangular flutes 732, including the gap at the apex 736 can be varied to provide different cushioning properties.

Figure 32:
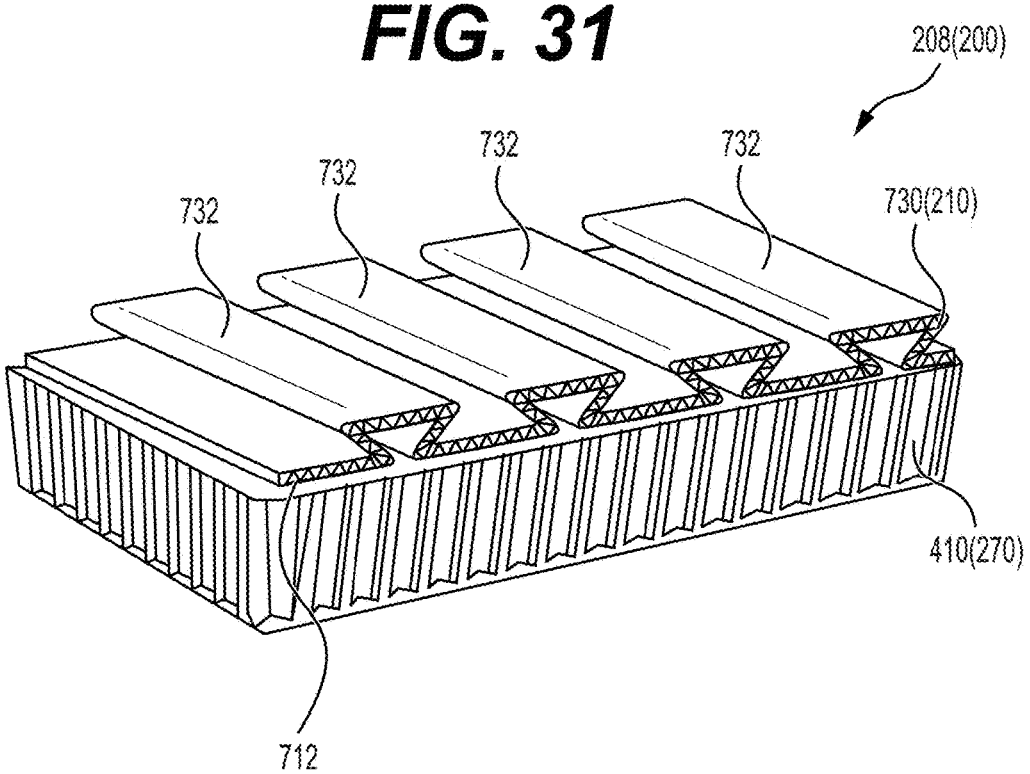
FIG. 32 is a schematic view of cushioning block using the cushioning panel of FIG. 31.

FIG. 32 shows the triangularly fluted cushioning panel 730 used as a cushioning layer 210 of a cushioning block 208. The triangularly fluted cushioning panel 730 can be used in a manner similar to any one of the cushioning panels discussed above. As shown in FIG. 32, for example, the triangularly fluted cushioning panel 730 is used to form a composite cushioning block with a rigid layer 270 formed of a honeycomb panel 410.

Figure 33:
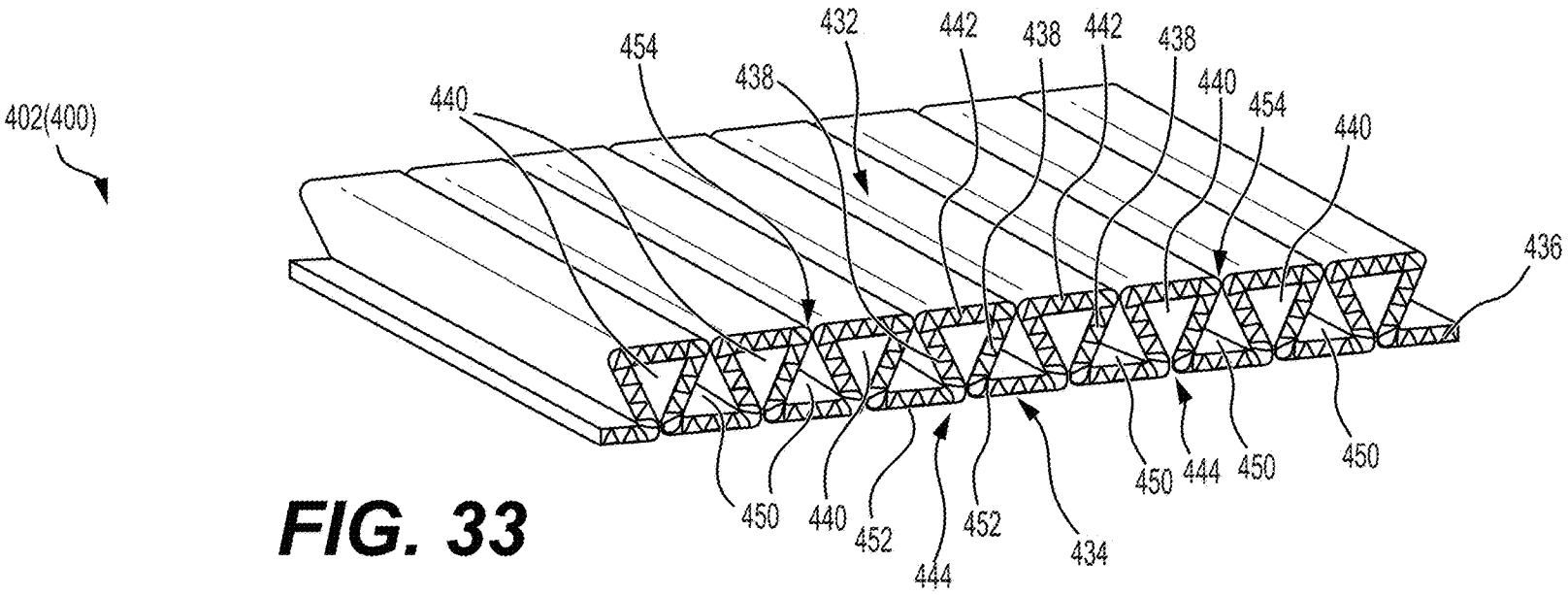
FIG. 33 is a schematic view of rigid sheet panel and, more specifically, a shaped corrugated fiberboard rigid sheet panel.

FIG. 33 shows rigid sheet panel 400 and, more specifically, a shaped corrugated fiberboard rigid sheet panel 402. The shaped corrugated fiberboard rigid sheet panel 402, shown in FIG. 33, includes a first surface and a second surface. For ease of reference herein, the first surface will be referred to as a top surface 432 and the second surface will be referred to as a bottom surface 434, but depending upon use, the surfaces may have different orientations, such as outer surfaces and inner surfaces. The shaped corrugated fiberboard rigid sheet panel 402 can be formed from a corrugated fiberboard sheet 436 that is folded or otherwise shaped to form a plurality of triangularly shaped cells and, more specifically, a plurality of first triangular cells 440 and a plurality of second triangular cells 450. The first triangular cells 440 and second triangular cells 450 are arranged in an alternating pattern with each of the first triangular cells 440 adjacent to and, more specifically, between two of the second triangular cells 450 and, similarly, with the exception of an end cell, each of the second triangular cells 450 is adjacent to and, more specifically, between two of the first triangular cells 440. The end cells, however, are adjacent to only one cell. If one of the first triangular cells 440 is on the end (an end cell), the end cell of the first triangular cells 440 is adjacent to one of the second triangular cells 450 and, similarly, if one of the second triangular cells 450 is on the end (an end cell), the end cell of the second triangular cells 450 is adjacent to one of the first triangular cells 440. Each of the plurality of triangular cells (i.e., the first triangular cells 440 and the second triangular cells 450) have a longitudinal axis, which, in the depicted embodiment, extends in a direction parallel to the top surface 432, the bottom surface 434, or both.

Each of the first triangular cells 440 includes a base portion, which is referred to herein as a first base portion 442. The first base portion 442 is a portion of the corrugated fiberboard sheet 436, and collectively, the plurality of first base portions 442 forms a top wall. The top surface 432 is an outer surface of the top wall. Similarly, each of the second triangular cells 450 includes a base portion, which is referred to herein as a second base portion 452. The second base portion 452 is a portion of the corrugated fiberboard sheet 436, and collectively, the plurality of second base portions 452 forms a bottom wall. The bottom surface 434 is an outer surface of the bottom wall. The first triangular cells 440 and the second triangular cells 450 are thus arranged in an interlocking pattern.

The shaped corrugated fiberboard rigid sheet panel 402 also includes a plurality of transverse walls 438. A transverse wall 438 can be a portion of the corrugated fiberboard sheet 436 that extends transversely to the top surface 432 and the bottom surface 434. The shaped corrugated fiberboard rigid sheet panel 402 can be formed from a continuous sheet (i.e., the corrugated fiberboard sheet 436), and each transverse wall 438 connects one of the first base portions 442 with one of the second base portions 452, forming a side of one of the triangularly shaped cells. The transverse wall 438 separates one first triangular cell 440 from an adjacent second triangular cell 450. Two transverse walls 438 are brought together opposite a base portion to form the apex of the triangular cell. More specifically, two transverse walls 438 may be brought together opposite the first base portion 442 to form a first apex 444 of one of the first triangular cells 440, and two transverse walls 438 may be brought together opposite the second base portion 452 to form a second apex 454 of one of the second triangular cells 450. The transverse walls 438 attach to the ends of the first base portion 442 and the second base portion 452. In the depicted embodiment, each end of the first base portion 442 abuts an end of an adjacent first base portion 442 at the second apex 454, and each end of the second base portion 452 abuts an end of an adjacent second base portion 452 at the first apex 444. In some embodiments, an adhesive may be at each of the first apexes 444 and each of the second apexes 454.

The transverse walls 438 of the depicted embodiment have the same length and thus the first triangular cells 440 and the second triangular cells 450 may be isosceles triangles or equilateral triangles. In some embodiments, the first base portion 442 and/or the second base portion 452 is the same length as each of the transverse walls 438, but in other embodiments, the first base portion 442 and/or the second base portion 452 has a length that is greater or less than each of the transverse walls 438. The first triangular cells 440 and the second triangular cells 450 are each acute isosceles triangles in FIG. 1, but other shapes may be used, such as obtuse triangles. The numbers, size, and density of the cells may be varied according to the overall crush, burst, and flexibility desired. The angles of the vertices and length of the first base portion 442, the second base portion 452, and the transverse walls 438 of the triangular cells may be varied to adjust the properties of the shaped corrugated fiberboard rigid sheet panel 402.

Figure 34:
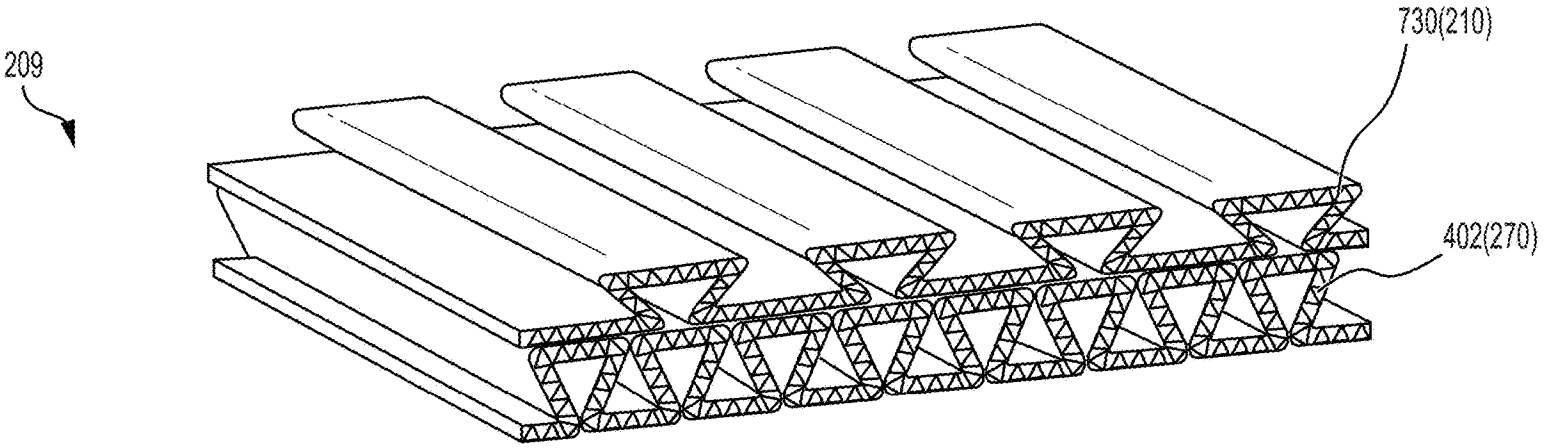
FIG. 34 is a schematic view of cushioning block using the shaped corrugated fiberboard rigid sheet panel of FIG. 33.

FIG. 34 shows the shaped corrugated fiberboard rigid sheet panel 402 used as the rigid layer 270 of a cushioning block 209. The shaped corrugated fiberboard rigid sheet panel 402 can be used in a manner similar to any one of the rigid sheet panels discussed above. As shown in FIG. 34, for example, the shaped corrugated fiberboard rigid sheet panel 402 is used to form a composite cushioning block with the triangularly fluted cushioning panel 730.

Figure 35:
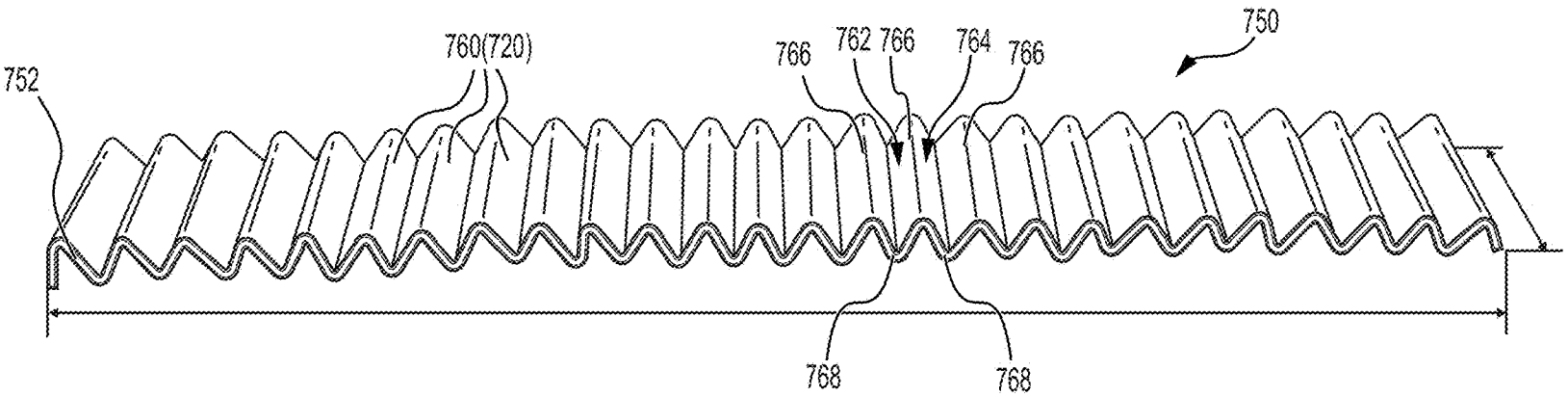
FIG. 35 is a schematic view of cushioning panel.

FIG. 35 shows another alternative cushioning panel 700. As noted above, the flutes 722 can have various shapes, and the cushioning panel 700 shown in FIG. 35 has projections 720 that are V-shaped or waved shaped. For clarity with other cushioning panels discussed herein, this cushioning panel is referred to as a V-shaped cushioning panel 750. The V-shaped cushioning panel 750 can be formed from a cellulosic sheet discussed herein, such as a corrugated fiberboard sheet 752. The V-shaped cushioning panel 750 includes a plurality of macro flutes 760 that are arranged parallel to each other. These macro flutes 760 will be referred to as macro flutes 760 to distinguish these flutes from the interior flutes of the corrugated fiberboard sheet 752 forming the V-shaped cushioning panel 750. The macro flutes 760 of the V-shaped cushioning panel 750 are parallel to the interior flutes.

The macro flutes 760 can have a generally triangular shape (or V-shape) with a first planar surface 762 connected to a second planar surface 764 at a peak 766. Adjacent macro flutes 760 are connected to each other at a valley 768, providing a structure of a plurality of alternating ridges (the peaks 766) and grooves (the valleys 768). The macro flutes 760 are shown as having the same height and spacing, but they are not so limited and may have different heights and spacings.

Figure 36:
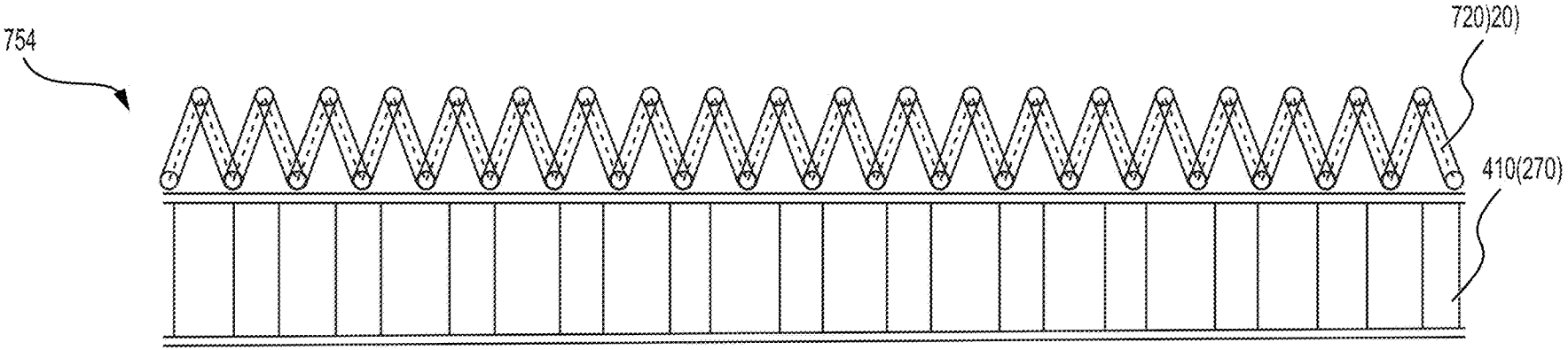
FIG. 36 is a schematic view of cushioning block using the cushioning panel of FIG. 35.

FIG. 36 shows the V-shaped cushioning panel 750 used as a cushioning layer 210 of a cushioning block 754. The V-shaped cushioning panel 750 can be used in a manner similar to any one of the cushioning panels discussed above. As shown in FIG. 36, for example, the V-shaped cushioning panel 750 is used to form a composite cushioning block with a rigid layer 270 formed of a honeycomb panel 410.

Figure 37A:
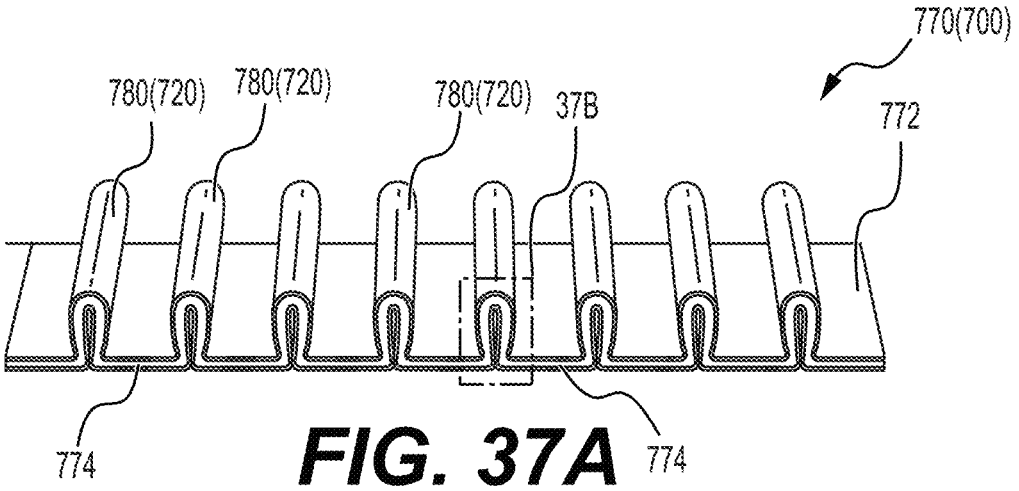
FIG. 37A is a schematic view of cushioning panel.
Figure 37B:
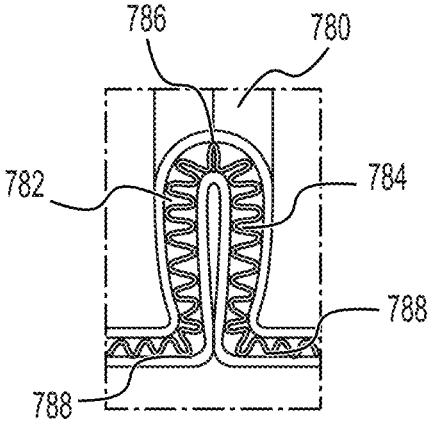
FIG. 37B is a detail view of a portion of the cushioning panel of FIG. 37A, showing detail 37B in FIG. 37A.

FIGS. 37A and 37B show another alternative cushioning panel 700. For clarity with other cushioning panels discussed herein, this cushioning panel is referred to as a finned cushioning panel 770. FIG. 11A is a perspective view of the finned cushioning panel 770, and FIG. 37B is a detail view, showing detail 37B in FIG. 37A of the finned cushioning panel 770. The projections 720 of the finned cushioning panel 770 are fins 780 that are arranged parallel to each other. The finned cushioning panel 770 can be formed from a cellulosic sheet discussed herein, such as a corrugated fiberboard sheet 772. The fins 780 of the finned cushioning panel 770 can be parallel to the interior flutes of the corrugated fiberboard sheet 772 used to form the finned cushioning panel 770. The fins 780 can be separated from each other by a base section 774 of the finned cushioning panel 770. The base section 774 is generally planar. The base section 774 can be similar to the base layers discussed above. Each of the fins 780 is connected to a base section 774, and the fins 780 project from the base section 774.

As shown in FIG. 37B, the fins 780 of this embodiment have a U-shape or a horseshoe shape, and each fin 780 includes a first projecting portion 782 connected to a second projecting portion 784 at a peak 786. The peak 786 is similar to the distal ends of the projections discussed above. The end of each of the first projecting portion 782 and the second projecting portion 784 that is connected to the base section 774 is a base end portion 788. The base end portion 788 is the end of the first projecting portion 782 or the second projecting portion 784 opposite the peak 786. The first projecting portion 782 and the second projecting portion 784 can be continuously connected to each other at the peak 786 and can be a continuation of the same corrugated material at the peak 786 without being cut or separated.

Other portions of the first projecting portion 782 and the second projecting portion 784 (beyond the peak 786) may also be connected to each other. For example, an adhesive may be applied between an interior surface of the first projecting portion 782, an interior surface of the second projecting portion 784, or both. Although the adhesive may be applied to the full length of the interior surface of the first projecting portion 782 and/or the interior surface of the second projecting portion 784, the adhesive can be applied between the base end portion 788 of the interior surface of the first projecting portion 782 and/or the base end portion 788 the interior surface of the second projecting portion 784. In this way, the first projecting portion 782 and the second projecting portion 784 are also connected to each other at the base end portion 788. Connecting the first projecting portion 782 and the second projecting portion 784 at the base end portion 788 helps prevent the fin 780 from spreading out when a force is applied to the peak 786, for example, and thus provides rigidity to the fin 780 and a protective (cushioning) effect of the finned cushioning panel 770 overall. Among other things, the spacing between the fin 780 (e.g., the length of the base section 774) can be varied to adjust the cushioning properties of the finned cushioning panel 770.

Figure 38:
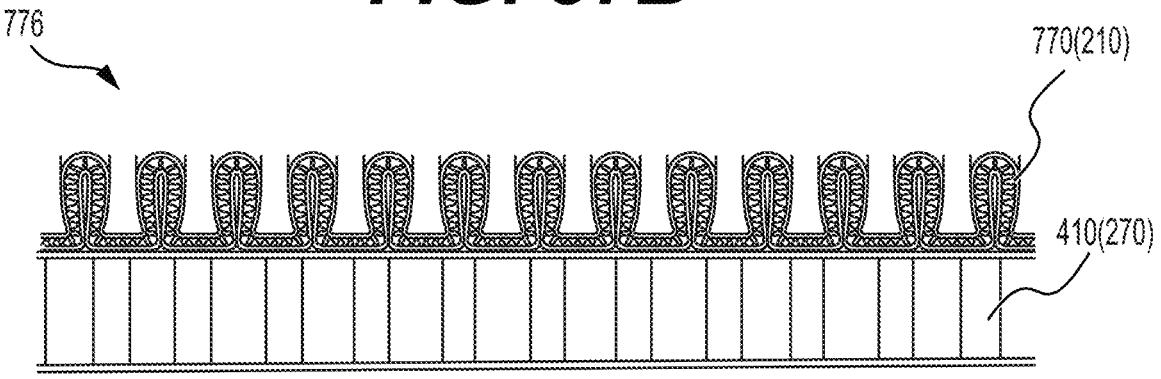
FIG. 38 is a schematic cross-sectional view of cushioning block using the cushioning panel of FIG. 37A.

FIG. 38 shows the finned cushioning panel 770 used as a cushioning layer 210 of a cushioning block 776. The finned cushioning panel 770 can be used in a manner similar to any one of the cushioning panels discussed above. As shown in FIG. 36, for example, the finned cushioning panel 770 is used to form a composite cushioning block with a rigid layer 270 formed of a honeycomb panel 410.

Figure 39B:
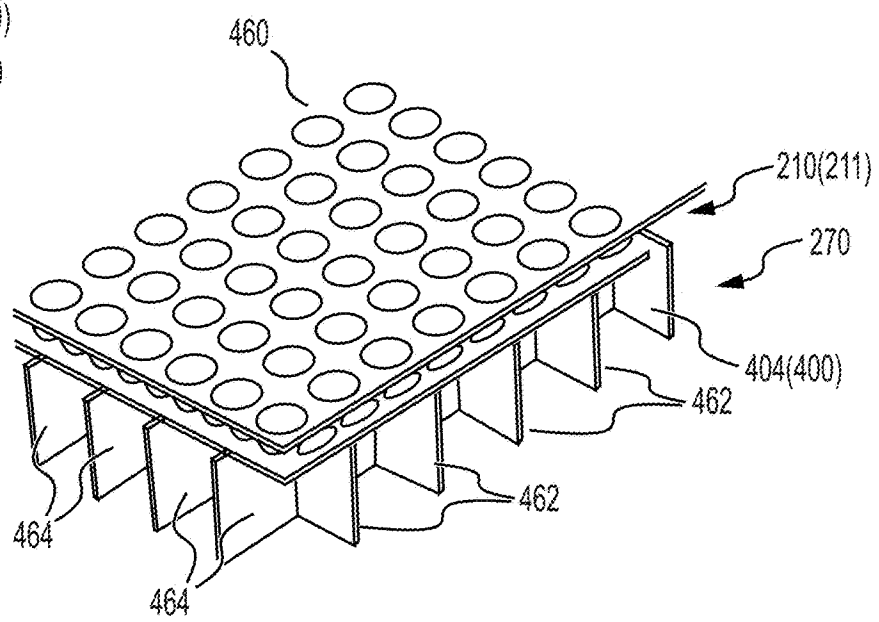
FIG. 39B is schematic view of the cushioning block shown in FIG. 35A.
Figure 39A:
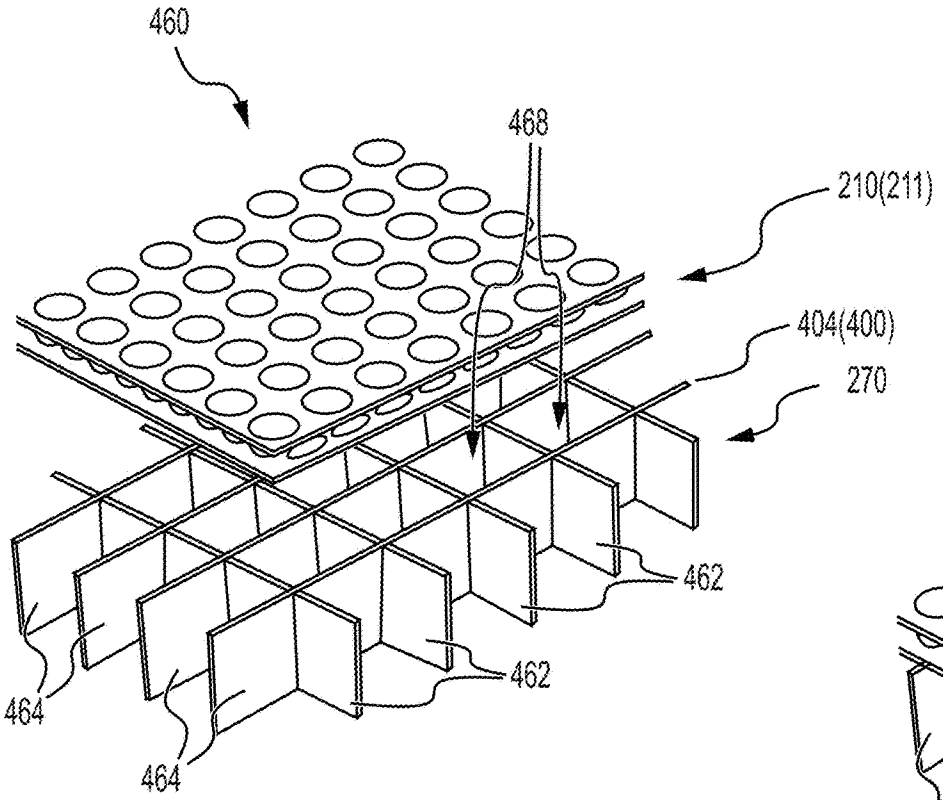
FIG. 39A is an exploded view of cushioning block having a rigid layer and, more specifically, a lattice-structured rigid sheet panel.

FIGS. 39A and 39B show a cushioning block 460 having a cushioning layer 210, such as the cushioning layer 211 discussed above, and a rigid layer 270. FIG. 39A is an exploded view of the cushioning block 460, and FIG. 39B is a perspective view of the cushioning block 460. Although shown with the cushioning layer 211 discussed above with reference to FIGS. 4A and 4B, any of the cushioning layers discussed herein can be used. The rigid layer 270 includes one or more rigid sheet panels 400. The rigid sheet panel 400 shown in FIGS. 39A and 39B is referred to herein as a lattice-structured rigid sheet panel 404. The lattice-structured rigid sheet panel 404 can be used in any of the cushioning blocks discussed herein.

The lattice-structured rigid sheet panel 404 includes a plurality of strips including first strips 462 and second strips 464 positioned transversely to each other to form a lattice structure 466 with a plurality of cells 468. The first strips 462 and the second strips 464 have a width that is oriented in the thickness direction of the cushioning block 460. The first strips 462 and the second strips 464 can be positioned such that the cells 468 are oriented in the thickness direction of the cushioning block 460. The first strips 462 and the second strips 464 can be positioned orthogonal to the outer side 238 of the second cushioning panel 230. The cells 468 are shown as rectangular cells with the first strips 462 being positioned orthogonally relative to the second strips 464, but other angles can be used.

The lattice structure 466 can be formed in different ways. The lattice structure 466 can be formed as a molded pulp structure with the first strips 462 and the second strips 464 being integrally formed with each other. Alternatively, the first strips 462 and the second strips 464 can be formed as separate strips and then interlocked with each other. For example, the first strips 462, the second strips 464, or both, can have slits formed therein to interlock with the other strip. The first strips 462 and the second strips 464 can be corrugated fiberboard strips that are interlocked with each other. When the first strips 462 and the second strips 464 are corrugated fiberboard strips, the flutes of the corrugated fiberboard can be oriented in the thickness direction of the cushioning block 460.

As noted above, adhesive can be used in various contexts. Any suitable adhesive may be used, but throughout the embodiments discussed herein, the adhesive is preferably a biodegradable adhesive.

Throughout the embodiments discussed herein, various features are described as being similar to one another. Accordingly, the discussion of one feature also applies to the features that are similar to that feature. In some cases, the same reference numerals are used to describe the same or similar features throughout. Additionally, various layers are described separately above, but as noted, these layers can be combined in various combinations, including those not explicitly illustrated, to form packing materials and, more specifically, various different cushioning blocks.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A packing material comprising:

one or more cushioning layers, each cushioning layer including:

a first molded pulp cushioning panel comprising a plurality of cellulosic fibers molded into a panel having a first base layer and a plurality of first projections extending therefrom, each of the first projections having a distal end that is distal from the first base layer; and a second molded pulp cushioning panel comprising a plurality of cellulosic fibers molded into a panel having a second base layer and a plurality of second projections extending therefrom, each of the second projections having a distal end that is distal from the second base layer, wherein the first molded pulp cushioning panel is positioned with the plurality of first projections projecting toward the second molded pulp cushioning panel, and wherein the second molded pulp cushioning panel is positioned with the plurality of second projections projecting toward the first molded pulp cushioning panel, and at least a portion of the second projections of the plurality of second projections being second contacting projections, the distal ends of the second contacting projections contacting the first molded pulp cushioning panel.

2. The packing material of claim 1, wherein the first molded pulp cushioning panel and the second molded pulp cushioning panel are a first portion and a second portion of a foldable molded pulp panel having a connection portion connecting the first portion and the second portion.

3. The packing material of claim 1, wherein at least a portion of the second contacting projections are internal second contacting projections, and each internal second contacting projection is positioned between two or more adjacent first projections of the plurality of first projections.

4. The packing material of claim 1, wherein at least a portion of the first projections of the plurality of first projections are first contacting projections, the distal ends of the first contacting projections contacting the second molded pulp cushioning panel.

5. The packing material of claim 4, wherein at least a portion of the second contacting projections are internal second contacting projections, and each internal second contacting projection is positioned between two or more adjacent first projections of the plurality of first projections.

6. The packing material of claim 4, wherein the first contacting projections contact the second molded pulp cushioning panel by the distal end of each first contacting projection contacting at least one of the plurality of second projections, and wherein the second contacting projections contact the first molded pulp cushioning panel by the distal end of each second contacting projection contacting at least one of the plurality of first projections.

7. The packing material of claim 6, wherein the first contacting projections and the second contacting projections are positioned to directly oppose each other with the distal end of each first contacting projection contacting a distal end of a corresponding second contacting projection.

8. The packing material of claim 1, comprising two or more cushioning layers including a first cushioning layer and a second cushioning layer, wherein, for each cushioning layer, the first base layer has an inner side and an outer side, the inner side of the first base layer being positioned to oppose the second molded pulp cushioning panel and the plurality of first projections extending from the inner side of the first base layer, and the second base layer has an inner side and an outer side, the inner side of the second base layer being positioned to oppose the first molded pulp cushioning panel and the plurality of second projections extending from the inner side of the second base layer, and wherein the outer side of one of the first base layer or the second base layer of the first cushioning layer abuts the outer side of one of the first base layer or the second base layer of the second cushioning layer.

9. The packing material of claim 1, wherein the first projections, the second projections, or both are elongated ridges extending parallel to each other.

10. The packing material of claim 1, wherein each first projection of the plurality of first projections has a first geometric shape, and wherein each second projection of the plurality of second projections has a second geometric shape, the second geometric shape being a different geometric shape than the first geometric shape.

11. The packing material of claim 1, wherein each first projection of the plurality of first projections has a first geometric shape, and wherein each second projection of the plurality of second projections has a second geometric shape, the second geometric shape being the same geometric shape as the first geometric shape.

12. The packing material of claim 1, wherein, for each cushioning layer, the second base layer has an inner side and an outer side, the inner side of the second base layer being positioned to oppose the first molded pulp cushioning panel and the plurality of second projections extending from the inner side of the second base layer, each second projection of the plurality of second projections having a tip and a length from the inner side to the tip, the plurality of second projections having a plurality of different lengths.

13. A composite packing material comprising:

one or more cushioning layers arranged to have a product side and an outer side, each cushioning layer including:

a first molded pulp cushioning comprising a plurality of cellulosic fibers molded into a panel having a first base layer and a plurality of first projections extending therefrom; and a second molded pulp cushioning panel comprising a plurality of cellulosic fibers molded into a panel having a second base layer and a plurality of second projections extending therefrom, wherein the first molded pulp cushioning panel and the second molded pulp cushioning panel are positioned to contact each other with the plurality of first projections projecting toward the second molded pulp cushioning panel and the plurality of second projections projecting toward the first molded pulp cushioning panel; and a cellulosic sheet positioned on the outer side of the one or more cushioning layers.

14. The composite packing material of claim 13, wherein the cellulosic sheet is a corrugated fiberboard sheet.

15. The composite packing material of claim 14, further comprising a rigid panel positioned between one of the cushioning layers and the cellulosic sheet, the rigid panel being formed of a cellulosic material, wherein the rigid panel has a rigidity greater than that of each cushioning layer when a load is applied in a thickness direction of the rigid panel or the cushioning layer.

16. The composite packing material of claim 13, wherein the cellulosic sheet is a honeycomb panel including a plurality of cells extending in a thickness direction of the packing material, and the plurality of first projections and the plurality of second projections extend in the thickness direction of the packing material.

17. A composite packing material comprising:

a cushioning layer including a molded pulp cushioning panel comprising a plurality of cellulosic fibers molded into a panel having a base layer and a plurality of projections extending therefrom, each of the projections having a distal end that is distal from the base layer, layer; and a rigid panel contacting the cushioning layer, the rigid panel being formed of a cellulosic material, wherein the rigid panel has a rigidity greater than that of the molded pulp cushioning panel when a load is applied in a thickness direction of the rigid panel or the molded pulp cushioning panel.

18. The composite packing material of claim 17, wherein the rigid panel is a honeycomb panel including a plurality of cells extending in a thickness direction of the packing material.

19. The composite packing material of claim 17, wherein the rigid panel is a lattice-structured panel having cells oriented in the thickness direction of the rigid panel.

20. The composite packing material of claim 17, wherein the plurality of projections extends from the base layer in a direction away from the rigid panel.

21. The composite packing material of claim 17, wherein the plurality of projections extends from the base layer in a direction toward from the rigid panel, the rigid panel including a first surface the distal ends of the plurality of projections contacting the first surface.

22. A packing material comprising:

one or more cushioning blocks capable of being positioned around an object-to-be-shipped on a product side of each cushioning block, each cushioning block comprising:

one or more cushioning layers, each cushioning layer including:

a first molded pulp cushioning panel comprising a plurality of cellulosic fibers molded into a panel having a first base layer and a plurality of first projections extending therefrom, each of the first projections having a distal end that is distal from the first base layer; and a second molded pulp cushioning panel comprising a plurality of cellulosic fibers molded into a panel having a second base layer and a plurality of second projections extending therefrom, each of the second projections having a distal end that is distal from the second base layer, wherein the first molded pulp cushioning panel is positioned with the plurality of first projections projecting toward the second molded pulp cushioning panel, and the second molded pulp cushioning panel is positioned with the plurality of second projections projecting toward the first molded pulp cushioning panel.

23. The packing material of claim 22, wherein each cushioning block further comprises a rigid panel contacting one of the cushioning layers.

24. The packing material of claim 23, wherein the rigid panel is a honeycomb panel having a plurality of cells extending in a direction to extend toward the product side of the cushioning block, the honeycomb panel being formed of a cellulosic material.

25. The packing material of claim 23, wherein the one or more cushioning layers are positioned closer to the product side of each cushioning block than the rigid panel.

26. The packing material of claim 22, wherein each cushioning block further comprises a cellulosic outer sheet, the cellulosic outer sheet being a corrugated fiberboard sheet.

27. The packing material of claim 26, wherein each cushioning block further comprises a rigid panel contacting one of the cushioning layers, the corrugated fiberboard sheet contacting one of the cushioning layers or the rigid panel.

28. The packing material of claim 22, wherein the one or more cushioning blocks includes a first cushioning block and a second cushioning block arranged transversely each other to form an L-shape and a product cavity therebetween.

29. The packing material of claim 22, further comprising a corrugated fiberboard sheet including a first portion, a second portion, and a connecting portion connecting the first portion with the second portion, wherein the one or more cushioning blocks includes a first cushioning block and a second cushioning block, the first cushioning block including the first portion of the corrugated fiberboard sheet and the second cushioning block including the second portion of the corrugated fiberboard sheet.

30. The packing material of claim 22, further comprising:

a corrugated fiberboard sheet including a plurality of backing portions connected to each other by a plurality of connecting portions, each connecting portion connecting one backing portion with another backing portion; and a plurality of the cushioning blocks, each cushioning block further comprising a backing portion of the plurality of backing portions, wherein the plurality of backing portions connected to each other in a manner to be foldable into a shipping box.

* * * * *